US010760417B2

(12) United States Patent
Orban

(10) Patent No.: US 10,760,417 B2
(45) Date of Patent: Sep. 1, 2020

(54) SYSTEM AND METHOD FOR SURFACE MANAGEMENT OF DRILL-STRING ROTATION FOR WHIRL REDUCTION

(71) Applicant: Schlumberger Technology Corporation, Sugar Land, TX (US)

(72) Inventor: Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 101 days.

(21) Appl. No.: 15/883,242

(22) Filed: Jan. 30, 2018

(65) Prior Publication Data

US 2019/0234208 A1 Aug. 1, 2019

(51) Int. Cl.

| | |
|---|---|
| ***E21B 49/00*** | (2006.01) |
| ***E21B 47/12*** | (2012.01) |
| ***E21B 21/12*** | (2006.01) |
| ***E21B 7/24*** | (2006.01) |
| ***E21B 21/08*** | (2006.01) |
| ***E21B 7/06*** | (2006.01) |
| ***E21B 47/022*** | (2012.01) |
| ***E21B 47/024*** | (2006.01) |
| ***E21B 47/06*** | (2012.01) |
| ***E21B 4/02*** | (2006.01) |

(52) U.S. Cl.

CPC ..... *E21B 49/005* (2013.01); *E21B 4/02* (2013.01); *E21B 7/064* (2013.01); *E21B 7/24* (2013.01); *E21B 21/08* (2013.01); *E21B 21/12* (2013.01); *E21B 47/022* (2013.01); *E21B 47/024* (2013.01); *E21B 47/06* (2013.01); *E21B 47/122* (2013.01)

(58) Field of Classification Search

CPC ..... E21B 4/04

See application file for complete search history.

(56) References Cited

U.S. PATENT DOCUMENTS 4,854,397 A 8/1989 Warren et al.
4,971,522 A 11/1990 Butlin (Continued)

FOREIGN PATENT DOCUMENTS

EP 0774563 A2 5/1997

OTHER PUBLICATIONS

Grigg et al., "Predicting Phase Behavior of Mixtures of Reservoir Fluids with Carbon Dioxide", SPE 11960, 58th Annual Technical Conference and Exhibition, Oct. 5-8, 1983; 12 pages.

(Continued)

*Primary Examiner* — David J Bagnell
*Assistant Examiner* — Dany E Akakpo
(74) *Attorney, Agent, or Firm* — Rachel E. Greene

(57) ABSTRACT

A system and method to reduce a whirl effect on a rotation of a drill string with an AC induction motor mechanically coupled to a rotary drilling system and configured to drive the rotary drilling system and the drill string attached thereto. Additionally, the system includes an electronic inverter to generate supplied power for the AC induction motor and a controller configured to drive the operation of the electronic inverter to impose a virtual drive characteristic relating a torque output of the motor with speed of the motor, determine a desired nominal operating point, and determine presence of whirl in the drill string from torque of the rotary drilling system and speed of the drill string.

14 Claims, 31 Drawing Sheets

(56) References Cited

U.S. PATENT DOCUMENTS

| | | | |
|---|---|---|---|
| 5,205,163 | A | 4/1993 | Sananikone |
| 5,259,468 | A | 11/1993 | Warren et al. |
| 5,390,748 | A | 2/1995 | Goldman |
| 5,433,279 | A | 7/1995 | Tessari et al. |
| 5,465,799 | A | 11/1995 | Ho |
| 5,467,832 | A | 11/1995 | Orban et al. |
| 5,474,142 | A | 12/1995 | Bowden |
| 5,738,178 | A | 4/1998 | Williams et al. |
| 5,842,149 | A | 11/1998 | Harrell et al. |
| 6,050,348 | A | 4/2000 | Richarson et al. |
| 6,166,654 | A | 12/2000 | Van Den Steen |
| 6,327,539 | B1 | 12/2001 | Keultjes et al. |
| 6,338,390 | B1 | 1/2002 | Tibbitts |
| 6,382,331 | B1 | 5/2002 | Pinckard |
| 6,414,455 | B1 | 7/2002 | Watson |
| 6,802,378 | B2 | 10/2004 | Haci et al. |
| 7,152,696 | B2 | 12/2006 | Jones |
| 7,404,454 | B2 | 7/2008 | Hulick |
| 7,461,705 | B2 | 12/2008 | Hulick et al. |
| 7,588,100 | B2 | 9/2009 | Hamilton |
| 7,802,634 | B2 | 9/2010 | Boone |
| 7,823,655 | B2 | 11/2010 | Boone et al. |
| 8,287,246 | B2 | 10/2012 | Plitt et al. |
| 8,360,171 | B2 | 1/2013 | Boone et al. |
| 8,387,720 | B1 | 3/2013 | Keast et al. |
| 8,528,663 | B2 | 9/2013 | Boone |
| 8,602,126 | B2 | 12/2013 | Boone et al. |
| 8,672,055 | B2 | 3/2014 | Boone et al. |
| 8,689,906 | B2 | 4/2014 | Nessjoen et al. |
| RE44,956 | E | 6/2014 | Richardson et al. |
| RE44,973 | E | 7/2014 | Richardson et al. |
| 8,833,488 | B2 | 9/2014 | Knudsen et al. |
| 8,939,233 | B2 | 1/2015 | Edbury et al. |
| 8,939,234 | B2 | 1/2015 | Mebane, III et al. |
| 8,950,512 | B2 | 2/2015 | Nessjoen et al. |
| 9,249,655 | B1 | 2/2016 | Keast et al. |
| 9,290,995 | B2 | 3/2016 | Boone et al. |
| 9,359,881 | B2 | 6/2016 | DiSantis |
| 9,506,336 | B2 | 11/2016 | Orbell |
| 9,581,008 | B2 | 2/2017 | Kyllingstad |
| 9,593,567 | B2 | 3/2017 | Pink et al. |
| 9,650,880 | B2 | 5/2017 | Bowley et al. |
| 9,708,900 | B2 | 7/2017 | Veltman |
| 9,885,231 | B2 | 2/2018 | Nessjoen et al. |
| 10,215,010 | B1 * | 2/2019 | Hadi ..... E21B 44/00 |
| 2015/0107897 | A1 | 4/2015 | Nessjoen et al. |
| 2015/0372492 | A1 * | 12/2015 | Kuttel ..... H02J 3/38 175/203 |
| 2016/0047219 | A1 | 2/2016 | Jeffryes |
| 2016/0115778 | A1 * | 4/2016 | van Oort ..... E21B 47/0006 175/27 |
| 2016/0168973 | A1 | 6/2016 | Dykstra et al. |
| 2016/0194649 | A1 | 7/2016 | Yohn |
| 2016/0237802 | A1 | 8/2016 | Boone et al. |
| 2016/0273332 | A1 | 9/2016 | Dwars et al. |
| 2016/0281488 | A1 | 9/2016 | Dwars et al. |
| 2017/0101861 | A1 | 4/2017 | Kyllingstad |
| 2018/0094512 | A1 | 4/2018 | Sadilek et al. |

OTHER PUBLICATIONS

Halsey et al., "Torque Feedback Used to Cure Slip-Stick Motion", SPE 18049, 63rd Annual Technical Conference and Exhibition of the Society of Petroleum Engineers, Oct. 2-5, 1988, 6 pages.

Genevois et al., "Gyrostab Project: The Missing Link—Azimuth and inclination mastered with new principles for standard rotary BHAs", SPE/IADC Drilling Conference, SPE/IADC 79915, Feb. 19-21, 2003; 11 pages.

Stockhausen et al., "Continuous Direction and Inclination Measurements Lead to an Improvement in Wellbore Positioning", SPE 79917, SPE/IADC Drilling Conference, Feb. 19-21, 2003, 16 pages.

* cited by examiner

SYSTEM AND METHOD FOR SURFACE MANAGEMENT OF DRILL-STRING ROTATION FOR WHIRL REDUCTION

BACKGROUND

For the exploration of oil and gas, wells are drilled, which connect the oil/gas reservoir to the surface. The well is drilled by a cutting tool such as a drill bit attached at the bottom of the drill string that is rotated by a rig at the surface. The drill string may include a plurality of pipe (i.e., the drill pipe) coupled end to end to be thousands of meters long. The lower part of the drill string is called the Bottom Hole Assembly (BHA) and consists of specialty tools and heavier thick-walled pipes, such as drill collars and mud motors. With the drill bit attached to the BHA, the drill bit is on the bottom of the wellbore, and the upper end of drill string is held by the rig. As such, the drill pipe portion of the drill string is therefore constantly in tension while the BHA is partly in compression. Furthermore, fluids are introduced into the wellbore by being pumped through the drill string and out through nozzles of the drill bit. From the drill bit, the fluids return to the surface via an annulus between the drill string and wellbore to transport cuttings from the bit to the surface and lubricate the drilling process.

During subsurface drilling by the drilling rig, the drill string may experience various forces and torques as it rotates within a wellbore. The drill string may be rotated by a top drive or a kelly, to make a drill bit turn at the bottom of the wellbore. Torque is applied to sustain the rotation, as the drill bit may be in contact with the bottom hole to perform drilling, and friction may be present between the drill string and the wellbore. Due to the presence of torque along the drill string, the drill string may be twisted with a deformation angle that increases with depth, storing elastic energy with the deformed structure. In addition, the inertia affects the rotation of the drill string during periods in which its speed of rotation changes. Furthermore, lateral displacement may occur during rotation due some centrifugal effect. As radial movements are limited by the presence of the wellbore, radial shocks occurs and the rotating string bounces back with more risk of future radial shock. When such process is sustained, it may develop into sustained whirling pattern. Such successive repeated shocks may be forwards whirling of backwards whirling, with nutation of the center of rotation of the rotary element.

With each contact with the wall, a tangential impulse is generated due to the rotation of the tubular. This tangent force applied on the external surface of the tubular is obviously the origin of a torque impulse. These frictional torque impulses may result into short reduction of rotational speed of the drill string. Whirling is a high frequency process (several contacts and impulses per turn) of radial shocks involving radial displacement. As such, the frequency of contact may be 3 to 20 times per turn. Such a frequency may be 5 to 60 hertz depending on the drill-string RPM. The drill string acts as a low pass filter by the combination of the rotational inertia and torsional rigidity. The excited high frequency effect does not transmit over long distance; however, the consumed torque at each impact must be provided by the surface drive system and appears as an increase of the average torque.

Furthermore, "stick-and-slip" may occur along the drill string and especially at the drill bit and BHA (including stabilizer). Stick-and-slip refers to irregular rotational movement of a drill string due to the forces and torques caused by variation of the friction at the drill bit (cutters) and drill string elements (e.g., a hole bottom, a liner, a casing, a wall of the wellbore, cuttings, etc.) and the wellbore. Such unsteady friction at the contact points causes the drill string to slow down and possibly stops (stick). When considering "stick-and-slip" at the bit face of PCD bit, this effect may be generated by the cutters which may vary their depth of cut (penetration into the well-bore bottom face) due to unsteady WOB. For example, teeth of a drill bit can lock in a hole-bottom due to a sudden increase of axial load (weight-on-bit or "WOB"). The required rotary torque immediately adjusts to this effect. When considering "stick and slip" along the BHA (collar surface or stabilizer blades), the effect may be generated by the dependence of friction factor on the relative velocity of the elements versus the bore wall. Typically, the magnitude of the friction factor increases as the rotational velocity of the drill string decreases, and has its greatest effect when the drill string has substantially stopped. Sticking may also occur due to an element of the drill string locking with one of the elements surrounding the wellbore (i.e., stabilizer blades can stick in a discontinuity of the wellbore's wall).

The stick-and-slip effect is a low frequency process, as it typically involves more than one turn of the drill string. Its period may be from 10 sec to 0.5 seconds. The required torque to sustain the rotation is varying and must provide by the surface equipment such as top drive or rotary table. With long period effect, the torque required from the surface drive equipment may clearly vary. Transmission of this variable torque, however, modify twisting of the drill string along its length, as it is an elastic system. This effect of variable torque and twisting affects the stored potential energy in the drill string due to elastic deformation. As multiple inertias are present along the drill-string, the variation of rotational speed affects the rotational kinetic energy in the drill string. Such variation of potential and kinetic energies may be associated with torsional resonance along the drill string. Thus, over time, operation of the drill string can operate in pattern in which the drill string cyclically slows, with potential stops, and quickly speeds up. As a result of this pattern, the drill string experiences a series of spikes in speed and torque, and may reduce the life span of the drill string and the efficiency of the drilling operation. It is critical to mitigate these phenomenon's to limit potential damage on the components. The drilling industry has proposed various methods to limit the effect of "stick-and-slips". However, it is also critical to detect and limit the effect of whirling and avoiding confusion with the stick-and-slip situation.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a system to reduce a whirl effect on a rotation of a drill string, which may include an AC induction motor mechanically coupled to a rotary drilling system and configured to drive the rotary drilling system and the drill string attached thereto, an electronic inverter to generate supplied power for the AC induction motor, and a controller configured to drive the operation of the electronic inverter to impose a virtual drive characteristic relating a torque output of the motor with speed of the motor, determine a desired nominal operating point, and determine presence of whirl in the drill string from torque of the rotary drilling system and speed of the drill string.

In one aspect, the embodiments disclosed herein relate to a method to detect a whirl effect on a drill string, which may include driving a rotary drilling system, and the drill string attached thereto, with an AC induction motor having power supplied by an electronic inverter along a virtual drive characteristic relating torque output of the motor with speed of the motor, and determining a presence of whirl in the drill string from a torque of the rotary drilling system and a speed of the drill string.

Other aspects and advantages will be apparent from the following description and the appended claims.

DETAILED DESCRIPTION

Figure 1B:
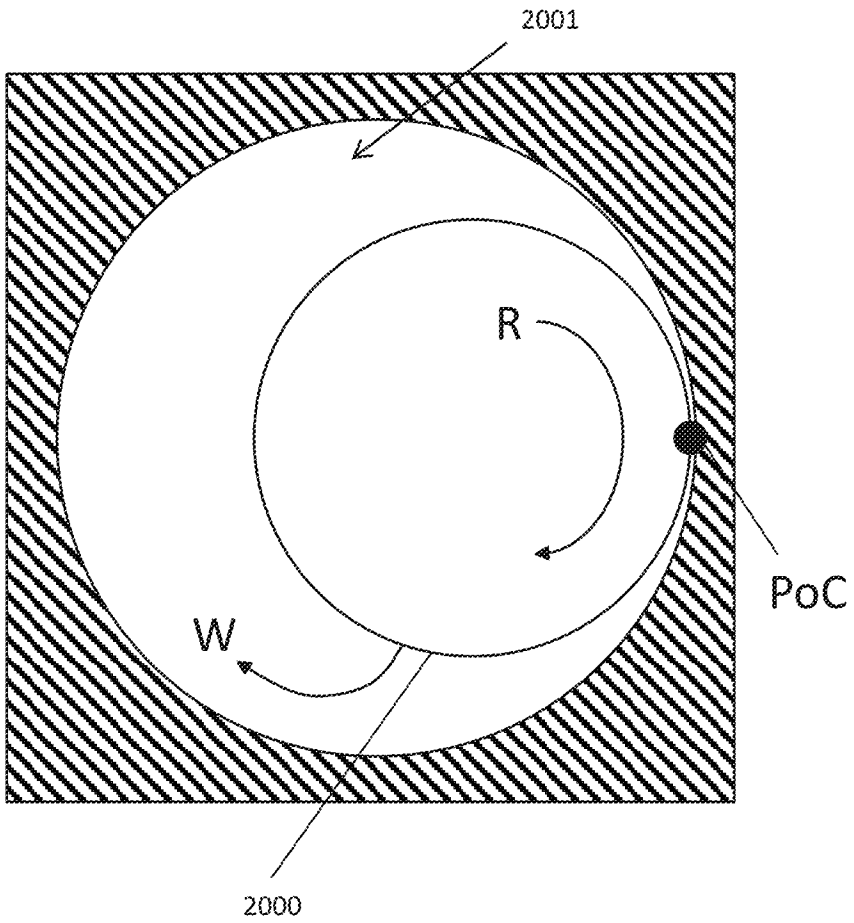
FIGS. 1A-1D show a top view of drill string in a well bore according to one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

Figure 1A:
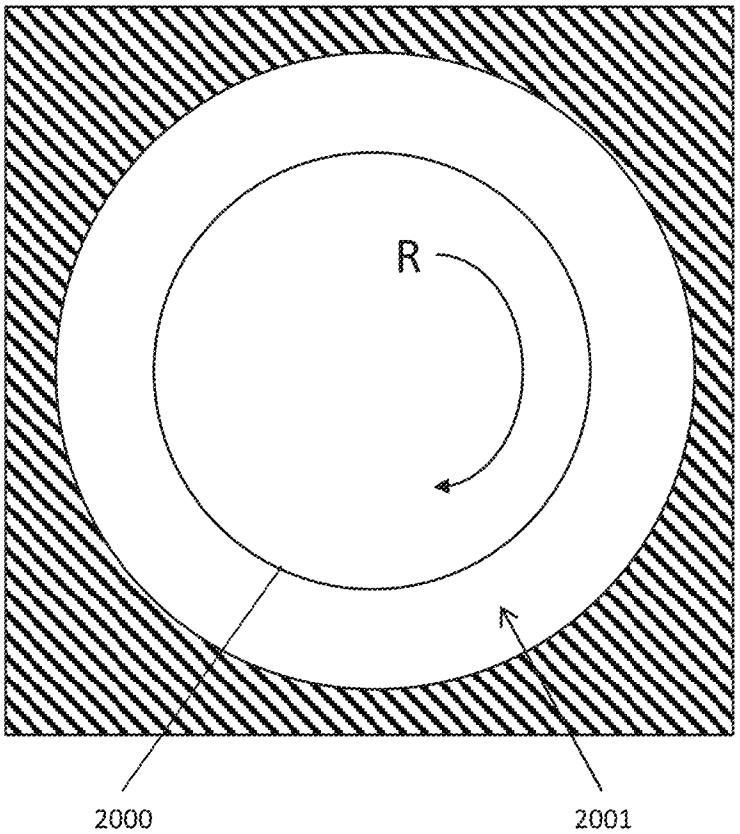

Referring to FIG. 1A, a drill string 2000 is centralized in a well bore 2001 and rotates in a direction shown by arrow R. However, as described above, the drill string 2000 may be under lateral displacement which may induce shocks and a "whirl effect". The whirl effect refers to lateral movement of a rotating drill string due to the radial forces (such as induced resonance due to rotation). The radial forces may generate radial displacement of the rotating string in the well-bore so that temporary contacts may occur. Then additional torque may also be required due to these contacts with elements surrounding the rotating assembly (e.g., a hole bottom, a liner, a casing, a wall of the wellbore, cuttings, etc.). The whirl effect occurs most frequently but is not limited to near vertical walls. Whirl is very sensitive to variations in speed, clearance (such as based on amount of cutting, presence of stabilizer, etc), and viscosity of the fluid, for example. The contact may generate lateral impulses, which causes the drill string to bounce around from one or more of the elements or points surrounding the wellbore. Lateral impulses and deformations may be destructive to the drill string as the drill string impacting against the wellbore creates large-magnitude shock and bending moment fluctuation that result in higher rates of component and connection fatigue. There are three main types of whirl effect: forward, backward and chaotic whirl. Referring to FIG. 1B, a forward whirl is when the drill string 2000 hits the wellbore 2001 at a point of contact (PoC) as the drill string 2000 rotates in direction of arrow R. Additionally, in forward whirl, the drill string 2000 bounces off the wellbore 2001 moves in the same direction (see arrow W) as the drill string 2000 rotates (see arrow R) and continues to hit and bounce off the wellbore 2001 in the direction of arrow W. Furthermore, forward whirl may damage/destroy bits, drill string, and the BHA.

Figure 1D:
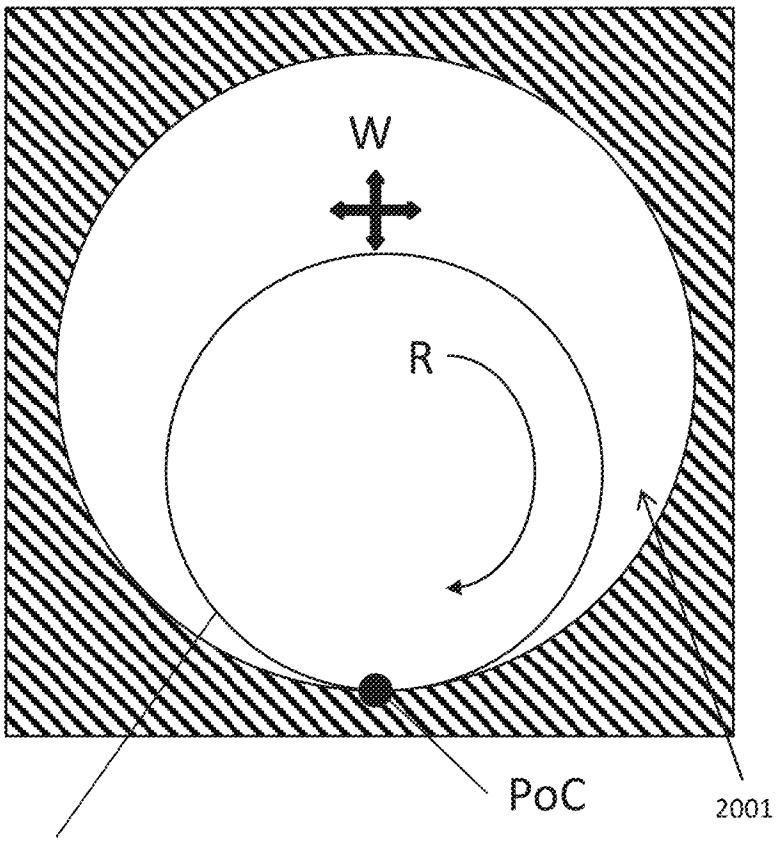
Figure 1C:
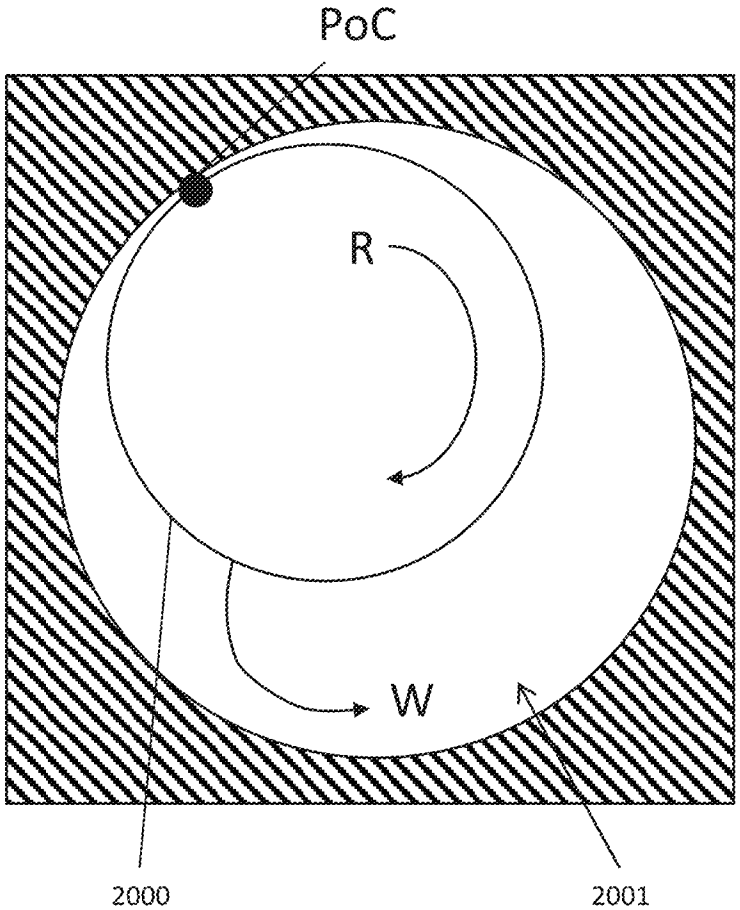

As shown in FIG. 1C, backward whirl is very similar to forward whirl except friction between the formation and the drill string 2000 is greater. At each contact, the drill string is submitted to a bouncing effect due the elastic behavior of the materials, which causes the drill string 2000 hit the wellbore 2001 at the point of contact PoC and continues to hit and bounce off the wellbore 2001. At each contact, a tangent force occurs due to the fiction effect and the radial contact force. The direction of the bouncing depends on the combination of the radial accelerations due to bouncing and the tangent force. FIG. 1C shows the case of backwards whirling as the arrow W which is the opposite direction of the rotation (see arrow R) of the drill string 2000. If whirling is backwards, the number of shocks with bore-wall may typically be high (i.e., several shocks per turn) and the rotating tubular may develop complex nutation displacement of its center (see FIG. 1D). In chaotic whirl, as shown by FIG. 1D, the bouncing path may be quite complex and there may be no preferential direction (see arrow W) in which the drill string 2000 bounces off the wellbore 2001 from the point of contact PoC. In occurrence of backward whirl or chaotic whirl, the contacts (shocks) with the bore-wall and the drill string may be quite frequent (high repetition rate). At each shock, there is occurrence of a tangent force and so an impulse of required drive torque. When considering the axial extending of the drill string, such shocks are located at specific axial position and this may create impulse on bending moment onto the drill string. Additionally, bit whirl is often associated with PDC bits because of their aggressive side cutting action preferably on harder rocks and near vertical holes. Generally, bit whirl may be caused by non-symmetric cutting action of a real formation that displaces the bit from its center of rotation, and then allows the bit to move. Such whirling effects may induce high frequency fatigue effect in the drill string and drill string component with risk of failure.

Systems and methods disclosed herein are directed to controlling a drill string assembly to limit effects of irregular rotary movements associated with whirling effect which may occur as results of some operations of a drilling rig. A system in accordance with aspects of the present disclosure includes a surface motor mechanically coupled to a rotary drilling system that drive the rotary drilling system. More specifically, implementations of the systems and methods can control torque and speed variations of a drill string assembly driven by an alternating current (AC) induction motor and a variable frequency drive (VFD) to limit the effect of the lateral vibrations on drill string assembly or whirl while operating in a wellbore.

In accordance with aspects of the systems and methods disclosed herein, rotational parameters of the drill string assembly and parameters of a motor drive of the drill string are measured to control the VFD and its associated motor so as to minimize the effects of lateral vibrations on the drill string and the occurrence of whirling such as rotating, resonance rpm of a drill string in a bore hole while simultaneously being able to minimize the effect of stick-and-slip. One of the methods to mitigate the effect of stick-and-slip along the well-bore is obtained by actively controlling a frequency of AC power output by the VFD based on a "virtual drive characteristic" ("VDC") between torque and speed of the motor. By controlling of the frequency of the AC power output to the motor based on the virtual drive characteristic, the motor outputs a torque that varies smoothly in opposite way of the smooth variation of speed in response to rotational conditions along the wellbore, rather than producing sharp torque variations and low variation of speed that may otherwise occur for the similar variation of rotational conditions along the wellbore. The superposition of whirling effect over stick-and-slip mitigation system may create additional difficulties for the control of the motor, as the presence whirling effect may create additional variation of drive motor frequency and motor RPM. Such effect may induce additional torsional fatigue in the drill string, while the lateral shock generated by the whirling effect may still be present for a fair percentage of the total time. In accordance with aspects of the systems and methods disclosed herein, the system allows the control system to distinguish between the two effects and applies an optimum 'virtual drive characteristic" to resolve to minimize the whirling effect while also providing adequate mitigation for variation of the rotational parameters due to stick-and-slip effect, The VDC includes a predetermined system response defining a relationship between a target torque and speed at or around a selected operating point. The virtual drive characteristic can be a substantially linear profile with a slope ($\alpha$) and represents the relationship between torque and speed of a motor. Implementations consistent with those disclosed herein use the virtual drive characteristic to control the motor to operate with a substantially constant output power, such that the speed at which the drill string assembly is driven decreases substantially as torque increases. For example, implementations change the speed (i.e., the rotations per minute (rpm)) of the drill string due to change in well rotational conditions (e.g., whirl effect and/or stick-slip) by dynamically controlling the speed and torque output of the motor. By doing so, the disclosed systems and methods can modify the effective (or apparent) mechanical impedance coupling between the motor and the drill string assembly to insure a smooth power transfer to the drill string while operating in presence of variation of well-rotational conditions (e.g., whirl effect). This smooth power transfer would reduce the abrupt change of torque at the top drive and reduce the fatigue of the drill-string and top drive.

Additionally, systems and methods consistent with those disclosed herein can determine and use a virtual motor rotor inertia ($\beta v$) (e.g., a virtual flywheel) to improve the rotation of a rotary drilling system which includes the drill-string, the bottom-hole assembly ("BHA").and the rotating part of the top-drive (e.g., the motor rotor). Such improvement can modify a resonance frequency of the rotary drilling system to insure that the resonance frequencies of the rotary drilling system do not match the frequencies of the source of excitation by variation of well-rotational conditions (such as a rotating, resonance rpm of a drill string on a bore hole). Further, systems and methods consistent with those disclosed herein can improve the rotation of the drill string by determining and using an adjustment rate ($\lambda$) for dynamically adjusting the frequency of the output power provided to the motor, allowing a minimization of the total noise generated within the drive system associated with the rotary drilling system.

Figure 2:
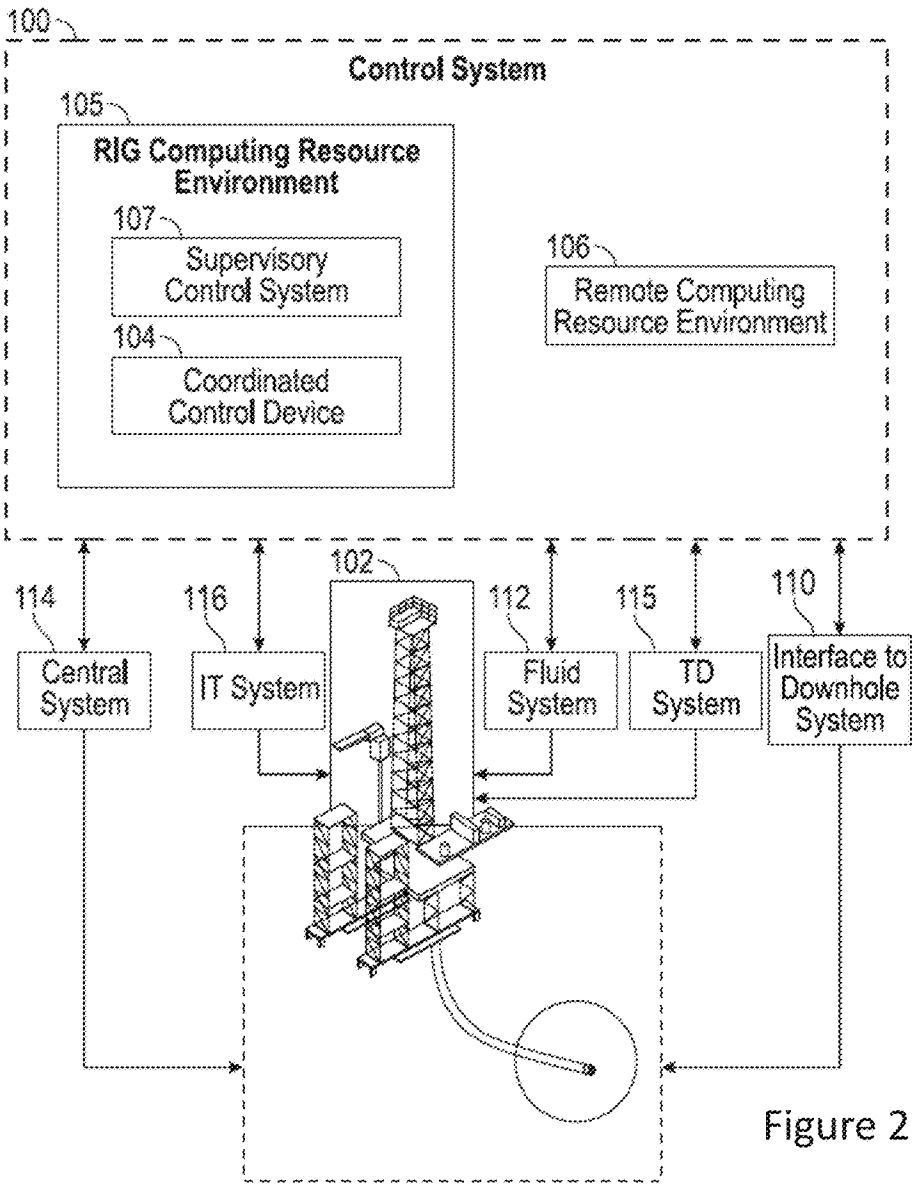
FIG. 2 illustrates a conceptual, schematic view of a control system for a drilling rig, according to an implementation.

FIG. 2 illustrates a conceptual, schematic view of a control system 100 for a drilling rig 102, according to an implementation. The control system 100 may include a rig computing resource environment 105, which may be located onsite at the drilling rig 102 and, in some implementations, may have a coordinated control device 104. The control system 100 may also provide a supervisory control system 107. In some implementations, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some implementations, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 2. For example, the drilling rig 102 may equipped with an interface to a downhole system 110, a fluid system 112, a central system 114, and top drive ("TD") system 115. These systems 110, 112, 114, and 115 may also be examples of "subsystems" of the drilling rig 102, as described herein. In some implementations, the drilling rig 102 may also include an information technology (IT) system 116.

A downhole system may include, for example, a bottom hole assembly (BHA), mud motors, rotary steerable system, sensors, MWD and LWD systems, etc. disposed along the drill string, and/or other drilling equipment configured to be deployed into the wellbore. (See, e.g., FIG. 4.) Accordingly, the downhole system may refer to tools disposed in the wellbore, e.g., as part of the drill string used to drill the well. The interface to the downhole system 110 may include one or devices that communicate with a downhole system (not shown) which may include MWD, RSS, and LWD components to send and/or received information to and/or from the downhole system.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc.

The top drive system 115 can be a system that rotates a drill string assembly. The top drive system 115 can include, a motor connected with appropriate gearing to a short section of pipe (a.k.a., "a quill") that in turn may be mechanically linked to a saver sub or the drill string itself. Additionally, the top drive system 115 can include control system that, among other functions, can control the motor to minimize stick and slip of the drill string in accordance with aspects of the present disclosure. In implementations, the top drive system 115 can be a subsystem of the central system 114 that performs the rotating operations of the drilling rig 102.

The IT system 116 may include software, computers, and other IT equipment for implementing IT operations of the drilling rig 102. In implementations, some or all of the components and/or functions of the top drive system 115 implemented within components of the central system 114 and/or the IT system.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the control system 100 may collect temporally and depth aligned surface data and downhole data from the drilling rig 102 and store the collected data for access onsite at the drilling rig 102 or offsite via the rig computing resource environment 105. Thus, the control system 100 may provide monitoring capability. Additionally, the control system 100 may include supervisory control via the supervisory control system 107.

In some implementations, one or more of the interface to the interface to the downhole system 110, fluid system 112, central system 114, and the top drive system 115 may be manufactured and/or operated by different vendors. In such an implementation, certain systems may not be capable of unified control (e.g., due to different protocols, restrictions on control permissions, safety concerns for different control systems, etc.). An implementation of the control system 100 that is unified, may, however, provide control over the drilling rig 102 and its related systems (e.g., the interface to the downhole system 110, fluid system 112, and/or central system 114, etc.). Likewise, the fluid system 112, the central system 114, and the top drive system 115 may contain one or a plurality of fluid systems, central systems, and top drive systems, respectively.

In addition, the coordinated control device 104 may interact with the onsite or offsite user device(s) (e.g., human-machine interface(s) 118, 120). For example, the coordinated control device 104 may receive commands from the user devices and may execute the commands using two or more of the systems 110, 112, 114, and 115, e.g., such that the operation of the two or more systems 110, 112, 114, and 115 act in concert and/or off-design conditions in the systems 110, 112, 114, and 115 may be avoided.

Figure 3:
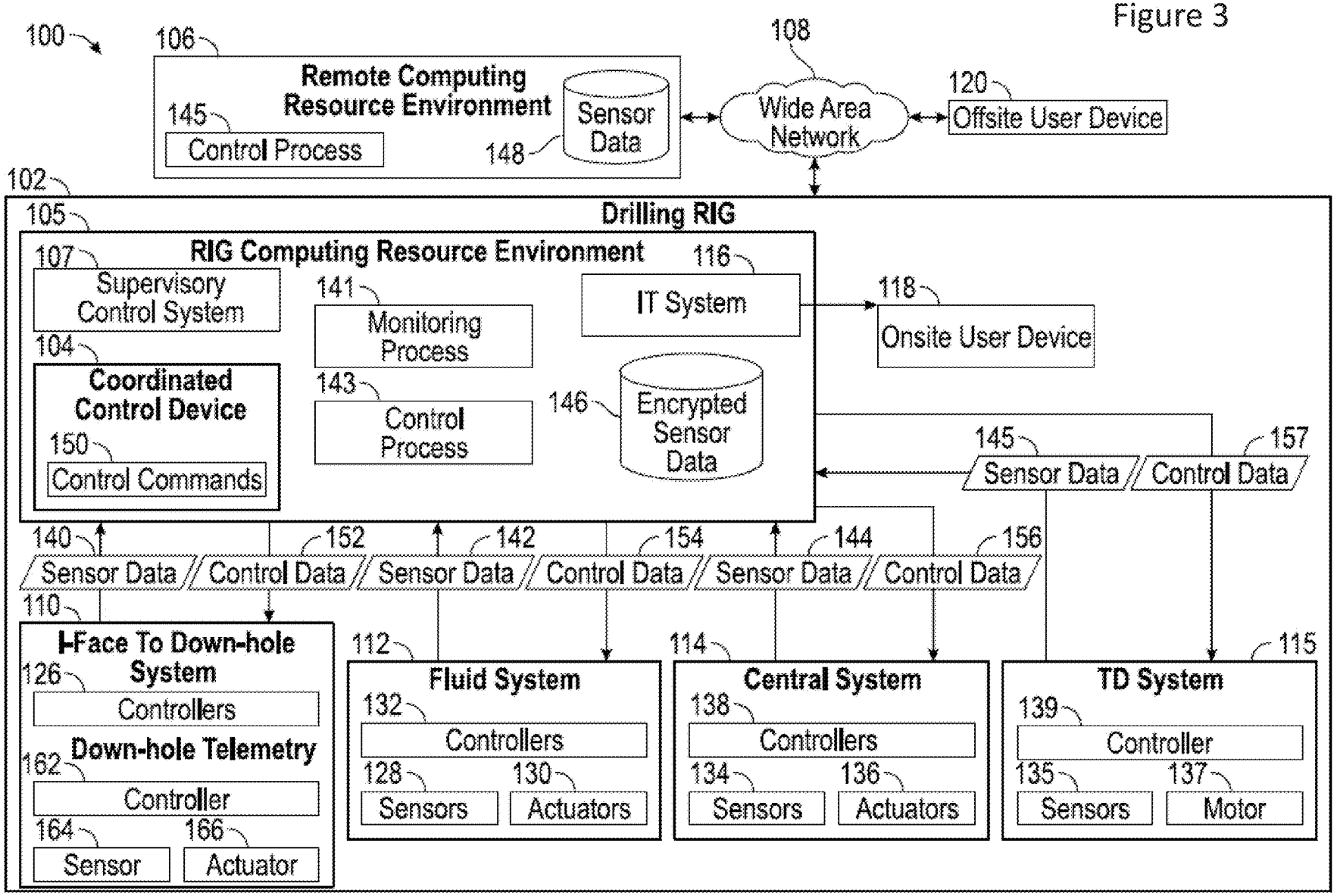
FIG. 3 illustrates a conceptual, schematic view of a control system according to one or more embodiments of the present disclosure.

Referring to FIG. 3, in one or more embodiments, FIG. 3 illustrates a system of a drilling rig 102 with an interface to the downhole system 110, a fluid system 112, a central system 114, a top drive system 115, and an IT system 116. It is further envisioned that one or more onsite user devices 118 may also be included on the drilling rig 102. The onsite user devices 118 may interact with the IT system 116. Additionally, the onsite user devices 118 may include any number of user devices, for example, stationary user devices intended to be stationed at the drilling rig 102 and/or portable user devices. Furthermore, the onsite user devices 118 may include a desktop, a laptop, a smartphone, a personal data assistant (PDA), a tablet component, a wearable computer, or other suitable devices. As such, the onsite user devices 118 may communicate with a rig computing resource environment 105 of the drilling rig 102, the remote computing resource environment 106, or both.

Further seen by FIG. 3, one or more offsite user devices 120 may also be included in the system 100. The offsite user devices 120 may include a desktop, a laptop, a smartphone, a personal data assistant (PDA), a tablet component, a wearable computer, or other suitable devices. Additionally, the offsite user devices 120 may be configured to receive and/or transmit information (e.g., monitoring functionality) from and/or to the drilling rig 102 via communication with the rig computing resource environment 105. In one or more embodiments, the offsite user devices 120 may provide control processes for controlling operation of the various systems of the drilling rig 102 and may communicate with the remote computing resource environment 106 via the network 108. As discussed above the user devices 118 and/or 120 may be examples of a human-machine interface. The user devices 118, 120 may allow feedback from the various rig subsystems to be displayed and allow commands to be entered by the user. In various implementations, such human-machine interfaces may be onsite or offsite, or both.

The systems of the drilling rig 102 may include various sensors, motors, and controllers (e.g., programmable logic controllers (PLCs)), which may provide feedback for use in the rig computing resource environment 105. The fluid system 112 may include sensors 128, actuators 130, and controllers 132. Additionally, the central system 114 may include sensors 134, actuators 136, and controllers 138. Further, the top drive system 115 can include sensors 135, motor 137, and controller 139. The interface to downhole system 110 allows information exchange with the downhole system of the rig. The interface to the downhole system 110 can include, in one or more embodiments, controllers 126 to communicate with a downhole controller 162 that communicates with an up-hole controller via down-hole telemetry. Additionally, the down-hole telemetry may be wireless such as MWD mud-pulse or E_MAG telemetry or cable base communication or wire-drill-pipe telemetry system. This allows the interface to the downhole system 110 to access devices remotely located in the downhole system (e.g., sensors, actuators, motors, and downhole controller).

Still referring to FIG. 3, sensors 164, 128, 134, and 135, as well as the sensors located in the downhole system (not shown), may include any suitable sensors for operation of the drilling rig 102 and drilling operations. It is further envisioned, the aforementioned sensors may include a camera, a speed sensor (measuring, e.g., revolutions per second), a torque sensor (e.g., of motor 137), a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors. The sensors described above may provide sensor data feedback to the rig computing resource environment 105 (e.g., to a coordinated control device 104). For example, downhole system sensors 164 and sensors located in the downhole system (not shown) may provide sensor data 140, the fluid system sensors 128 may provide sensor data 142, the top drive sensors 135 may provide sensor data 145, and the central system sensors 128 may provide sensor data 144. The sensor data 164, 140, 142, 144, and 145 may include, for example, equipment operation status (e.g., on or off, up or down, set or release, etc.), drilling parameters (e.g., depth, hook load, torque, etc.), auxiliary parameters (e.g., vibration data of a pump) and other suitable data. In one or more embodiments, the acquired sensor data may include or be associated with a timestamp (e.g., a date, time or both) indicating when the sensor data was acquired. Further, the sensor data may be aligned with a depth or other drilling parameter.

Furthermore, acquiring the sensor data into the coordinated control device 104 may facilitate measurement of the same physical properties at different locations of the drilling rig 102 and downhole system 160. As such, measurement of the same physical properties may be used for measurement redundancy to enable continued operation of the well. Additionally, in one or more embodiments, measurements of the same physical properties at different locations may be used for detecting equipment conditions among different physical locations. It is further envisioned, in one or more embodiments, measurements of the same physical properties using different sensors may provide information about the relative quality of each measurement, resulting in a "higher" quality measurement being used for rig control, and process applications. The variation in measurements at different locations over time may be used to determine equipment performance, system performance, and scheduled maintenance due dates. Furthermore, aggregating sensor data from each subsystem into a centralized environment may enhance drilling process and efficiency. For example, whirl status may be acquired from the sensors and provided to the rig computing resource environment 105, which may be used to define a rig state for automated control. In another example, acquisition of fluid samples may be measured by a sensor and related with bit depth and time measured by other sensors. As such, acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104, as seen in FIG. 3, may facilitate control of individual systems (e.g., the interface to the downhole system 110, the central system 114, the downhole system (not shown), or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. Additionally, the downhole pressure may be affected by both the fluid system 112 (e.g., pump rate and choke position) and the central system 114 (e.g., tripping speed). When it is desired to maintain certain downhole pressure during tripping, the coordinated control device 104 may be used to direct the appropriate control commands. Furthermore, for mode based controllers which employ complex computation to reach a control set point, which are typically not implemented in the subsystem PLC controllers due to complexity and high computing power demands, the coordinated control device 104 may provide the adequate computing environment for implementing these controllers.

In one or more embodiments, control of the various systems of the drilling rig 102 may be provided via a multi-tier (e.g., three-tier) control system that includes a first tier of the controllers 126, 132, 138, and 139, a second tier of the coordinated control device 104, and a third tier of the supervisory control (e.g., supervisory control system 107). The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other implementations, coordinated control may be provided by one or more controllers of one or more of the drilling rig systems 110, 112, 114, and 115 without the use of a coordinated control device 104. In such implementations, the rig computing resource environment 105 may provide control processes directly to these controllers for coordinated control. For example, in some implementations, the controllers 126, 132, 138, and/or 139 may be used for coordinated control of multiple systems of the drilling rig 102.

The sensor data 140, 142, 144, and 145 may be received by the coordinated control device 104 and used for control of the drilling rig 102 and the drilling rig systems 110, 112, 114, and 115. In one or more embodiments, the sensor data 140, 142, 144, and 145 may be encrypted to produce encrypted sensor data 146. For example, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) since such devices gain access to one or more networks of the drilling rig 102. Furthermore, the sensor data 140, 142, 144, and 145 may include a timestamp and an aligned drilling parameter (e.g., depth) as discussed above.

It is further envisioned that the encrypted sensor data 146 may be sent to the remote computing resource environment 106 via the network 108 and stored as encrypted sensor data 148. The rig computing resource environment 105 may provide the encrypted sensor data 148 available for viewing and processing offsite, such as via offsite user devices 120. As such, access to the encrypted sensor data 148 may be restricted via access control implemented in the rig computing resource environment 105. Furthermore, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. Additionally, the encrypted sensor data may be decrypted by the rig computing resource environment 105 before transmission or decrypted on an offsite user device after encrypted sensor data is received. The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

One skilled in the art will appreciate how the rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g., 110, 112, 114, and 115) to enable coordinated control between each system of the drilling rig 102. The coordinated control device 104 may execute control commands 150 for control of the various systems of the drilling rig 102 (e.g., 110, 112, 114, and 115). Thus, the coordinated control device 104 may send control data determined by the execution of the control commands 150 to one or more systems of the drilling rig 102. For example, control data 152 may be sent to the interface to the downhole system 110, control data 154 may be sent to the fluid system 112, control data 157 may be sent to the top drive system 115, and control data 156 may be sent to the central system 114. The control data may include, for example, operator commands (e.g., turn on or off a pump, switch on or off a valve, update a physical property set point, etc.). In one or more embodiments, the coordinated control device 104 may include a fast control loop that directly obtains sensor data 140, 142, 144, and 145 may and executes, for example, a control algorithm. Additionally, the coordinated control device 104 may include a slow control loop that obtains data via the rig computing resource environment 105 to generate control commands.

In one or more embodiments, the coordinated control device 104 may intermediate between the supervisory control system 107 and the controllers 126, 132, 138, and 139 of the systems 110, 112, 114, and 115. For example, a supervisory control system 107 may be used to control systems of the drilling rig 102. The supervisory control system 107 may include, for example, devices for entering control commands to perform operations of systems of the drilling rig 102. Furthermore, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. The supervisory control system 107 may be provided by and/or controlled by a third party. In such implementations, the coordinated control device 104 may coordinate control between discrete supervisory control systems and the systems 110, 112, 114, and 115 while using control commands that may be improved from the sensor data received from the systems 110 112, 114, and 115 and analyzed via the rig computing resource environment 105.

In one or more embodiments, the rig computing resource environment 105 may include a monitoring process 141 that may use sensor data to determine information about the drilling rig 102. For example, the monitoring process 141 may determine a drilling state, equipment health, system health, a maintenance schedule, or any combination thereof. Furthermore, the monitoring process 141 may monitor sensor data and determine the quality of one or a plurality of sensor data. In some implementations, the rig computing resource environment 105 may include control processes 143 that may use the sensor data 146 to improve drilling operations, such as, for example, the control of drilling equipment to improve drilling efficiency, equipment reliability, and the like. For example, in some implementations the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some implementations, the remote computing resource environment 106 may include a control process 143 that may be provided to the rig computing resource environment 105.

In one or more embodiments, the rig computing resource environment 105 may include various computing resources, such as, for example, a single computer or multiple computers. Additionally, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data). The virtual computer system may include a collection of computing resources configured to instantiate virtual machine instances. The virtual computing system and/or computers may provide a human-machine interface through which a user may interface with the virtual computer system via the offsite user device or, in some implementations, the onsite user device. Furthermore, other computer systems or computer system services may be utilized in the rig computing resource environment 105, such as a computer system or computer system service that provisions computing resources on dedicated or shared computers/servers and/or other physical devices. In some implementations, the rig computing resource environment 105 may include a single server (in a discrete hardware component or as a virtual server) or multiple servers (e.g., web servers, application servers, or other servers). The servers may be, for example, computers arranged in any physical and/or virtual configuration.

In one or more embodiments, it is further envisioned that the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In one or more embodiments, the remote computing resource environment 106 may include similar computing resources to those described above, such as a single computer or multiple computers (in discrete hardware components or virtual computer systems).

Figure 4:
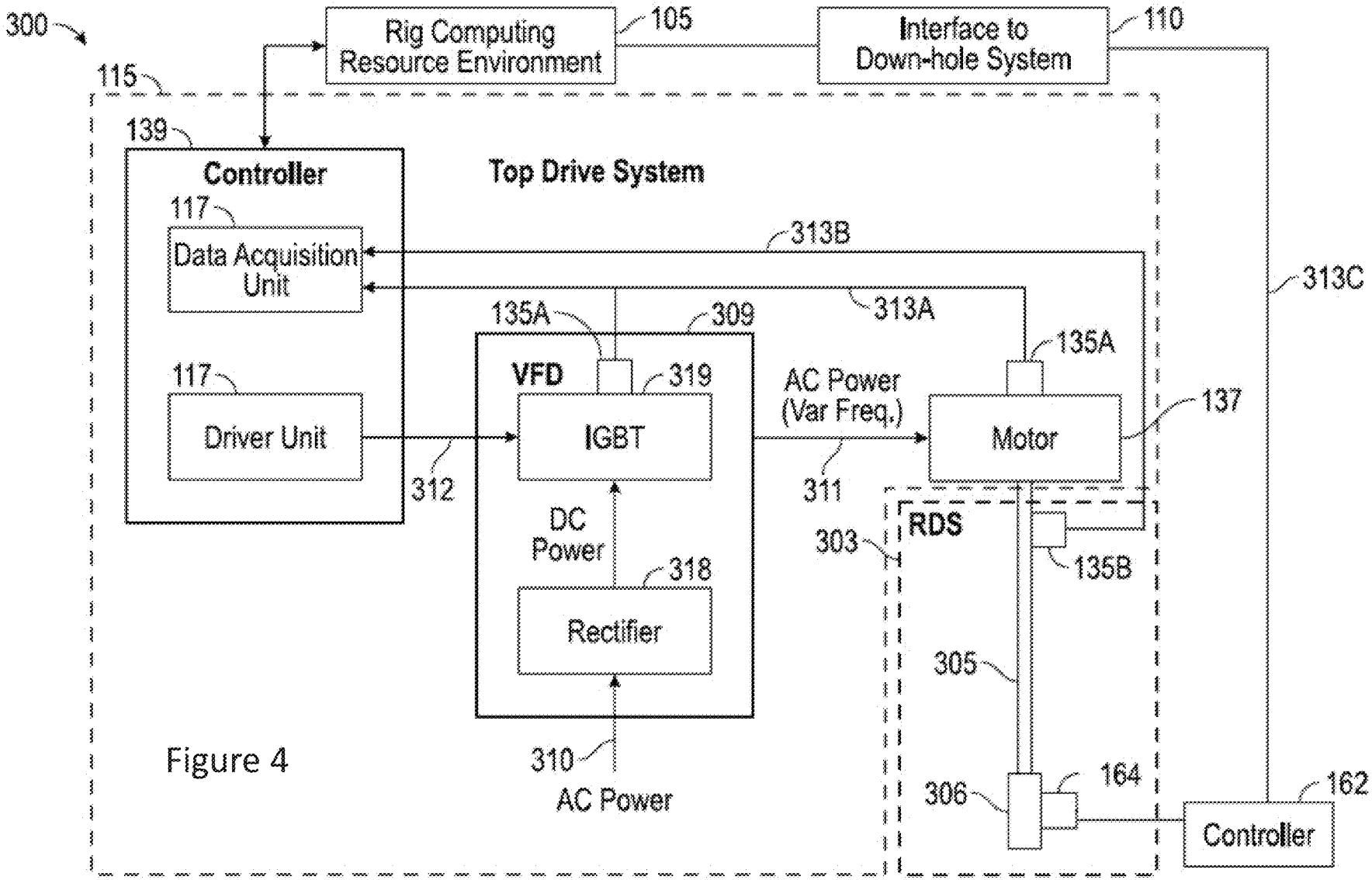
FIG. 4 illustrates a functional block diagram illustrating an example of a top drive system and a rotary drilling system according to one or more embodiments of the present disclosure.

Now referring to FIG. 4, in one or more embodiments, FIG. 4 shows a functional block diagram illustrating an example of the aforementioned top drive system 115 configured to drive a rotary drilling system 303, including a drill string 305 and a bottom hole assembly 306 (in combination, 305 and 306 may be referred to herein as a "drill string assembly") in accordance with implementations of the present disclosure. The top drive system 115 may include, motor 137 (e.g., a top-drive motor and a gearbox), and sensors 135A, 135B and controller 139, which can be the same or similar to those previously described. Additionally, the top drive system 115 may include a VFD 309 that receives AC power 310, which has a substantially fixed frequency, and outputs AC power 311, which has a selectable, variable frequency. For example, the VFD 309 may include a rectifier 318 and a set of insulated-gate bipolar transistors (IGBT) 319 (e.g., an inverter) configured to convert the input AC power 310 to output AC power 311 having a particular frequency based on control signals 312 received from the controller 139.

The sensors 135A, 135B may determine sensor data 313, which may include various information to be measured at the rig 102. For example, the sensor data 313A may include, among other information, VFD output frequency, VFD output voltage, VFD output current, motor RPM, motor acceleration, and output torque. Additional measurements may be provided by sensors 135B (e.g., up-hole sensors installed below the top-drive, such as an instrumented quill sub) and grouped into sensor data 313B. The data from the down-hole sensor 164 is transmitted by down-hole telemetry to the interface to down-hole system 110 which exchanges sensor data with the rig computing resource environment 106 and finally with the controller 139 of the top drive system 115. The sensor 164 may be related to down-hole torque, weight-on-bit or down-hole vibration. The down-hole telemetry 313C may be MWD wireless telemetry such as MWD mud-pulse telemetry or MWD E-mag telemetry). The sensors 135B can determine sensor data 313B and may be transmitted by conventional surface communication (such as Wi-Fi or Bluetooth) to the controller 117 of the top drive system 115. In particular, the sensors 135B may be related to torque as measured at that particular level along the rotary drilling system 303. In implementations, the sensor data 313C can be provided to the controller 139 of the top drive system 115 via the interface to the downhole system 110 and the coordinated control device 104, as shown in FIG. 2). The data from the down-hole sensor 164 is transmitted by down-hole telemetry to the interface to down-hole system 110 which exchanges sensor data with the rig computing resource environment 106 and finally with the controller 139 of the top drive system 115. The sensor 164 may be related to down-hole torque, weight-on-bit or down-hole vibration. The down-hole telemetry 313C may be MWD wireless telemetry such as MWD mud-pulse telemetry or MWD E-mag telemetry or even Wired-Drill-Pipe system (WDP).

Still referring to FIG. 4, the motor 137 may be an induction motor that operates at the operating point which is the intersection of the specific response characteristics (torque versus RPM) for the motor operated with a specific control (e.g., a virtual drive characteristic) and the drill string demand (torque versus RPM/ also called "load curve") for the rotation of rotary drilling system 303, which includes the drill string 305 and the bottom hole assembly 306 in a wellbore. The specific response characteristics (e.g., a virtual drive characteristic) depends on the dynamic output of the controller 139, which sets the variable frequency of the AC power 311, as described below. The controller 139 can include a data acquisition unit 315 that receives and conditions the sensor data 313 from the sensors 135A, 135B. The controller 139 can also include a driver unit 117 that outputs control signals 312 for selecting the frequency of the AC Power 311 output by the VFD 309. For example, the driver unit 117 can include a programmable logic controller that generates the signal 312 that selectively switches the IGBT 319 in the VFD 309 to generate the variable-frequency AC power 311 provided to the motor 137. The controller 139, the VFD 309, and the sensors 135A, 135B, 164 may comprise a control system for driving the motor 137 and the rotary drilling system 303.

Further seen by FIG. 4, the VFD 309 generates the variable-frequency AC power 311 for driving the motor 137 from the substantially non-variable-frequency AC power input 310. The VFD 309 may act as an adjustable-speed drive unit that adapts the power input 310 to provide the adjusted power 311 (amplitude and frequency) to the motor 137. The motor 137 may then operate at a given torque and speed as result of the match between the motor output characteristic (torque versus RPM) for the frequency of the output power 311 and the instantaneous demand (of torque versus RPM) of the rotary drilling system 303, including the drill-string 305 and bottom hole assembly (BHA) 306. Furthermore, the output torque of the motor 137 may be measured directly in-line with the drill string 305 or on (or near) the shaft of the motor 137. For example, the output torque may be acquired on a quill, a motor shaft, or a gearbox of the top drive system 115. Additionally, the output torque may be obtained via the sensors 135B on from the rotary shaft of the drill string 305 via wireless telemetry 313B or even from a sensor 164 in the BHA 306 via the down-hole telemetry 313C. The total motor torque can also be determined from the current fed by the VFD to the motor 137 (sensor 135A inside the VFD 309). This total motor torque can be substantially linear with respect to the drive current when the motor operates near the synchronization speed. However, the motor total torque may include two components: the torque output applied onto its drive shaft, and the torque applied to accelerate/decelerate the motor rotor. This torque is characterized as followed:

$$\text{Tac}=\text{InRot accel}=\text{InRot}\ \partial\Omega/\partial t \tag{1}$$

wherein:

Tac=torque for accelerating motor rotor;

InRot=Inertia of the motor rotor;

accel=rotary acceleration; and

Ω=rotary speed.

Figure 5:
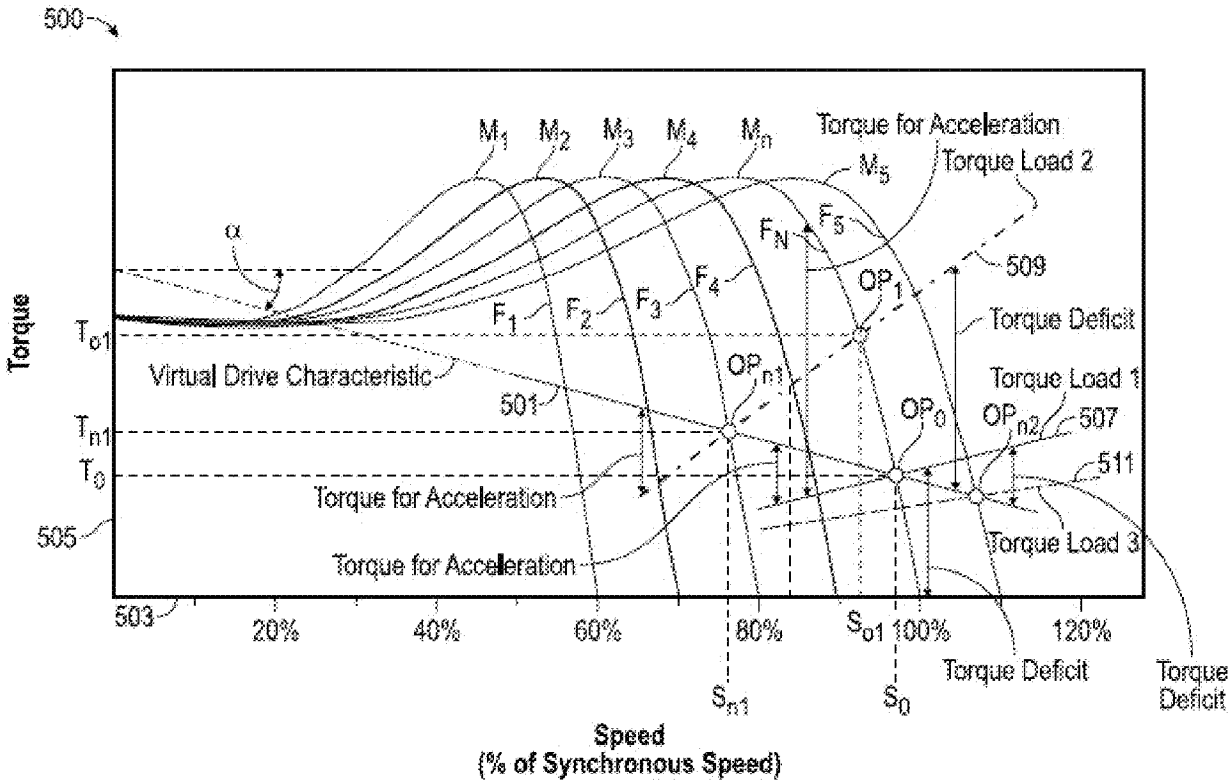
FIG. 5 illustrates a graph illustrating an example of a reference function describing a virtual drive characteristic relating torque, speed, and drive frequency of a motor driving a drill string according to one or more embodiments of the present disclosure.

With reference to FIG. 5, FIG. 5 shows a graph 500 illustrating an example of reference function describing a virtual drive characteristic relating torque, speed, and drive frequency of a motor driving a drill string, according to an implementation. In the example of FIG. 5, when the torque load changes from torque load 507 ("torque load 1") to torque load 509 ("torque load 2"), the operating point of the rotary drilling system moves from $OP_0$ to $OP_{n1}$ (corresponding to torques $T_0$ to $T_{n1}$, and to speeds $S_0$ and $S_{n1}$, respectively) when applying a power 311 to the motor at optimized selected frequency by the VFD 309. In comparison to change in torque from $T_0$ to $T_{n1}$ corresponding to $OP_0$ to $OP_{n1}$, a top drive system operating open loop would instead allow the operating point would have pass from $OP_0$ to $OP_1$ having a variation of torque from $T_0$ to $T_{01}$, which is substantially greater than the change in torque resulting from the virtual drive characteristic in accordance with the present disclosure.

As shown by FIG. 5, the graph 500 describes the real motor response curves under various drive conditions, the desired motor response (called virtual drive characteristic) and the torque demand by the rotary drilling system. The graph 500 includes an x-axis 503, which is graduated in speed (or in percent of the synchronized speed of the motor when driven at its nominal frequency $F_N$ and at zero-torque drive condition). The graph 500 also includes a y-axis 505 representing a range of torque that the motor can provide for the corresponding rotational speed. Further, the graph 500 includes a plurality of motor characteristic lines $M_1$, $M_2$, $M_3$, $M_4$, $M_n$, $M_5$ representing the non-linear relationship between speed and torque the induction motor driven by power 311 having different frequencies $F_1$, $F_2$, $F_3$, $F_4$, $F_N$, $F_5$. Additionally, the graph 500 also includes the "torque demand" (i.e., torque load) by the rotary drilling system (which includes the drill-string 305 and BHA 306 shown in FIG. 4). The torque demand is determined at the motor shaft which includes the correction due the potential presence of a reduction of gearbox. The torque demand represents an amount of torque supplied by the rotary drilling system to operate a given rotating speed under the current drilling conditions (e.g., current weight-on-bit, lithology, wellbore friction, bit configuration, wear, and the like.). The torque demand for the rotary drilling system may change as one or more of the drilling conditions change. Torque loads 507, 509, 511 represent some potential variation of torque loads.

As discussed above and with reference jointly to FIGS. 4 and 5, a motor (e.g., motor 137) can be driven by power (e.g., AC power 311) at a given frequency (e.g., FN) form a VFD (e.g., VFD 309). Due to the given frequency (and also the voltage output of the power 311), operation of the motor following a given characteristic curve Mn. When the rotary drilling system (e.g., rotary drilling system 303) operates under a certain torque demand (e.g., torque load 507), an operating point $OP_0$ is defined as intersection between the motor characteristics Mn and the torque load 507. The operating point changes from $OP_0$ when the torque changes from torque load 507 to a different torque load 509 due to, e.g., changes in rotation conditions of the drill string assembly (e.g., variable friction between the drill string assembly and a wellbore). In the situations where the motor operates in open loop (e.g., without dynamic control by controller 139 based on feedback from sensors 135), the operating point may move from $OP_0$ to $OP_1$, which is not located on the virtual drive characteristic line 501. However, if the frequency of the fed power 311 is changed to F3, the operating point for the torque load 509 is $OP_{n1}$. Additionally, the graph 500 also shows the virtual drive characteristic 501 as a line having a slope ($\alpha$) with respect to the x-axis 503 and the y-axis 505, and a reference operating point $OP_0$ (as intersection of the torque load 507 and the motor characteristic when driven by electrical power of frequency $F_N$. With reference to FIG. 5, the virtual drive characteristic 501 can be described as follows:

$$T=T0+\alpha(S-S0), \tag{2}$$

wherein:

T=torque,

S=speed, $T_0$=torque at the desired nominal operating point, $S_0$=speed at the desired nominal operating point, and $\alpha$=virtual drive characteristic slope. This slope may also be given as an angle $\alpha'$, which is the arctangent ($\alpha$)

As shown in FIG. 5, the initial operating point $OP_0$ is also on the virtual drive characteristic 501 due to the initialization process which will be described below. As already mentioned, when operating in open loop, the operating point moves from $OP_0$ to $OP_1$ on the same motor characteristic curve $M_n$, when the torque demand from the rotary drilling system changed from the torque load 507 to the torque load 509 away from the virtual characteristic line 501 (such change may be quite abrupt). In accordance with embodiments of the present disclosure, the controller may control the motor to move the operating point $OP_1$ of the motor back to the virtual drive characteristic line 501 at the point $OP_{n1}$, which is at the intersection of the new torque load 509 and the virtual drive characteristic 501. Furthermore, controlling the motor to operate at the operating point $OP_{n1}$ involves changing the frequency of the power fed to the motor 137 to the frequency $F_3$. Accordingly, systems and methods consistent with those disclosed herein can determine and selectively output power to the motor at the desired frequency $F_3$ such that the motor operates on torque response line $M_3$ instead of $M_N$. By doing so, the operating point of the motor changes from the initial $OP_0$ to $OP_{n1}$ at the intersection with the virtual drive characteristic 501.

FIG. 5 also illustrates the case of lowering of the torque demand to, e.g., torque load 511 ("torque load 3"). Further, by applying similar consideration as before, the new operating point would move to $OP_{n2}$, which is on the virtual drive characteristic 501 and corresponds to a frequency $F_5$ for the power output to the motor. The above-described control can be continuously performed by the controller as the torque demanded by the drill string may continuously change during operation. In reference to FIG. 5, the drill-string assembly may be accelerated (or decelerated) by the available torque for acceleration (or torque deficit). Such available torque (or deficit) represented along a vertical line from the virtual drive characteristic and the motor characteristic corresponding to the drive frequency. With such consideration, it is evident in FIG. 5 that the available torque (deficit) is smaller when operating in accordance to a virtual drive characteristic than in open loop. Hence, the acceleration (and so speed adjustment) of the drill string may be slower when operating in close-loop mode with a virtual drive characteristic than in open loop operation.

Figure 6:
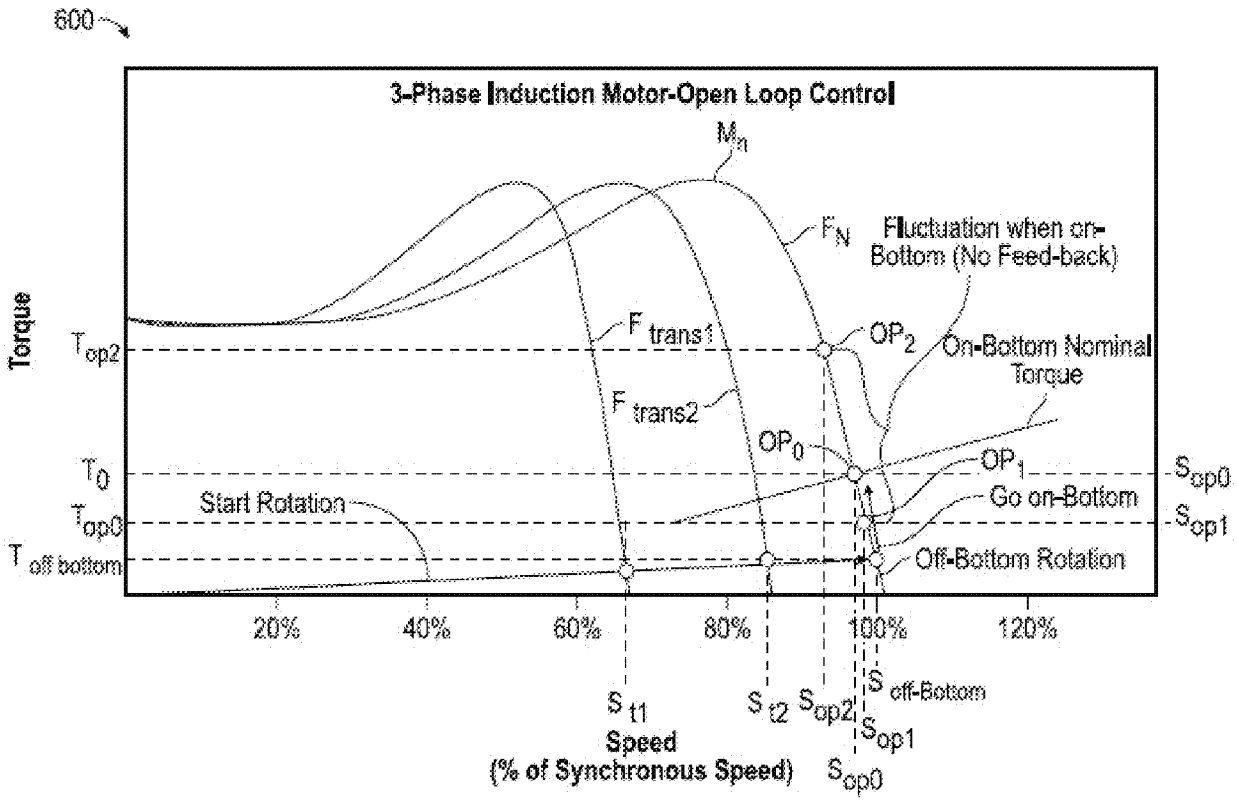
FIG. 6 illustrates a graph of a reference function for a motor driving a drill string illustrating an example of selecting a nominal operating point for a motor according to one or more embodiments of the present disclosure.

As shown in FIG. 6 (with references back to the components of FIG. 3), FIG. 6 shows a graph 600 related to a motor driving a rotary drilling system (e.g., rotary drilling system 303), including reference function illustrating an example of a nominal operating point selection for a motor (e.g., motor 137). Specifically, a frequency of power (e.g., AC power 311) to the motor may be increased progressively to a nominal frequency ($F_N$) so that the rotary drilling system (e.g., drill string 305 and BHA 306) rotates at a desired speed. Initially, the motor torque $T_{off\text{-}bottom}$ may be small when a bit of the drill string assembly is off a bottom of a wellbore. When the rotary drilling system is lowered in the wellbore so that the bit engages the bottom of the wellbore, the weight-on-bit increases and the torque on the rotary drilling system increases. As the nominal frequency of the VFD has not changed at this point, the motor operates on the characteristic line of the motor ($M_N$); yet the torque may oscillate between values $T_{OP1}$ and $T_{OP2}$ due to variations of friction between the rotary drilling system and the wellbore, as well as due to variation of engagement of the drill bit in the wellbore bottom due to the typical unsteady transmission of weight-on-bit.

In one or more embodiments, an operating point $OP_0$ may be selected between $OP_1$ and $OP_2$. The operating point $OP_0$ may be, for example, an average of $OP_1$ and $OP_2$ based on torque versus time response while drilling. One with ordinary skill in the art would understand that this $OP_0$ is a theoretical reference as operating point (to be used for later processing), as in reality the control of weight-on-bit determines the torque. As such, different filters can be applied to the torque versus time before such averaging. Additionally, said filters may be low pass filter with a cut-off point selected to minimize the effect of the variation of weight-on-bit. Furthermore, the operating torque can be selected to organize a set of torque measurements made during a selected time-window, where the torque is considered sufficiently steady fit into a torque histogram comprises of N different bins of different torque ranges. The bins in the histogram in having the greatest amount of content could be averaged to determine $OP_0$. It should be also noted that the operating point $OP_0$ stays constant only if the nominal weight-on-bit is not changed, as well as the lithology has not be changing due to the fact the hole is becoming deeper. When the operating point $OP_0$ has been determined, the corresponding torque and speed can be considered as characteristics of this operating point. Such characterization may be obtained from the motor characteristic line of the motor ($M_N$) or from the data obtained during the selected time-window for determination of the operating point. For a selected $OP_0$, then the slope of the virtual characteristic line may be defined.

Figure 7:
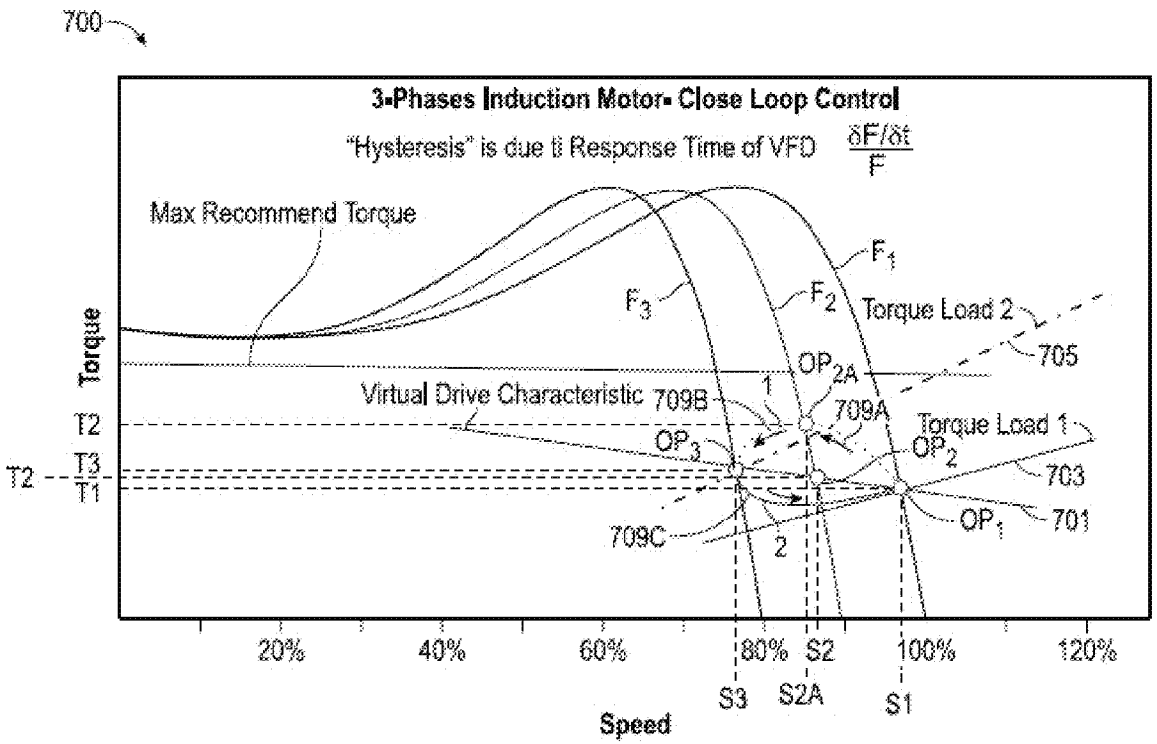
FIG. 7 illustrates a graph of a reference function for a motor driving a drill string illustrating an example of virtual drive characteristic at a nominal operating point of a motor according to one or more embodiments of the present disclosure.

Now referring to FIG. 7, in one or more embodiments, FIG. 7 shows a graph 700 of a drill string reference function illustrating an example of virtual drive characteristic 701 at a nominal operating point of a motor (e.g., motor 137). A first torque load 703 on the aforementioned drill string assembly at a nominal drilling condition $OP_1$ (e.g., steady drill operation on well bottom without stick/slip and without variation of rotation conditions) corresponding to the torque loading imposed by the drill string. The virtual drive characteristic 701 can define a first speed S1 for the motor associated with a first torque output T1 obtained by a controller (e.g., controller 139) driving the motor with power (e.g. AC power 311) having the first frequency F1. Additionally, for a second torque load 705, occurring due to, e.g., increase of friction at the rotary drilling system, the virtual drive characteristic 701 can define an operating point $OP_3$ corresponding to a speed S3 and torque T3 while the frequency of the power generated by the VFD is F3. If the drill string demand suddenly changes from the first torque load 703 to the second torque load 705, the controller can adjust the frequency of power supplied to the motor 137. Further, an adjustment may be performed in progressive fashion, so that the frequency would change progressively from F1 to F3 via one or more intermediate frequencies, such as F2.

The second speed S2 for the motor that is associated with a second torque output T2 may be obtained by setting the power supplied to the output frequency F2. The operating point $OP_2$ may not be exactly on the line representing the virtual drive characteristic 701 due to some delay in the setting process (e.g., due to limited speed of response for the system). As such, the operating point $OP_2$ may be displaced as shown in FIG. 5 (shown as point $OP_{2A}$). Further, a third operating point $OP_3$ may be present to show the continuation of the application of the torque load change. The virtual drive characteristic 701 may define a third speed S3 for that is associated with a third torque output T3 obtained by supplying power having a frequency F3.

Additionally, FIG. 7 illustrates a situation in which the system returns to the nominal operating point $OP_1$. Arrows 709A, 709B, and 709C indicate the evolution of the operating point corresponding to a single example of a variation of the torque load from torque load 703 to torque load 705. In one or more embodiments, the virtual drive characteristic 701 defines a substantially linear relationship between torque and speed to be provided by the motor so that the corresponding operating conditions (e.g., torque and speed) are on one straight line in the graph 700 of torque versus speed. The controller can continuously monitor the torque and speed of the drill string assembly (e.g., via sensors 135). The controller can also continuously identify the present (e.g., actual) operating condition in the graph 700 and determine the separation of this current operating point versus the virtual drive characteristics 701. If the present operating point is above the virtual drive characteristic 701, the control system lower can the output frequency of supply power driving the motor. For example, the point $OP_{2A}$ is above the line representing the virtual drive characteristic 701. Accordingly, the controller can progressively reduce the frequency of the supply power to modify the present operating point $OP_{2A}$ and progressively move it (e.g., via arrow 709B) towards the bottom left corner of the graph. With such progressive frequency adjustment, the operating point located at $OP_3$, which is the intersection of the virtual drive characteristic 701, and the line representing torque load 703 (imposed by the drill string behavior in the wellbore under the current drilling condition such as weight-on-bit). One with ordinary skill will recognize that, the opposite adjustment would be imposed by the control system if an operating point of the motor were located below the virtual characteristic line 701 to progressively increase the frequency of the supply power. As seen in FIG. 5, the torque demand by the drill-string assembly may reduce (as passing from the torque load 507 to 511). If such case, the system can increase the frequency of the supply power to keep the operating point $OP_{n2}$ on the virtual drive characteristic 701.

Figure 8A:
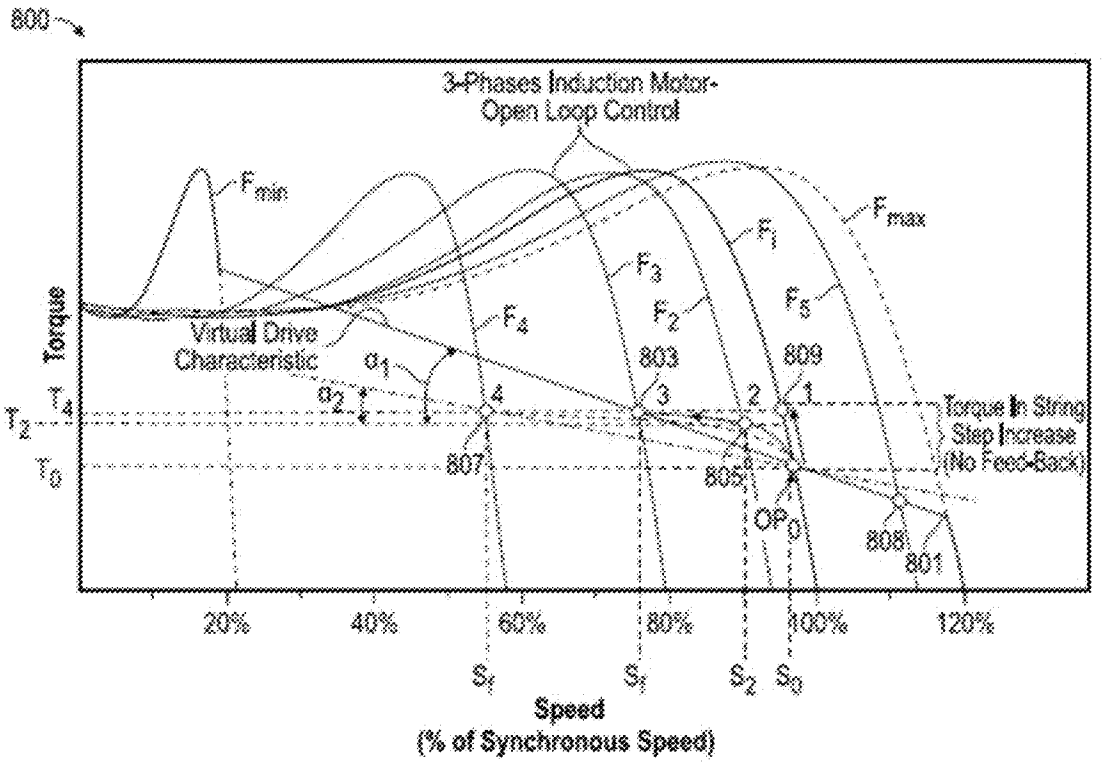
FIGS. 8A-8B illustrate a graph of reference function of a motor driving a drill string illustrating an example of a system output according to one or more embodiments of the present disclosure.

With reference to FIG. 8A, in one or more embodiments, FIG. 8A shows a graph 800 of a drill string reference function illustrating an example of a system output, according to an implementation. Specifically, FIG. 8A depicts a limit of adjustment between the minimum and maximum frequencies (shown as $F_{min}$ and $F_{max}$) of power (e.g., AC power 311) output to a motor (e.g., to motor 137 by VFD 309). FIG. 8A also shows the influence of selected different virtual drive characteristic 801 when a sudden increase of torque (e.g., a step function) is applied onto a drill string (e.g., drill string 305 and/or BHA 306). The system would normally operate at the operating point $OP_0$ before the torque increase and then can move to the operating point 803 by passing via an intermediate operating point such as 805 during the time of adjustment of the frequency of the power (e.g., under control of controller 139) and when operating under a selected virtual drive characteristic of slope $\alpha$1. However, the final operating point after the torque step would be the point 807 if drilling operation followed the virtual drive characteristic of slope $\alpha$2. It should also be noted that in open loop operation, the final operating point after the torque step would be the point 809. Furthermore, the virtual drive characteristic 801 is determined based on a definition of an operating point $OP_0$ at T0, $S_0$ and slope $\alpha$. The operating point ($T_0$, $S_0$) can be determined by an operator of the system, such as described above. When operating at $OP_0$, if the torque step function is involving a reduction of torque, the operating point would move to the right from $OP_0$ to the point 808 to stay on the virtual drive characteristic to operating point 808, while a controller (e.g., controller 139) of the system would set the frequency of the supply power to frequency F5.

Figure 8B:
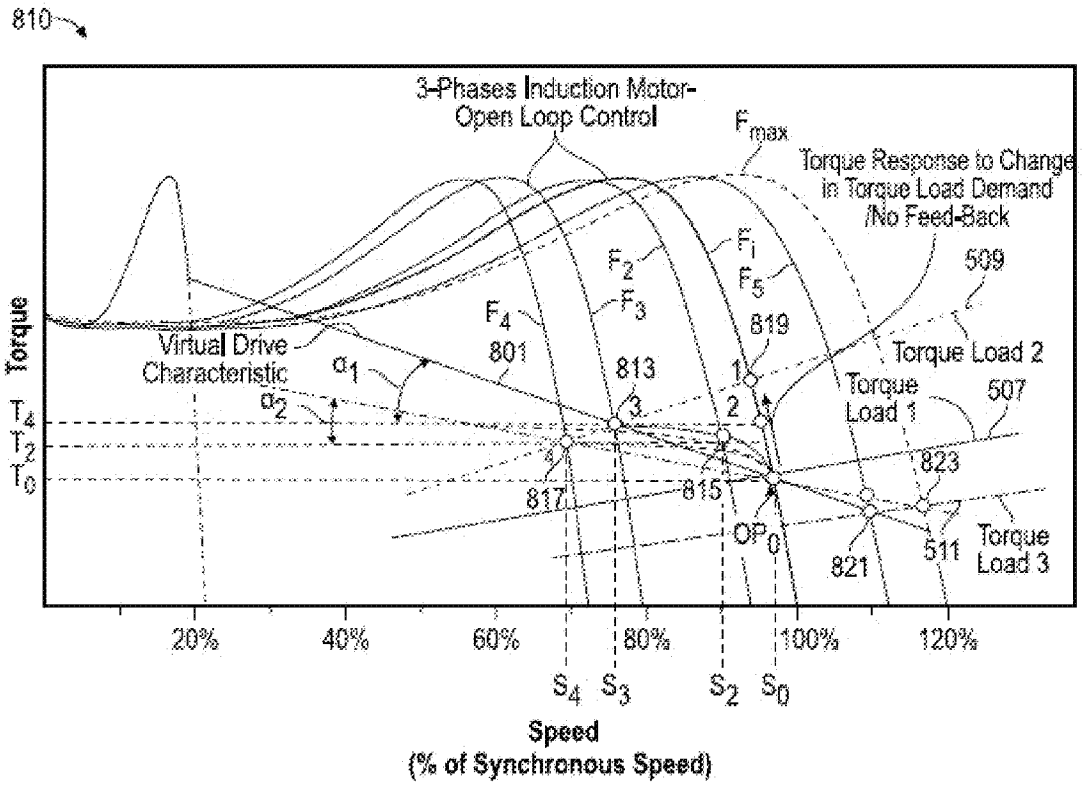

Now referring to FIG. 8B, in one or more embodiments, FIG. 8B shows a graph 810 of a reference function for a motor driving a drill string illustrating an example of a system output. Specifically, FIG. 8B depicts an example of the limit of adjustment between the minimum and maximum frequencies of VFD output (shown as Fmin and Fmax). FIG. 8B also shows the influence of selected different virtual drive characteristic 801 when a change in the torque load (demand) is occurring along the rotary drilling system. The system would normally operate at the operating point $OP_0$ before a torque increase and then can move to the operating point 813 by passing via an intermediate operating point such as 815 during the time of adjustment of power supply frequency when operating under a selected virtual drive characteristic of slope α1. However, the final operating point after the torque step would the point 817 if operating following the virtual drive characteristic of slope α2. It should also be noted that in open loop operation, the final operating after the torque step would be the point 819. If the change of torque load (from torque load 507 to torque load 511) corresponds to a reduction of torque demand by a drill string assembly (e.g., drill string 305 and BHA306). The new operating point may become 821 when operating with the virtual drive characteristic of slope α1, while being 823 when operating with the virtual drive characteristic of slope α2. Again, notably, the virtual drive characteristic 801 is determined based on a definition of an operating point $OP_0$ at $T_0$, $S_0$ and a slope α. As such, the operating point ($T_0$, $S_0$) corresponds to a selection made by an operator, such as described above.

Figure 9B:
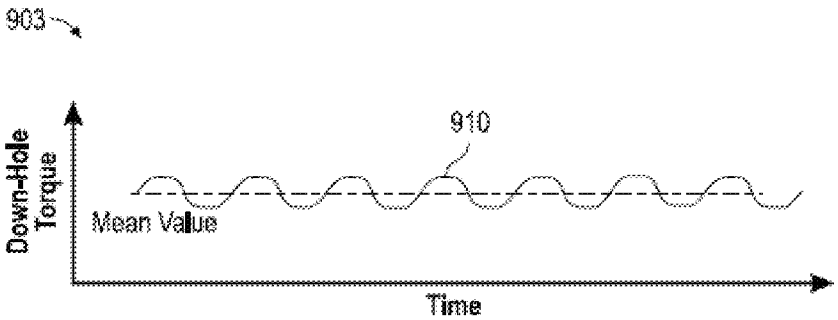
FIG. 9B illustrates a graph illustrating an example response of a drill string submitted to variable torque load along the wellbore according to the system of FIG. 7A of one or more embodiments of the present disclosure.
Figure 9C:
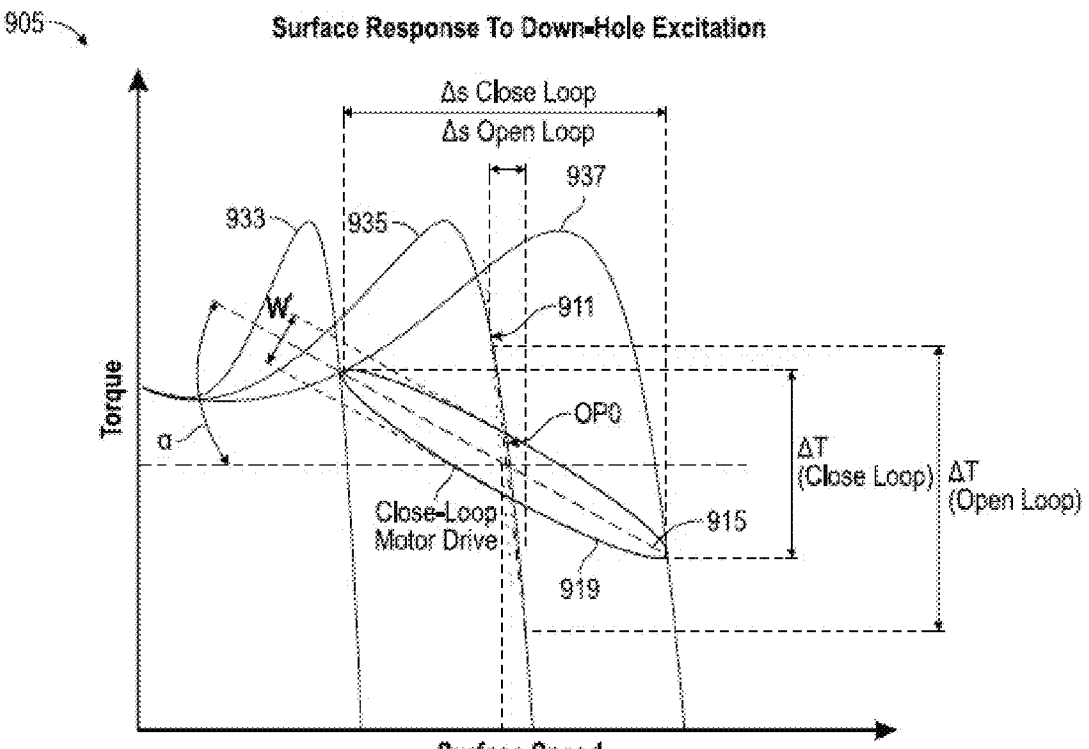
FIG. 9C illustrates a graph illustrating an example response of a motor driving a rotary drilling system according the system of FIG. 9A of one or more embodiments of the present disclosure.
Figure 9A:
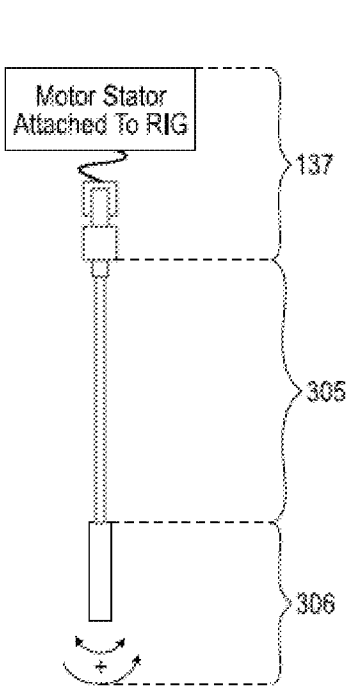
FIG. 9A illustrates shows a schematic view of a rotary drive system of a rotary drilling system according to one or more embodiments of the present disclosure.

FIGS. 9B and 9C show graphs 903 and 905 illustrating responses for an example system 909 shown in FIG. 9A. Specifically, FIG. 9B shows a graph 903 depicting a downhole combination of average torque and fluctuation in torque affecting operation of the rotary drilling system of the system 909, including, a drill string 305, and a bottom hole assembly (BHA) 306 which includes a drill-bit (not represented), which is rotated by a motor 137 on a top drive As described previously, variation of rotational conditions may occur due to change in friction factor between the rotary drilling system and the wellbore or at the contact of the drill-bit and the bottom of the wellbore. Such effects influence the torque demand within the wellbore as shown in graph 903 of FIG. 9A. For example, during operation, a torsional wave 910 may propagate in the drill string 305 and the BHA 306, which can create fluctuations in torque and/or speed at the surface or at the motor 137. In such case, the system 909 may behave as shown in the graph 905 of FIG. 9C.

Additionally, the graph 905 (in FIG. 9C) depicts a similar version of the FIG. 8B when torque oscillation is occurring along the system 909. In the case of open loop operation 911, the variation of torque can be large, while the corresponding variation in speed is small. By operating in close-loop control following a virtual drive characteristic 915, the variation of speed is larger while the corresponding variation of torque is smaller. During a full oscillation cycle of torque due to the wave propagation, torque and speed can oscillate around the nominal operating point OP0 (e.g., selected by an operator). If a response of the system 909 (including sensors, controller, VFD, and motor response) were infinitely fast, the response would follow the virtual drive characteristic line 915 in the graph (upper left corner). Due to limits in response speed (limited adjustment rate), however, the system 909 may actually follow an elliptical pattern 919 when operating in close-loop (e.g., as shown in FIG. 4). The width W of the elliptical pattern 919 depends on the response speed (adjustment rate) of the system including the motor, the VFD and the closed loop system. This graph 905 also shows also three different motor characteristics 933, 935, 937 when the motor (e.g., motor 137) is driven at three different frequencies (e.g. using the controller 139 and the VFD 309). The characteristic 935 corresponds to the nominal motor operation as it passes by the nominal operating point OP0. The characteristic 933 corresponds to the motor operation of the motor 137 at the minimum frequency of the power 311 generated by the VFD 309 during a single oscillation loop. The characteristic 937 corresponds to the motor operation of the motor 137 at the maximum frequency of the power 311 generated by the VFD 309 during a single oscillation loop.

Further seen by FIG. 9C, the selection of the virtual drive characteristic 915 affects the response of the system 909 when operating under closed-loop control. In one or more embodiment, the virtual drive characteristic 915 can be determined by determining extremum of a reference function describing the behavior of the drill string assembly. The reference function can be, for example, an algorithm, a dataset, a mathematical relation including torque and or speed as input, or a predefined model of the drill string (e.g., stored in rig computing resource environment 105) that defines a correspondence between torque on the drill string assembly and the rotational frequency of the drill string assembly during typical rotation oscillation (e.g., a cycle of torque oscillation due to stick-slip). This function depends on the slope (α) of the virtual characteristic drive 915. In an implementation, the slope α of the virtual drive characteristic 915 can be optimized based on the use of the following function:

$$\text{Osc-Power-App}(\alpha)=K_1\Delta T(\alpha)\Delta S(\alpha) \quad (3)$$

where:

ΔT(α)=variation of torque during one typical oscillation cycle when operating with the slope α; and ΔS(α)=variation of the drill string rotational speed during one typical oscillation cycle when operating with the slope α.

ΔT(α) and ΔS(α) are represented as ΔT-close-loop and ΔS-close-loop in FIG. 9C, as this graph relates to a single value of α. Function such as Osc-Power-App(α) can be generalized as F(ΔTorque, ΔSpeed) and called "improvement function."

Still referring to FIGS. 9A-9C, the system 909 can be controlled (e.g., by controller 139) to operate during successive periods of time with different values for the slope of the virtual drive characteristic 915 to determine the values ΔT(α) and ΔS(α) via a graph 905 for each value of α, and then to generate information which relates the value of a function (3) versus a allowing to determine a particular value of the slope corresponding to the maximum of the function (3) over the successive periods. During these successive periods, the variations torque (ΔT) and speed (ΔS) can recorded in relation with the slope of the virtual drive characteristic (α).

Figure 10B:
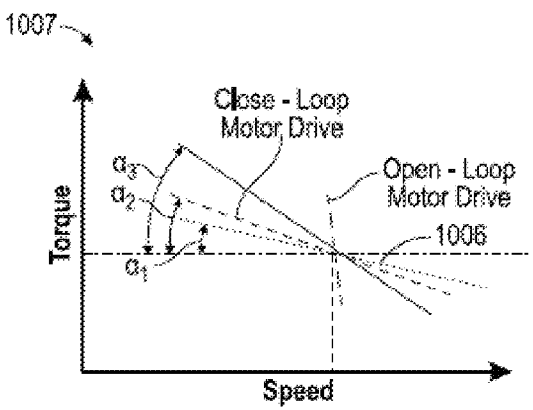
FIG. 10B illustrates a graph illustrating an example of a drilling system response according to one or more embodiments of the present disclosure.
Figure 10A:
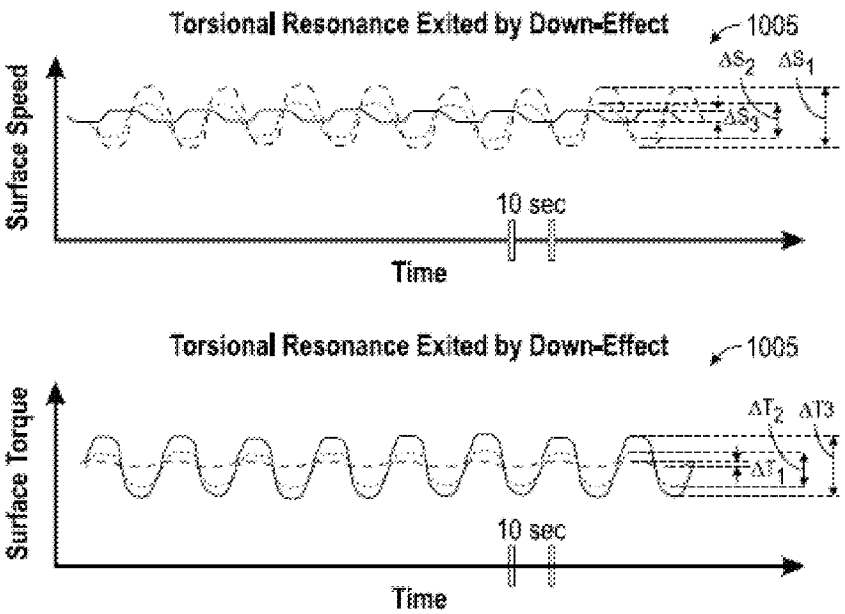
FIG. 10A illustrates a graph illustrating an example of a system response as typically detected at surface according to one or more embodiments of the present disclosure.
Figure 11:
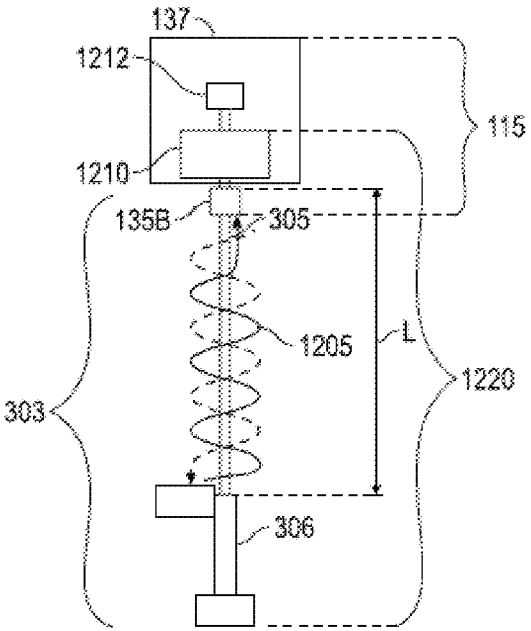
FIG. 11 illustrates a block diagram illustrating an example of a rotary drilling system according to one or more embodiments of the present disclosure.
Figure 10C:
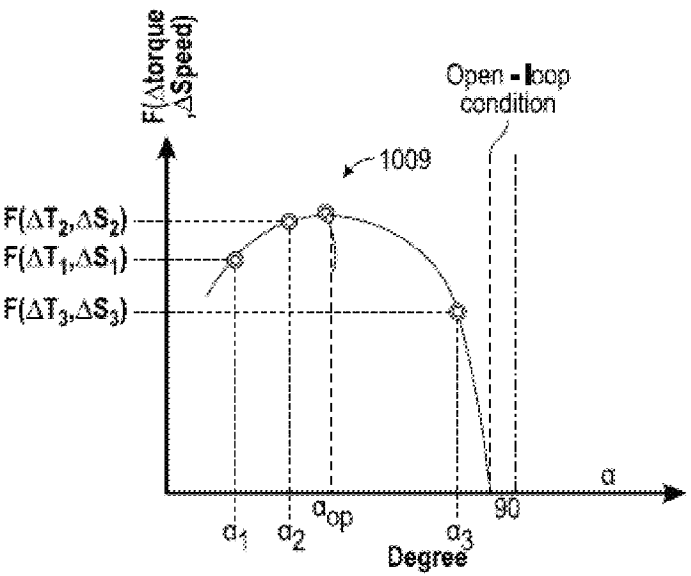
FIG. 10C illustrates a graph illustrating an example of a drilling system response as processed information after operations at multiple operating conditions according to one or more embodiments of the present disclosure.

Shown by FIG. 10B, in one or more embodiments, are slopes of virtual drive characteristic lines 1006 are shown in graph 1007. For each period corresponding to a given α, ΔT and ΔS are determined for the "close-loop" operation, as shown in graph 1005 of FIG. 10A. For each period, the value of the improvement function (3) can be calculated based on these determined values of ΔT and ΔS. Then, the result of the improvement function (3) is plotted versus the slope α of the virtual drive characteristic in the graph 1009 of FIG. 10C. After sufficient steps of value α, the graph 1009 of FIG. 10C allows a determination of the extremum of this improvement function (3) and the corresponding optimum slope of the virtual drive characteristic ($\alpha_{op}$). Furthermore, the ΔT(α) and ΔS(α) of the improvement function (3) may be determined either the information recorded versus time, such as shown in the graph 1005, or in the graph of torque versus speed such as shown in graph 905 of FIG. 9C. It should also be noted that the coefficient K1 of improvement function (3) has no influence on the determined optimum value of the slope of the virtual drive characteristic. For example, the improvement function (3) above characterizes the capability for the system to manage a travelling wave alternately as torque that deforms elastically the string or a kinetic energy thanks to the un-steady rotation speed. Further, it should be noted that potential improvement functions may be considered Now referring to FIG. 11, FIG. 11 shows a block diagram illustrating an example of a rotary drilling system. As shown in FIG. 11, for example, a drill string assembly rotates in a wellbore with some oscillation. During the acquisition sequence, several cycles of the oscillation are recorded as shown in graph 1005 of FIG. 10A. Furthermore, as shown in, e.g., FIG. 9C (described above) and FIG. 10B (described above), the individual oscillation cycles of the drill string assembly corresponds to a full cycle on the elliptical set of settings (torque versus speed). For example, the acquisition sequence can cycle for at least two longest oscillation cycles (e.g., about 20 seconds). During this acquisition sequence, the drill string assembly can be kept in rotation in accordance to the application of the virtual drive characteristic applied by the controller to drive the motor with the supply power (e.g., from the VFD). Due to variable friction and other forces inside the wellbore, the torque at the top of drill string assembly varies.

As described previously herein (e.g., in relation with FIGS. 7 and 8A), the controller may dynamically adjust the frequency of the supply power provided to the motor so that the actual operating point stays on or close to the virtual drive characteristic. For example, with reference, e.g., to FIG. 7, and starting at operating point $OP_1$ (while α-actual is selected), the iterative control sequence of 1119 can select F1 as an output frequency. $OP_1$ is on the torque load 1 corresponding to mean operating condition in the wellbore. When torque demand increases in the wellbore, the controller can reduce the frequency of the supplied power to F2. The operating point is $OP_{2A}$ may stay slightly above the virtual drive characteristic due to, for example, lag in system, while $OP_2$ (in FIG. 7) would be the target operating point corresponding to F2.

FIG. 11 illustrates an example of a top drive system 115 and a rotary drilling system 303, according to an implementation. The top drive system 115 and the rotary drilling system 303 can be the same or similar to those previously described herein. The top drive system 115 rotates the rotary drilling system, which includes a drill string 305 and a BHA 306, as well as the motor rotor with its inertia 1210. The top drive system 115 includes a motor 137, which may be the same or similar as those previously described herein and an optional gearbox (not shown). The drill string 305 can be represented as comprising a torsional resonator due its torsional rigidity allowing elastic torsion of the drill string 305 under torque and associate with to multiple rotational inertia (e.g., the bottom hole assembly 306 and the motor inertia 1210, as well as other distributed inertias (not shown) that may be included in the rotary drilling system 303. The rotary drilling system 303 associated with the motor rotor 1210 acts as a rotary resonator 1220. This resonator may be excited by the torsional oscillation appearing during rotation when torsional excitation may be present. The torsional excitation may be generated by the variation of friction 1215 between the drill string 305 and/or BHA 306 and a borehole, including the bit cutting effect and the friction along the wellbore. The principal inertia affecting resonance is the BHA 306 acting as a rigid flywheel, the distributed inertia of the drill-pipe section, and the motor rotor 1210 which includes rotational inertia, which may be affected by an optional gearbox of the top drive system 115. Inertia present at the motor 137 can affect some resonating modes of the drill string 305 and/or the BHA 306. In one or more embodiments of the top drive system 115 consistent with aspect of the present disclosure, a virtual motor-rotor inertia may be represented by the following relation:

$$T=\beta v\partial\Omega/\partial t \tag{7}$$

wherein:

βv is the virtual inertia of the motor,

∂Ω/∂t is the rotational acceleration of the drill string assembly, and

T is the torque that occurs to rotate the virtual motor-rotor inertia βv in the presence of the rotational acceleration.

With regard virtual inertia of the motor βv, the variation of rotational speed may be measured (e.g., by sensors 135) and fed a control system (e.g., controller 139). The control system can determine the corresponding torque due to the virtual inertia (βv) of the motor by the applying the formula (7). For example, with reference to FIGS. 9A-9C, the effect of the virtual inertia of the motor can generate difference of torque between the two sides of the following motor-rotor inertia algorithm:

$$T_{EM}=T_{in\text{-}line}-(\beta v+\beta r)\partial\Omega/\partial t \tag{8}$$

wherein:

$T_{EM}$ is the electromagnetic torque generated at the motor,

Tin-line is the torque measured by the in-line sensor (between the motor 137 and the drill-sting 305), and βv is the motor rotor virtual inertia, and βr the motor real inertia.

For example, a rotor of the motor 137 may be considered as the squirrel cage supporting the electromagnetic torque, while the rotor lamination can be considered the motor inertia 1210. The electromagnetic torque generated by the stator 1212 onto the squirrel cage may be considered as a system without inertia turning the rotor due the presence of the electromagnetic torque. The virtual inertia of the motor can be represented, for example, as an additional flywheel added to the rotor (e.g., a heavier lamination stack). To simulate the presence of the additional virtual inertia, the drive torque (electromagnetic torque generated by the stator 1212) may be reduced in comparison to the in-line torque by the following algorithm:

$$T_{EM_eq}=\beta v\partial\Omega\partial t \tag{9}$$

In one or more embodiments, the virtual inertia of the motor may be adapted so that the resonance frequencies along the drill string 305 and BHA 306 are modified so that the effect of the resonance is minimized on the torque and/or speed oscillation recorded versus time.

Still referring to FIG. 11, in one or more embodiments, FIG. 11 also depicts a model of the resonance within the top drive system 115. The drill string 305 may substantially function as a torsional resonator due to a combination of its inertia and rigidity. Some of the inertia may be distributed (as the effect of the inertia of the drill string 305) or lumped as the effect of the BHA 306 and the motor rotor inertia 1210 of the motor 137. When a source of lateral vibrations occurs, rotational variation may be created with potential effect on torque and speed variations. Rotational variations with effect on torque and speed variations may also result from torsional excitations (e.g., stick-slip). Variation in friction along, a borehole and at a bit of the BHA 306 may generate the vibration excitation at the wall of the borehole or at the bit. A stable resonating pattern may-be generated by a vibration wave 1205 reflecting upwards and downwards along the drill string 305. Reflection of the vibration wave 1205 may occur, for example, at top of the drill string 305 as well as in the wellbore due to with the drill string 305. Highest and lowest resonance amplitudes of the vibration wave 1205 may occur when the wave length corresponds to certain proportion of the length L of the drill-string assembly (e.g., the drill string 305 and the BHA 306) and a potential reflector. In one or more embodiments, the control system may control the virtual inertia of motor to change the resonance frequency of the rotary drilling system involving the top drive system 115, the drill-string 305 and BHA 306. As described herein, the amplitude of the vibration wave 1205 can be reduced by controlling the resonance of the rotary drilling system so that the excitation frequency does not match any resonance frequency of the rotary drilling system. Accordingly, the virtual inertia of the motor can be tuned to operate the system at a lowest resonance amplitude.

Figure 12:
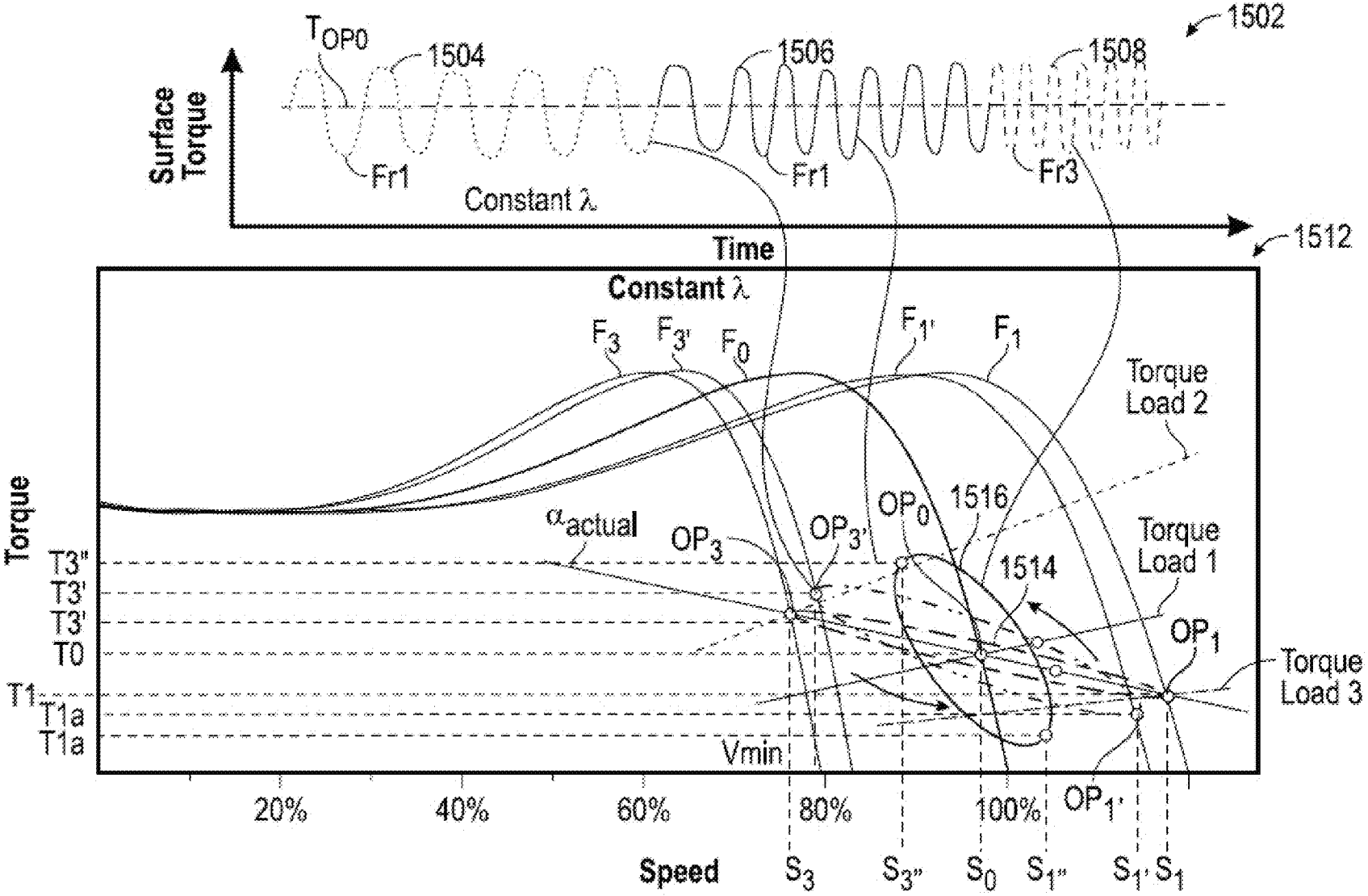
FIG. 12 illustrates a graph illustrating an example of a response for a controlled motor versus different excitation frequencies of the rotary drilling system according to one or more embodiments of the present disclosure.

With the selected adjustment rate λc, the frequency of the power output (e.g., supply power 311) of VFD can be continuously adjusted by the controller 139 during a cycle of oscillation of drill-string operating at a defined nominal condition (speed) and having a defined oscillation frequency and amplitude. Otherwise, the frequency of the power output may not fully follow the needed change for the VFD power output 311. This behavior is depicted in FIG. 12, which illustrates an example of a response for a controlled motor versus different excitation frequencies of the rotary drilling system, according to an implementation. The graph 1502 depicts the time variation of the surface torque (such as measured by a sensor 135), while the graph 1512 represents the same information as torque versus speed at the top-drive motor. When oscillation occurs at low frequency as shown by 1504 (at oscillation frequency Fr1), the control system manages that the motor setting follows nearly the virtual drive characteristics as shown by the narrow ellipse 1514. However, when the drill-string is excited at higher frequencies such as 1508 (or oscillation frequency Fr3 for drill-string), the control systems may not ensure fast adjustment of the frequency of power output and the motor may not be able to follow accurately the virtual drive characteristic: as an example, this is shown by the path 1516. Furthermore, FIG. 12 depicts the effect of the modifying the frequency of the drill-string oscillation while the VFD adjustment rate is kept constant.

Figure 13A:
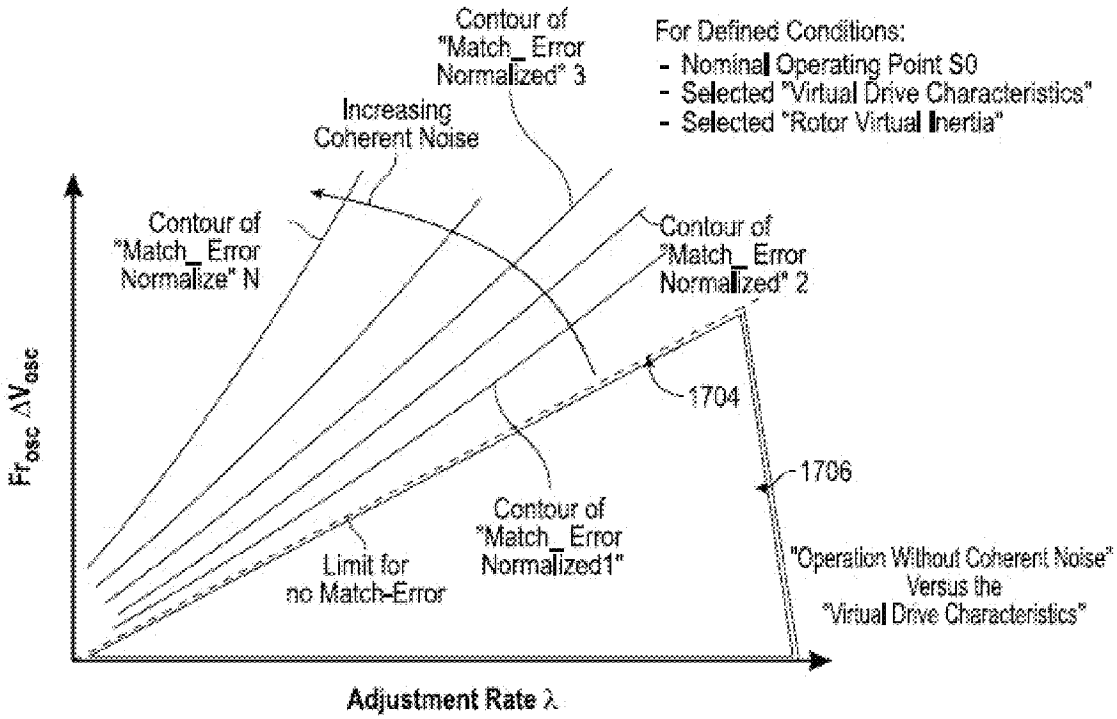
FIG. 13A illustrates a graph illustrating an example of the mapping of the coherent noise due to distortion of the driving process of a rotary drilling system operating under variable rotational conditions of a well according to one or more embodiments of the present disclosure.
Figure 13B:
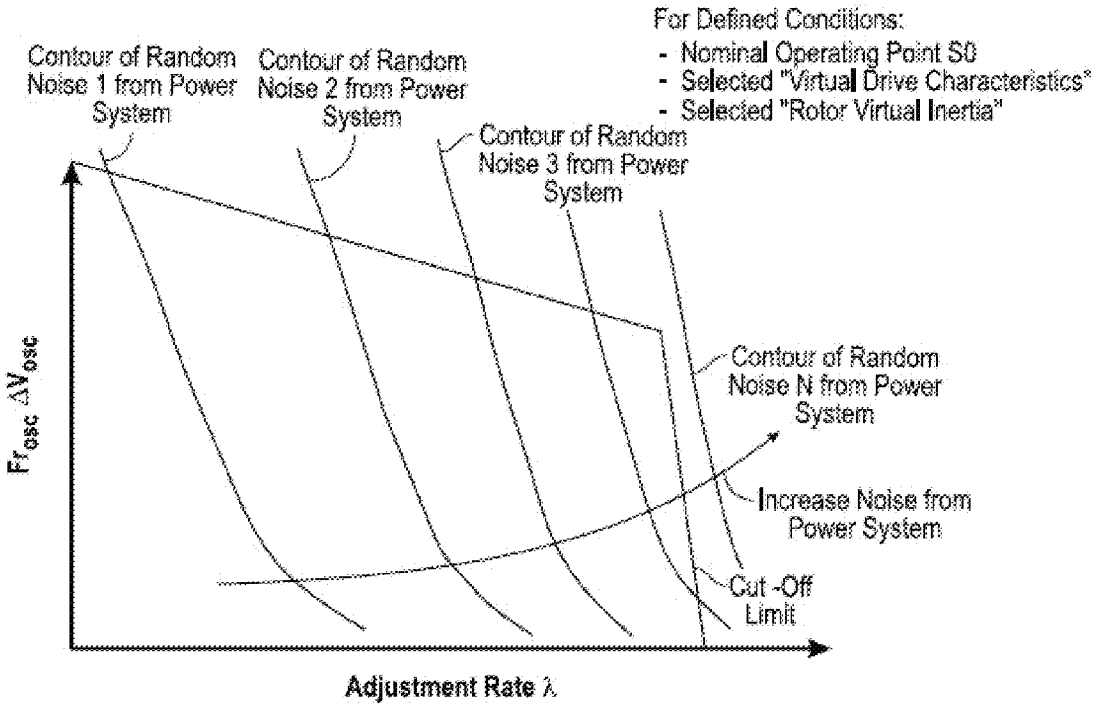
FIG. 13B illustrates a graph illustrating an example of the mapping of the random noise generated during the operation of the rotary drilling system according to one or more embodiments of the present disclosure.

In one or more embodiments, a fast adjustment rate requires the proper high performance for the whole system (e.g., in FIG. 4, sensors 135, data acquisition unit 315, controller 139, driver unit 317 and IGBT 319 which control the AC power 311 for the top drive system 115). If one or some of these elements are not capable of sustaining the fast adjustment process, the system may not be able to generate the required frequency for the supply power at the proper timing (e.g., due to limits of the IGBT 319). This may result in an improper torque across the motor, which could degrade the function of the system. Noise is induced in the rotary system by these effects of the power system. Such noises may be characterized of "random noise," as they are not correlated/ coherent to the drive process. The trend of this random noise is illustrated in FIG. 13B by contour lines of "constant value noise" in the same axes as seen in FIG. 13A. Said noise also generates perturbation in the drive system, not allowing the perfect operating conditions. For given operating potential conditions, the total noise based on the random noise as defined in FIG. 13B may be added to the coherent noise as defined in FIG. 13A. The total noise can also be displayed as contour line of constant value in Figure 13C, using the same axes as in FIGS. 13A and 13B. Furthermore, the control system and power system are limited in their maximum capabilities for adjustments so that the operating range is limited by cut-off capabilities. The aforementioned cut-off limits are also illustrated in FIG. 13C.

Figure 13C:
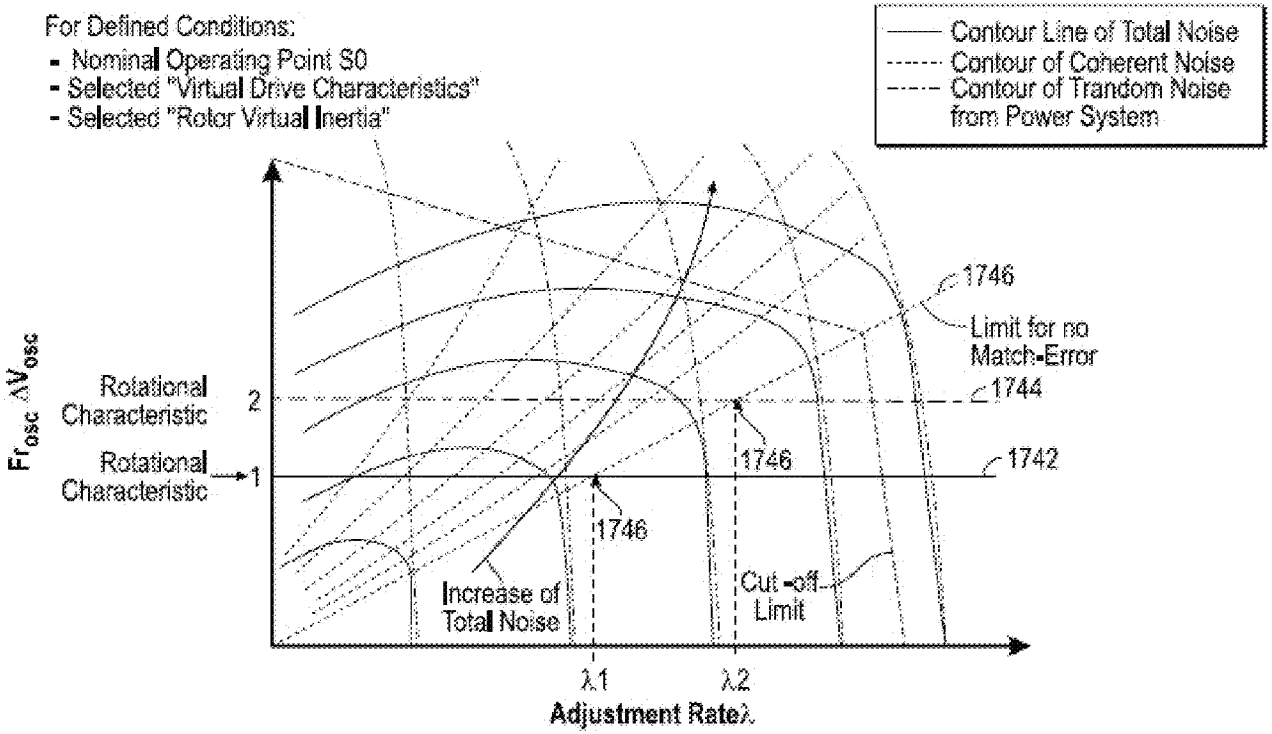
FIG. 13C illustrates a graph illustrating an example of the mapping of the total noise generated during the operation of the rotary drilling system according to one or more embodiments of the present disclosure.
Figure 13D:
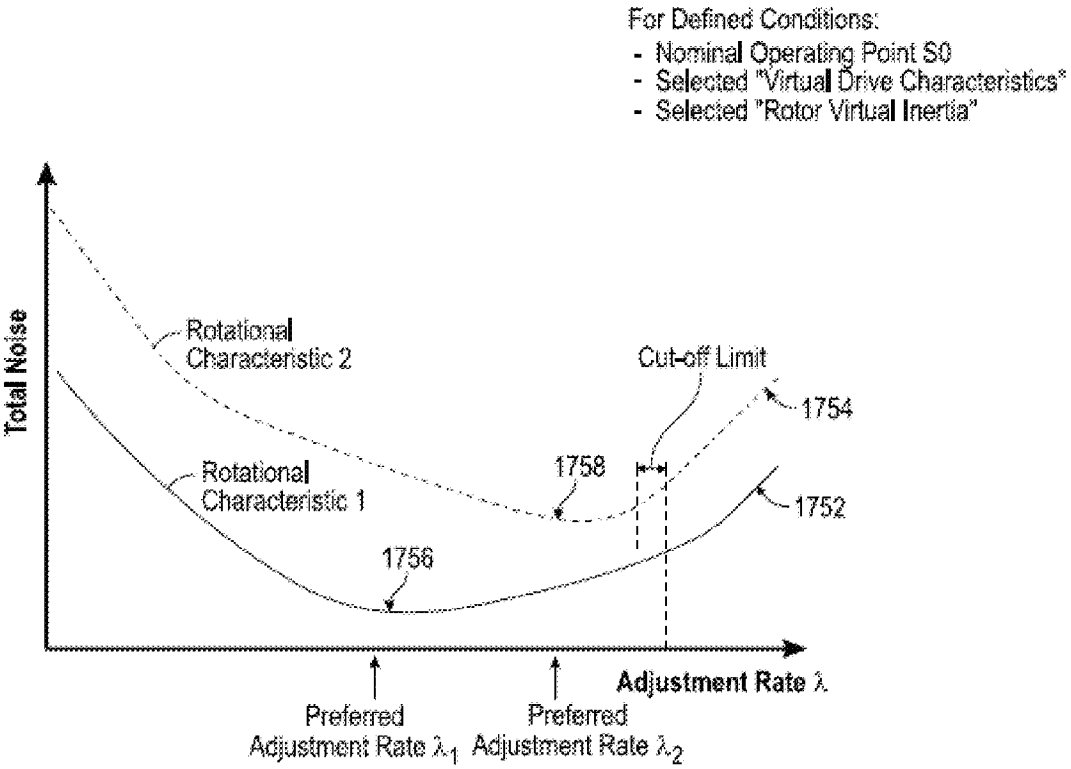
FIG. 13D illustrates a graph illustrating some examples of total noise during operation of the rotary drilling system at different conditions according to one or more embodiments of the present disclosure.

As seen by FIG. 13C, in one or more embodiments, FIG. 13C also illustrates the case of rotational characteristic 1 and rotational characteristic 2 on the Y-axis. For each of these rotational characteristics, the total noise can be determined in relation to the adjustment rate following the lines 1742 and 1744. The aforementioned noises can be ported in the graph as seen by FIG. 13D. A line 1752 passes by a minimum at 1756 and nearly corresponding to the value of adjustment rate λ1 as defined in FIG. 13C. A line 1754 passes by a minimum at 1758 and nearly corresponding to the value of adjustment rate λ2 as defined in FIG. 13C. Furthermore, when observing the FIG. 13C, it may be noted that A1 and A2 correspond to the crossings 1746 and 1748 between the limit for no match error 1746 and the lines 1744 and 1742 corresponding to a given rotational characteristic. If the rotary drilling system is affected by a condition of rotary oscillation (defined by $Fr_{-osc}$ $\Delta V_{osc}$), then the minimum (i.e. 1756) as displayed in FIG. 13D corresponding to the crossing of the line 1742 with the limit for no match error (1746). In one or more embodiments, the adjustment rate may be selected versus oscillation characteristic ($Fr_{-osc}$ $\Delta V_{osc}$) of the rotary drilling system and the rotational speed. However, there may be little, if any, benefit to select a higher value for the adjustment rate, as random noise will be introduced by the power system. There would also be little, if any, benefit to select a lower value as coherent noise would be introduced. The minimization of the total noise may have to include the condition involving multiple rotational characteristics. Said situation may occur when secondary resonance may be present along the rotary system involving the drill-string or when the amplitude of oscillation may vary versus time. Thus, it is necessary to minimize the total error induced by simultaneous sources of rotation oscillation.

Figure 14B:
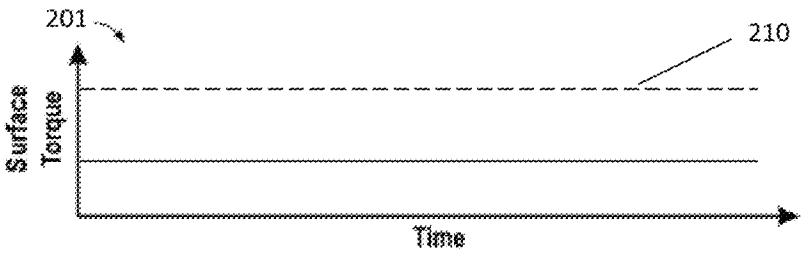
FIG. 14B illustrates a graph illustrating an example response of a drill string submitted to variable torque load along the wellbore according to the system of FIG. 14A of one or more embodiments of the present disclosure.
Figure 14C:
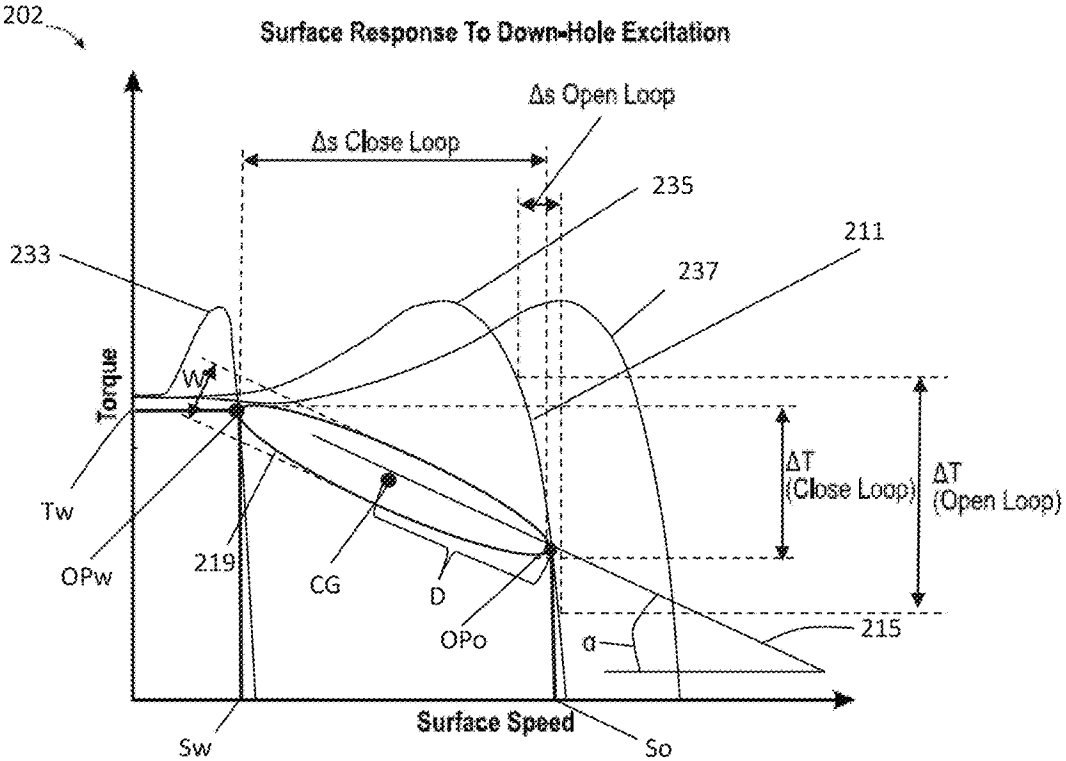
FIG. 14C illustrates a graph illustrating an example response of a motor driving a rotary drilling system according the system of FIG. 14A of one or more embodiments of the present disclosure.
Figure 14A:
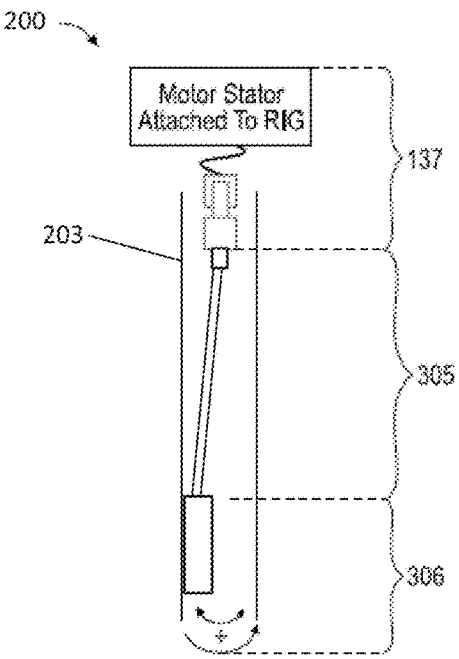
FIG. 14A illustrates shows a schematic view of a rotary drive system of a rotary drilling system in whirl according to one or more embodiments of the present disclosure.

FIGS. 14B and 14C show graphs 201 and 202 illustrating responses for an example system 200 shown in FIG. 14A. Specifically, FIG. 14B shows a graph 201 depicting a down-hole fluctuation in torque affecting operation of the rotary drilling system of the system 200, including, a drill string 305 and a bottom hole assembly (BHA) 306 which includes a drill bit (not represented), which is rotated by a motor 137 and making contacting with a wellbore 203. As described, variation of rotational conditions may occur due to whirling effect which involves lateral vibration which may be related to intermittent contacts between drill string 305 and/or BHA 306 with the wellbore. Such effects influence the torque demand at a shaft of the motor 137 as shown in graph 201 of FIG. 14B. For example, during operation, whirling and radial vibration may occur at the drill string 305 and the BHA 306, which can create downhole fluctuations in torque (solid line moving to become dotting line 210 on the graph 201) and/or speed at these locations of the drill string 305 or BHA 306. These variations propagate to the surface and affect a torque demand or at the motor 137. As compared, for example, to FIG. 9B, the surface response 210 due to the existence of whirling (shown, for example in FIGS. 1A-1D) may appear as an increase of the average torque demand at the surface, in contrast to a sinusoidal response seen in FIG. 9B. The sinusoidal oscillation response in FIG. 9B may be due a source of torsional excitations (e.g., stick-slip), which may typically stay sustained for long time period (e.g., such behavior is typically low frequency). Low frequency torque variation may propagate along the drill-string, as shown in FIG. 10A. The amplitude of the torque and speed variation at the motor 137 may depends on the type of motor and drive control for the VFD 309. Whirling is often associated with radial vibrations and shocks that are the source of high frequency variation for torque during the contact with the bore wall. Whirling (especially backwards whirling) generated several contacts of the rotary system with bore wall per turn. Such high number of contact per turn may generate a torque variation frequency as combination of rotation speed and number of shock per turn. For example, a drill-string turning at 120 RPM and submitted to ten shocks per turn would be exited with a base frequency of 20 hertz. Furthermore, each contact may create a short impulse of radial contact force which in turn creates a short impulse of torque.

Figure 15A:
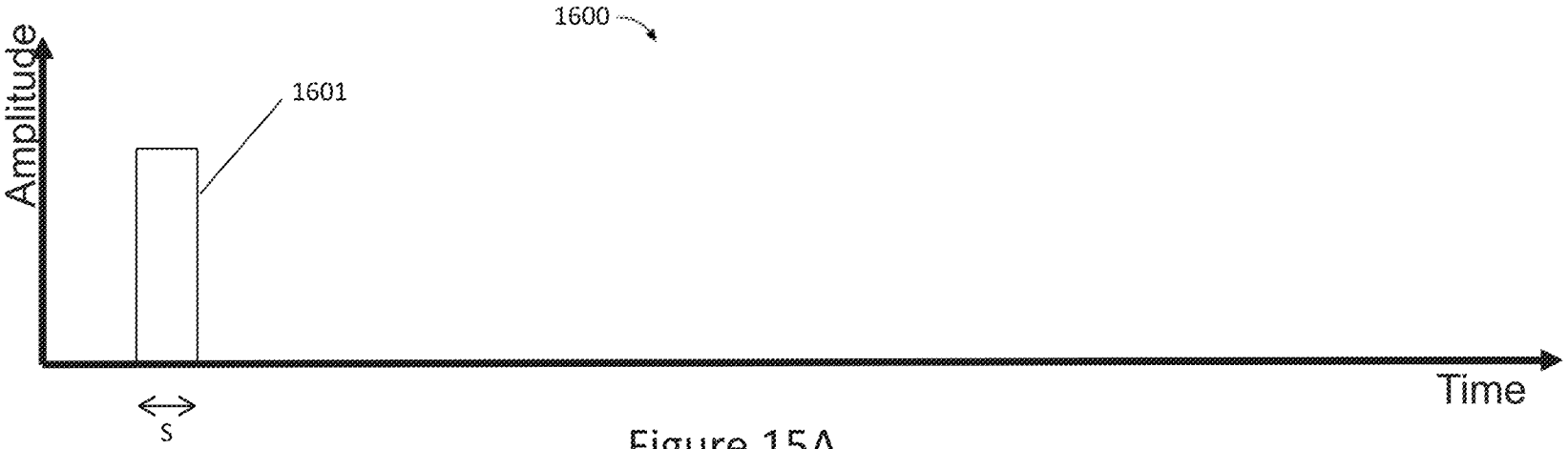
FIG. 15A illustrates a graph of a time versus amplitude response for a single square transient signal of a motor driving a drill string according to one or more embodiments of the present disclosure.
Figure 15B:
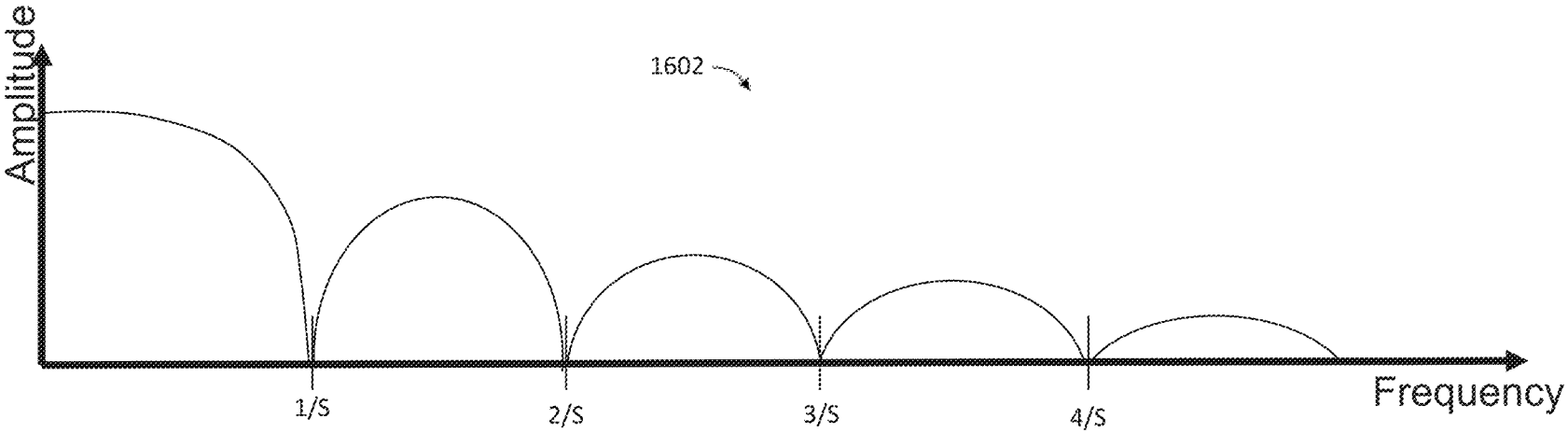
FIG. 15B illustrates a graph of a frequency versus amplitude response for a single square transient signal of a motor driving a drill string according to one or more embodiments of the present disclosure.
Figure 16A:
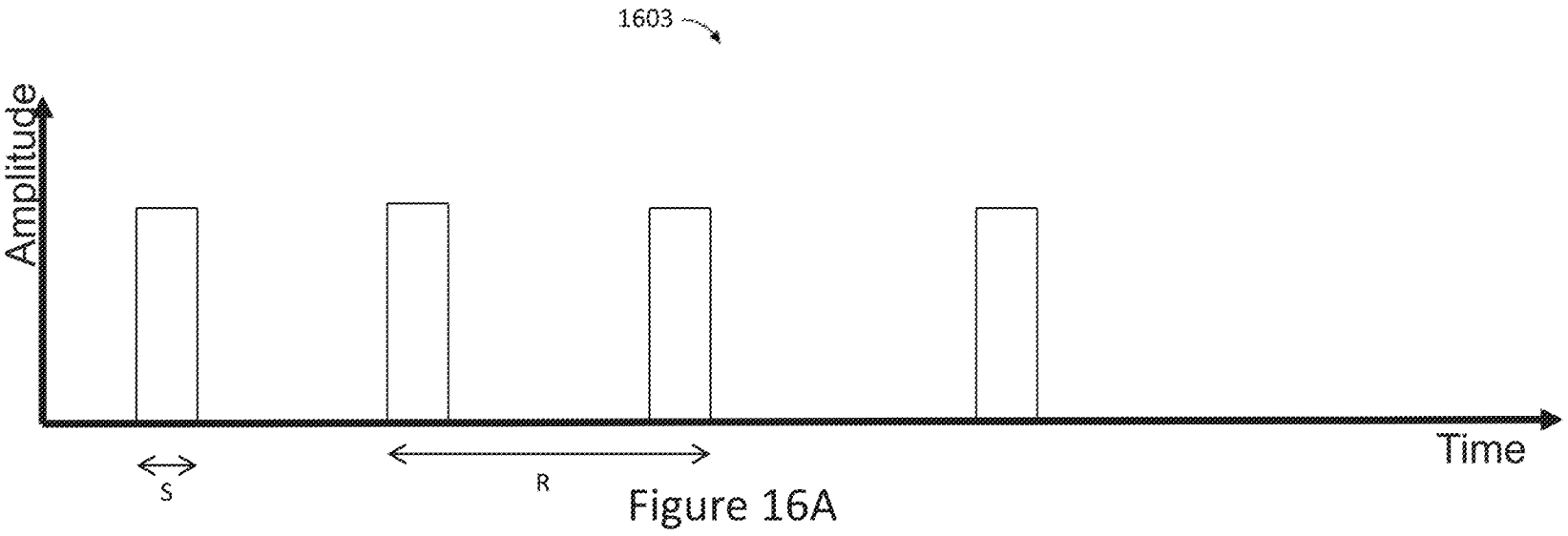
FIG. 16A illustrate a graph of a time versus amplitude response for a repetitive transient signal of a motor driving a drill string according to one or more embodiments of the present disclosure.
Figure 16B:
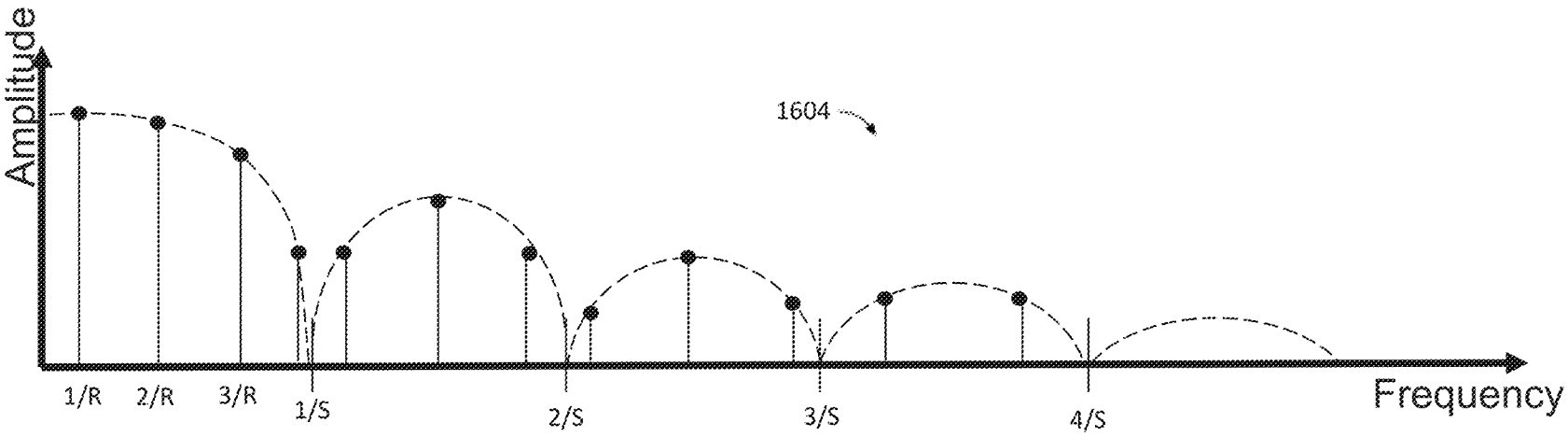
FIG. 16B illustrates a graph of a frequency versus amplitude response for a repetitive transient signal of a motor driving a drill string according to one or more embodiments of the present disclosure.

A case of a theoretical single transient signal is shown in FIGS. 15A and 15B. In FIG. 15A, graph 1600 illustrates amplitude over time response of a transient shock S on the drill string for a single square transient signal 1601 of the motor driving the drill string. Additionally, such transient shock S covers a wide range of frequencies and extends to high frequency, as shown in graph 1602 of amplitude over frequency in FIG. 15B. Based on the theoretical knowledge of signal processing, the graphs 15A and 15B are equivalent. Furthermore, when such shock transients S are periodically repeated R (see graph 1603 in FIG. 16A), the response of a single transient (as shown in FIGS. 15A and 15B) is convoluted with a base repetition frequency (and it may be harmonic) to provide the response in frequency, as shown graph 1604 in FIG. 16B. The response in frequency shown in FIG. 16B is a theoretical example of a torque variation due to the whirling effect.

Figures 17A, 17B, 17C:
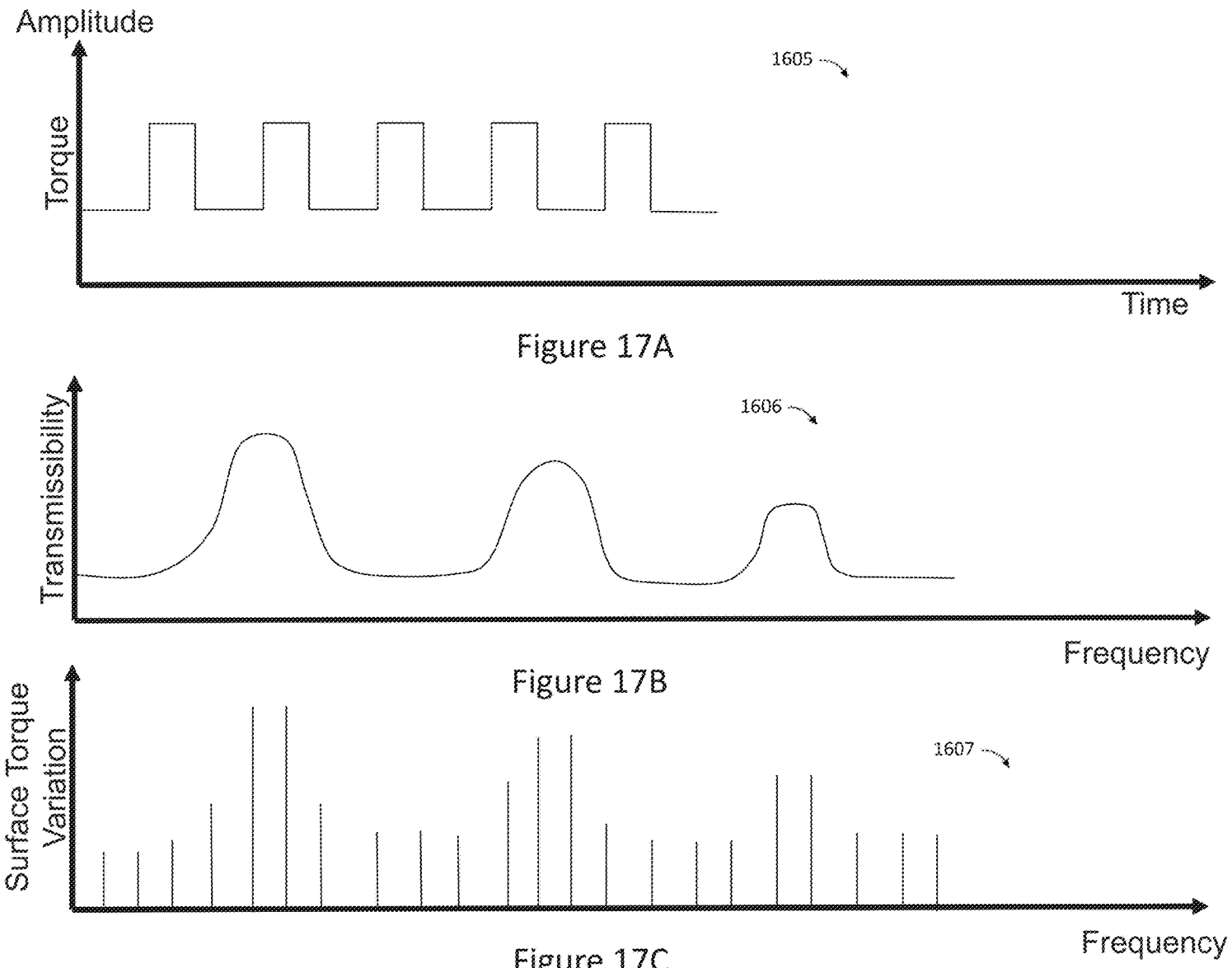
FIGS. 17A-17C illustrates a graph of reference function of a motor driving a drill string illustrating an example of a system output when whirl occurs according to one or more embodiments of the present disclosure.

In one or more embodiments, the drill string has its own torsional resonance due to the drilling string having multiple sections of different inertia and torsional rigidity. Further, the drilling string having multiple sections of different inertia and torsional rigidity defines a transmissibility capability of the drill-string of torsional vibration to the surface, as shown in graph 1606 of FIG. 17B. The graph 1606 of transmissibility over frequency illustrates peaks which correspond to torsional resonances of the drill string. For example, large peaks are typically at a low frequency (less than one hertz). The torsional resonances act as a filter for transmission of signals applied along the drill string and directly affect the received signal at extremities (i.e., an upper extremity at the top drive). The torque excitation due to whirling (as described in FIG. 16A and further illustrated in graph 1605 of FIG. 17A) convoluted with the drill string filtering action (FIG. 17B) allows for the determination of the torque variation at surface, as shown in the surface torque variation over time graph 1607 of FIG. 17C. Typically, due to the low-pass filtering effect of the transmissibility of the drill string, the down-hole whirling effect appears mainly as an increase of torque demand at surface. With the low-pass filtering effect of the transmissibility of the drill string, whirling may be difficult to detect in surface, as it would appear as a shift in average demand, and thus, such a behavior would be present in case of open-loop operation of the motor 317 driven by the VFD 309.

A key characteristic of whirling is the narrow band of rotation conditions to maintain whirling conditions. With small change in RPM of the drill string and BHA, or small change in the hole conditions (such as friction at the wall or clearance), whirling may not establish. For example, the graph 202 (in FIG. 14C) depicts when different torque demand is occurring along the system 200. In the case of open loop operation 211, the variation of torque can be large, while the corresponding variation in speed is small. By operating in close-loop control following a virtual drive characteristic 215, the variation of speed is larger while the corresponding variation of torque may be smaller.

In the case of conventional stick-and-slip condition, oscillation of drilling rotary conditions may appear. In particular, the down-hole torque may oscillate around a nominal torque (as shown in FIG. 9B). During a full oscillation cycle of torque due to the wave propagation, torque and speed may oscillate to have an optimum speed and torque at the nominal operating point $OP_0$ (e.g., selected by an operator), as shown in FIG. 9C. If a response of the system 200 (including sensors, controller, VFD, and motor response) were infinitely fast, the response would follow the virtual drive characteristic line 215 in the graph (upper left corner). Due to limits in response speed (limited adjustment rate), however, the system 200 may actually follow an elliptical pattern 219 when operating in close-loop (e.g., as shown in FIG. 9C).

The whirling effect may be detected at the surface as an increase of mean torque demand, while the high frequency effect is not detectable at the surface due the low pass filtering effect of the drill string. Additionally, whirling is extremely sensitive to the average rotary speed (RPM) of the drill-string, such that a small change of RPM may force the drill string to be rotated with or without whirling. When a drilling system is operated with a control based on the method of virtual drive characteristic (explained above), the occurrence of whirl along the string increase the torque demand at the motor 317. In reference to FIG. 14C, which describe a drilling system associated with a close-loop control based on virtual-drive-characteristic, the operating point $OP_0$ which corresponds to the nominal operation without whirl would tend to be shifted to $OP_w$ when whirl occurs. The rotational speed would tend to drop by ΔS close-loop to the speed Sw. Further, the speed Sw may be sufficiently different than operating speed S0, so that whirling conditions disappear along the drill string. With the disappearance of whirling, the torque demand returns to the nominal value T0 and the system would return to the nominal operating point $OP_0$, in particular, the speed being reestablished to S0 so that whirling re-stabilized along the drill-string. Furthermore, the width W of the elliptical pattern 219 depends on the response speed (adjustment rate) of the system including the motor, the VFD and the closed loop system.

Further seen by FIG. 14C, the selection of the virtual drive characteristic 215 affects the response of the system 200 when operating under closed-loop control. In one or more embodiments, the virtual drive characteristic 215 can be determined by determining extremum of a reference function describing the behavior of the drill string assembly. The reference function can be, for example, an algorithm, a dataset, a mathematical relation including torque and or speed as input, or a predefined model of the drill string (e.g., stored in rig computing resource environment 105) that defines a correspondence between torque on the drill string assembly and the rotational frequency of the drill string assembly during typical rotation oscillation (e.g., a cycle of torque oscillation due to whirl).

Still referring to FIGS. 14A-14C, the system 200 may be controlled (e.g., by controller 139) to operate during successive periods of time with different values for a slope of the virtual drive characteristic 215 to determine the values $\Delta T(\alpha)$ and $\Delta S(\alpha)$ via a graph 205 for each value of $\alpha$, and then to generate information which relates the value of a function (3) versus $\alpha$ allowing to determine a particular value of the slope corresponding to the maximum of the function (3) over the successive periods. During these successive periods, the variations torque ($\Delta T$) and speed ($\Delta S$) can recorded in relation with the slope of the virtual drive characteristic ($\alpha$).

Figure 18:
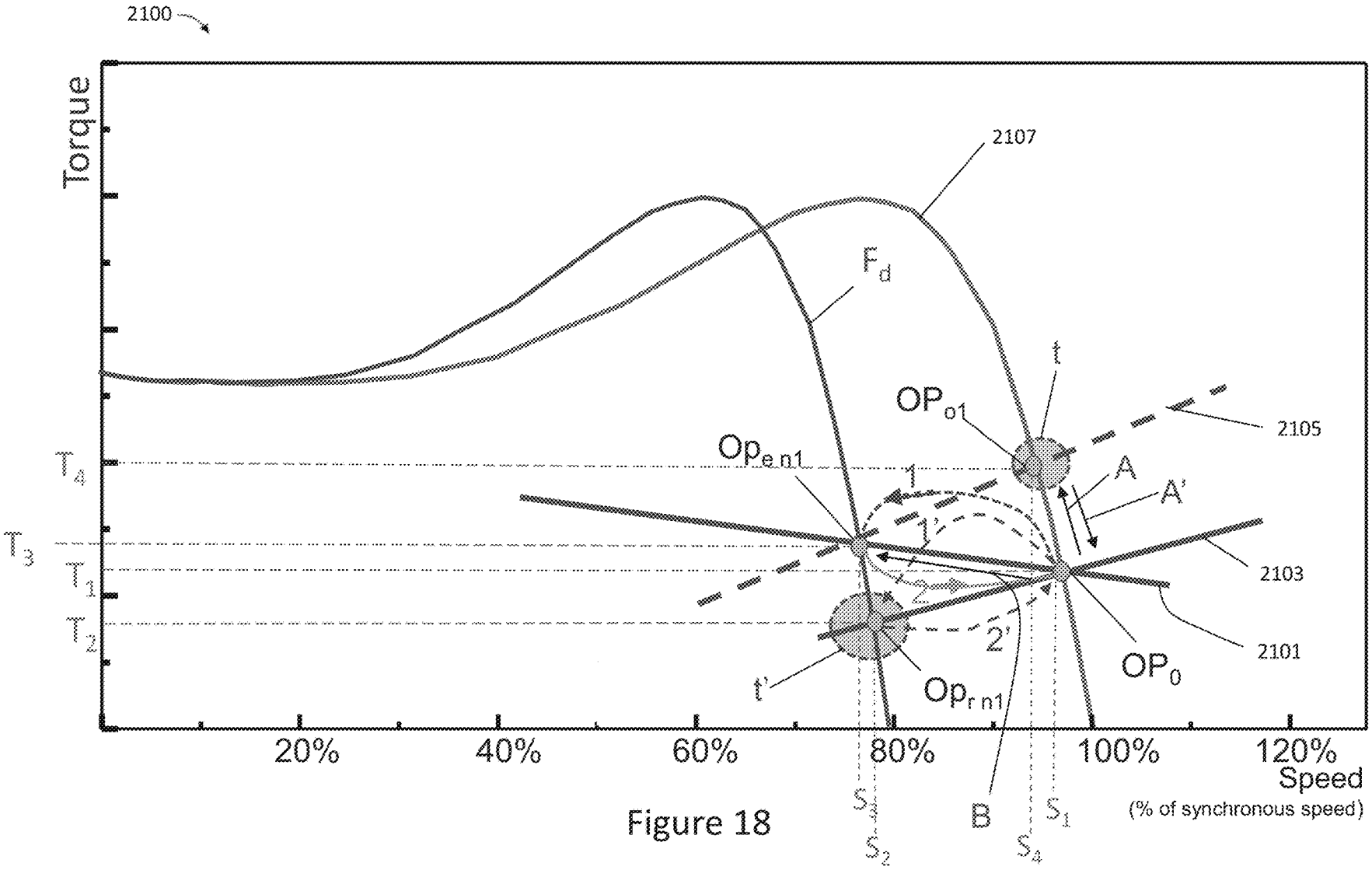
FIGS. 18 illustrates a graph of reference function of a motor driving a drill string illustrating an example of a system output when whirl occurs according to one or more embodiments of the present disclosure.

Now referring to FIG. 18, in one or more embodiments, FIG. 18 shows a graph 2100 of a drill string reference function illustrating an example of virtual drive characteristic 2101 at a nominal operating point of a motor (e.g., motor 137) while the drill string is rotated by the motor (e.g. motor 137). A normal rotational load or "torque demand" (when no whirl) 2103 on the aforementioned drill string assembly is specific to a rotational relationship of torque versus speed for the drill string. Furthermore, the motor driven is by a power at a given frequency operated along a motor output characteristic 2107. The nominal drilling condition $OP_0$ (e.g., steady drill operation on well bottom without whirl and without variation of rotation conditions) is defined as an intersection of the motor output characteristic 2107 and the drill string rotational demand 2103. This intersection corresponds to the torque loading imposed by the motor on the drill string. The intersection between the motor output characteristic 2107 and the rotational demand 2103 can define a first speed $S_1$ for the motor associated with a first torque output $T_1$ while the motor is driven at a power (See 311 of FIG. 4) having a frequency $F_N$. Additionally, the drill string may be entering into whirling and radially contacting or hitting the wellbore along the drill string or at the BHA and drill bit with the generation of higher friction, the drill string torque load (or demand) shifts from the rotational demand 2103 to a torque load with whirl 2105. In one or more embodiments, if the top-drive is operated in an open-loop, the motor stays driven by the power (311) at frequency $F_N$, so that the motor characteristics stay the motor output characteristic 2107. In such case, the operating point in presence of whirling is at $OP_{01}$ with a driving torque T4 and a rotational speed S4 (see FIG. 19).

In some embodiments, when the top system is controlled with a "stick-and-slip" control associated with a "virtual drive characteristic" 2101, the control system would then lower the drive frequency of AC power (311) to tentatively keep the "operating point" at the intersection of the "virtual drive characteristic" 2101 and the torque load which is transitioning from the rotational demand (normal torque) 2103 without whirling to the torque load 2105 when whirling occurs. With such control logic, the operating point may tentatively move from $OP_0$ (when no whirl) to $Op_{e\ n1}$ (See loop 1 2); However, as the control system lowers the drive frequency of the AC power (311), the rotational speed of the drill string reduces and then the whirling may disappear. Then the control system may impose a change of frequency of AC power such that a transition in the graph 2100 appears as the path 1': for example, the extremity of the path 1' is back on the initial torque load (or demand) 2103, as the additional torque demand disappears as the whirling has disappeared. This would correspond to the tentative operating point $OP_{m1}$ at the interaction between the motor characteristic for the drive frequency Fd and that torque load 2103. However, this operating point $OP_{r\ n1}$ is below the drive characteristic 2101 so that the control system increases the rotational speed by increasing the frequency of the AC power (311), bringing back the operating point to $OP_0$ by the path 2'. But, as the conditions in the well-bore are not modified, whirl immediately reestablishes so a new loop 1' 2' would be restarting. The aforementioned oscillation (1', and 2') may occur continuously even if the operator is not changing the setting of the drilling parameters, such that oscillation would not be adequate for optimum drilling. The evolution of the operating point is further described below in FIGS. 19-21. It is further envisioned that the control system may use a center of gravity (not shown) of the torque versus speed response (graph 2100) to differentiation between whirl and stick-and-slip behaviors. For example, if stick-and-slip behavior is present, the center of gravity may be in a vicinity of the operating point $OP_0$. Alternatively, if whirl behavior is present, the center of gravity may correspond to a lower torque of a torque of the nominal operating point $OP_0$ and the center of gravity is located at or below the "virtual drive characteristic" 2101 passing by a nominal operating point $OP_0$.

Figure 19:
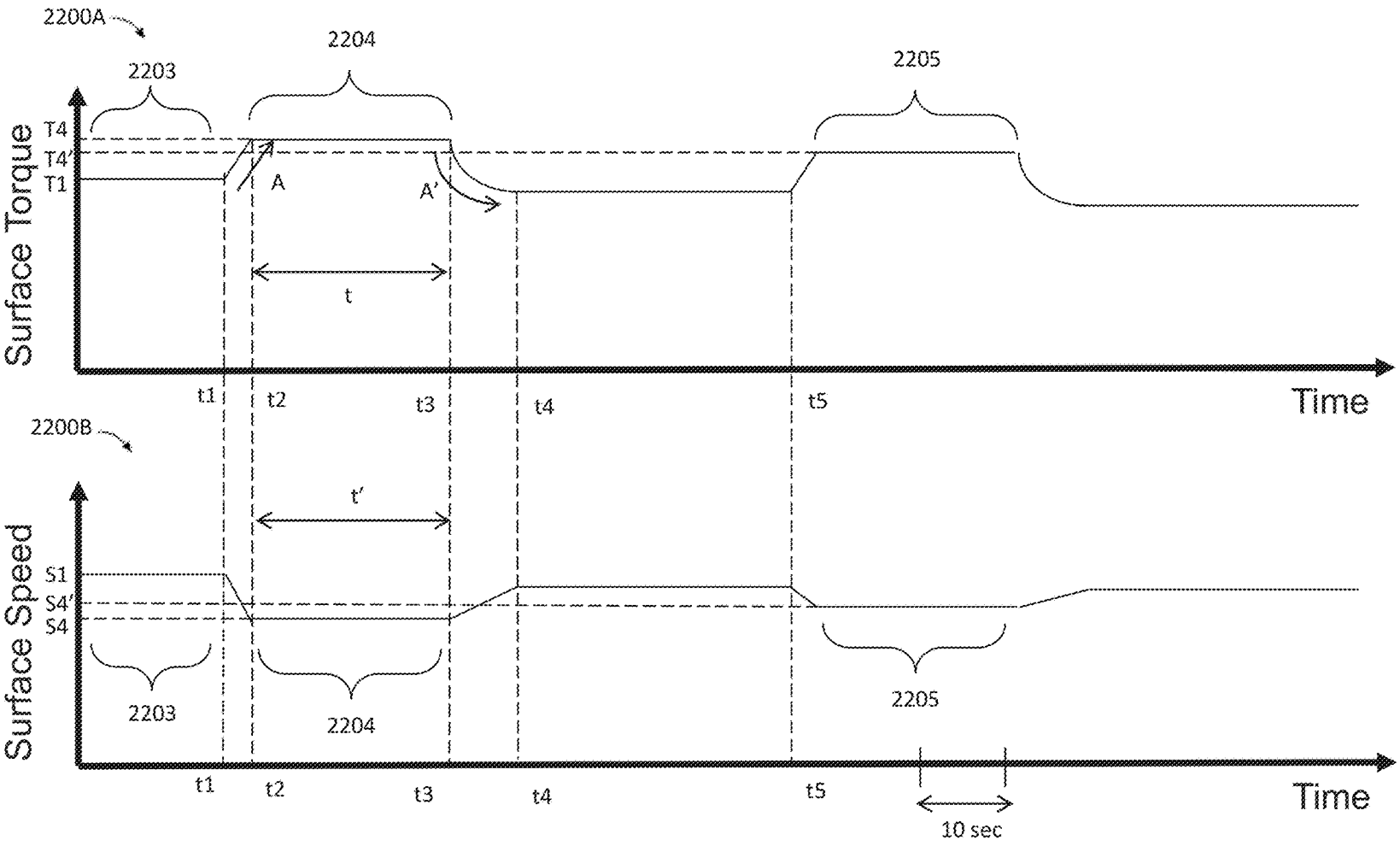
FIG. 19 illustrates a graph of reference function of a response of a motor driving a rotary drilling system in a well bore when the motor drive operates in open-loop of the graph in FIG. 18 according to one or more embodiments of the present disclosure.
Figure 20:
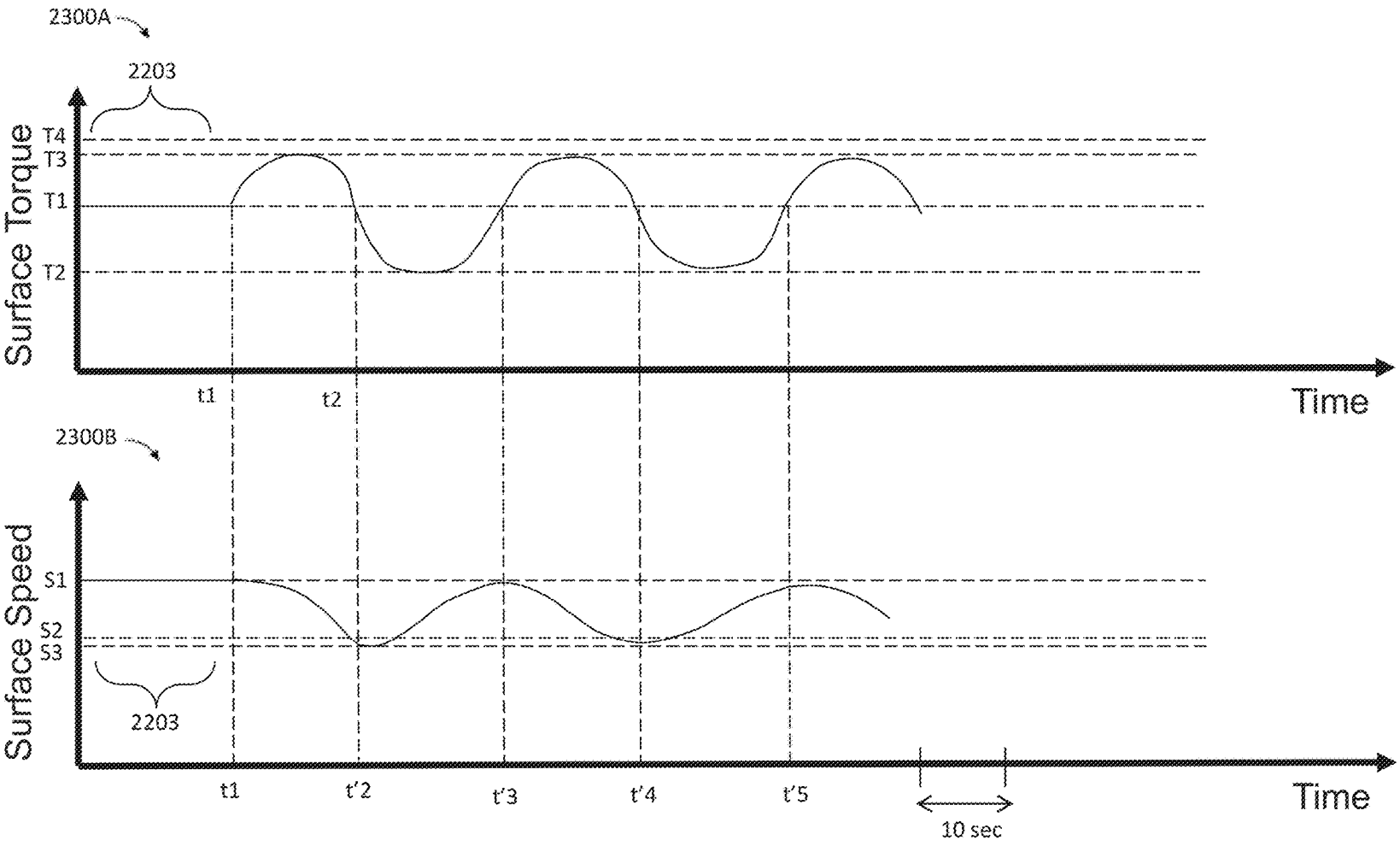
FIG. 20 illustrates a graph of reference function of a response of a motor driving a rotary drilling system in a well bore when the motor drive operates in relation with a virtual-drive characteristic of the graph in FIG. 18 according to one or more embodiments of the present disclosure.
Figure 21:
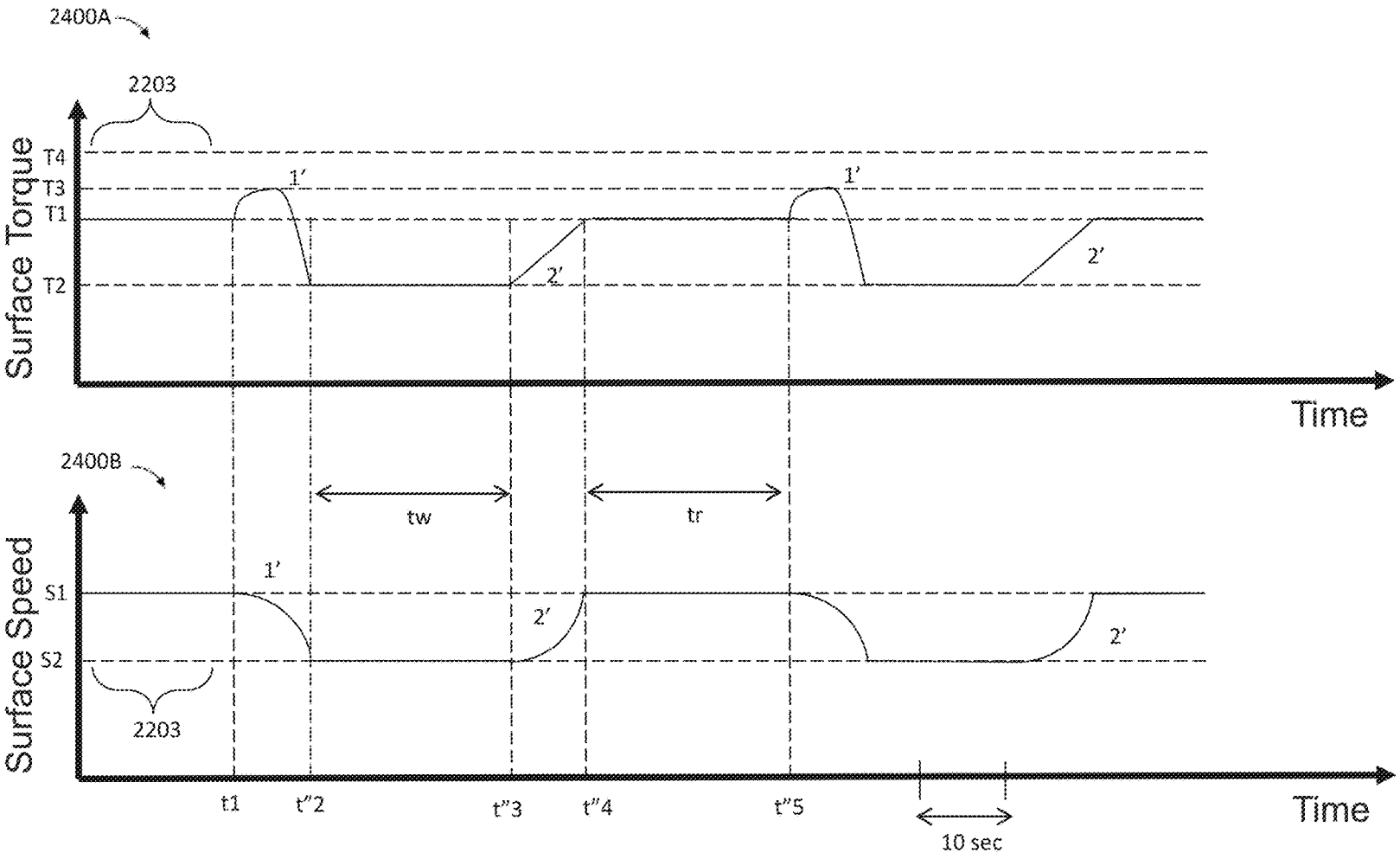
FIG. 21 illustrates a graph of reference function of a response of a motor driving a rotary drilling system in a well bore when the motor drive operates in relation with a virtual-drive characteristic combined with adjustment response of whirling occurrence of the graph in FIG. 18 according to one or more embodiments of the present disclosure.

With respect to FIGS. 19-21, FIGS. 19-21 illustrates graphs that are related to FIG. 18, which describes the potential response of a rotary drilling assembly in the well-bore with and without occurrence of whirling. Additionally, FIGS. 19-21 are also related to the typical adjustment by the controller 139 when adjusting the motor performance in relation with the "virtual drive characteristic" in presence of different load curves. Specifically, FIG. 19 shows the torque (graph 2200A) and speed (graph 2200B) behavior versus time of the motor 317 driving the drill string and BHA in rotation in the well-bore, while the control of the VFD 309 is performed in open-loop. The graphs 2200A and 2200 may be used by the controller to determine a presence of whirl or stick-and-slip behavior from an observed torque and speed response of the rotary drilling system and drill string for sufficient time duration of the observed torque and speed response. FIG. 20 shows the torque (graph 2300A) and speed (graph 2300B) behavior versus time of the motor 317 driving the drill string and BHA in rotation in the well-bore, while the control of the VFD 309 is performed with a virtual-drive-characteristics not including specific adjustment for potential occurrence of whirling at certain rotation speeds in the well-bore (i.e., closed loop). FIG. 21 shows the torque (graph 2400A) and speed (graph 2400B) behavior versus time of the motor 317 driving the drill string and BHA in rotation in the well-bore, while the control of the VFD 309 is performed with a virtual-drive-characteristics associated with adjustment for potential occurrence of whirling at certain rotation speeds in the well-bore.

For clarity purposes (i.e., a eligible graph), FIGS. 19-21 each have two graphs to show the corresponding behaviors described above; such that the upper graphs (2200A, 2300A, and 2400A) are surface torque (of the motor) over time in FIGS. 19-21 and the lower graphs (2200B, 2300B, and 2400B) are surface speed (of the motor) over time in FIGS. 19-21. Further shown by FIGS. 19-21, a portion 2203 of the graphs (2200A-2400B) are illustrated to represent normal conditions of the motor while the drill string is operating as expected in the wellbore. In the portion 2203, the torque and speed are typically in correspondence with the parameters selected by the operator. The drill string operates at the operating point $OP_0$ as described above in FIG. 18. However, as discussed above the drill string may experience various elements to cause the operation to run different, which will be described in more detail below. Furthermore, because the graphs of FIGS. 19-21 are derived from FIG. 18, the same reference numbers may be used in FIGS. 18-21 to represent the same value referenced to in multiple Figures to further illustrate differences in various embodiments.

As described above, the portion 2203 in FIGS. 19-21 represents the normal conditions of the motor while the drill string is operating as expected in the wellbore; and further, the portion 2203 may last for a period of time up to a time t1 at which the whirling effect establishes in the well-bore. For example, at the time t1, the whirling effect may be generated by a change of local well-bore diameter, accumulation of cutting in the well-bore, effect of wellbore rugosity, etc. In reference to FIG. 18, the torque load changes from the normal torque 2103 to the torque load with whirl 2105. In such a case, when operating in open-loop (FIG. 19), the operating point moves from $OP_0$ to $OP_{01}$ as shown in FIG. 18 (as explained above) via a path A with the torque changing from T1 to T4 and the speed from S1 to S4. The new operating condition (i.e., $OP_{01}$) is reached at time t2. After some duration 2204 of drilling with presence of whirling, the conditions in the well may change and whirling disappear at time t3 and the system may return to normal condition (operating point $OP_0$) at time t4 via a path A' (see correspondences between FIGS. 18 and 19). At time t5, conditions in the well may against change and whirling re-establishes, and thus, a new cycle starts. Additionally, the duration 2205 of the new cycle may be different than the duration 2204. Furthermore, the corresponding speed S4' and torque T4' during duration 2205 may be different than S4 and T4 during duration 2204, as these values depends on the type of perturbation in the well-bore.

When operating in close-loop with a given "virtual drive characteristics" (FIG. 20), the targeted operating point corresponding to the presence of this additional torque demand due to the whirl would be $OP_{e\ n1}$, as shown in FIG. 18. The targeted operating point ($OP_{e\ n1}$) is defined as the intersection of the torque load with whirl 2105 and the virtual drive characteristic 2101 with the torque T3 and the speed S3. During a transition path B ($OP_0$ to $OP_{e\ n1}$), the torque demand increases towards T3 while the speed decreases towards S3. With this reduction of speed (S1 to S3), the whirl condition may disappear along the string and instantaneously, the torque demand would drop towards T2 of the resulting new operating point $OP_{r\ n1}$. When no specific mitigation of such response to whirl, the control system may try to bring the operating point form $OP_{r\ n1}$ to $OP_0$ (path 2' in FIG. 18). Once the controller re-establishes the operation conditions back to operating point $OP_0$ (normal conditions), the speed of the drill string and BHA is again at speed S1 which may still be the critical speed for whirling occurrence. In such the case, the process of changing operating point would restart, such that operating the motor would corresponds to continuous change along the ellipse described in FIG. 14C.

In one or more embodiments, the control system detects that the targeted operating point is drifting from $OP_0$ to $OP_{r\ n1}$ during adjustment duration (time t1 to t2" in FIG. 21) in relation with "virtual drive characteristic". The recognition of the drifting may be based on that the initially targeted torque T3 was above the initial operating torque T1 and then suddenly the measured torque dropped to value in the vicinity of torque T2 of the resulting operating point $OP_{r\ n1}$. The sudden drop of targeted torques from T3 to T2 allows confirmation of the presence and disappearance of whirl along the drill string as a function of the drill-string rotation speed. After time t2", the controller may select the operating point $OP_{r\ n1}$ as the condition to avoid whirl in the wellbore. It is further envisioned that after a pre-defined elapsed time tw, the control system may progressively increase (during time period tR) the rotating speed towards the value (S1) of the initial operating point $OP_0$. Additionally, if the operating conditions along the drill string stay the same, whirl may restart at time t5", and thus, a new cycle of adjustment would start from time t5". At time t5" the control system would detect once more that whirl is still present in the wellbore. In such the case of the new cycle of adjustment, the control system would increase a value of the time duration $t_w$ of operation at the operation point $OP_{r\ n1}$. The increase of the duration $t_w$ would be continued over multiple cycles of "whirl-no-whirl", until the longest acceptable time for duration $t_w$ (predetermined) is reached. If the longest acceptable time for duration $t_w$ is reach, the time duration of the operation at the operating point $OP_{r\ n1}$ would stay at the longest acceptable time for duration $t_w$ . Furthermore, if whirl does not re-occur as described above at the time t5", the control system would operate the rotation at the operating point $OP_0$.

Figure 22A:
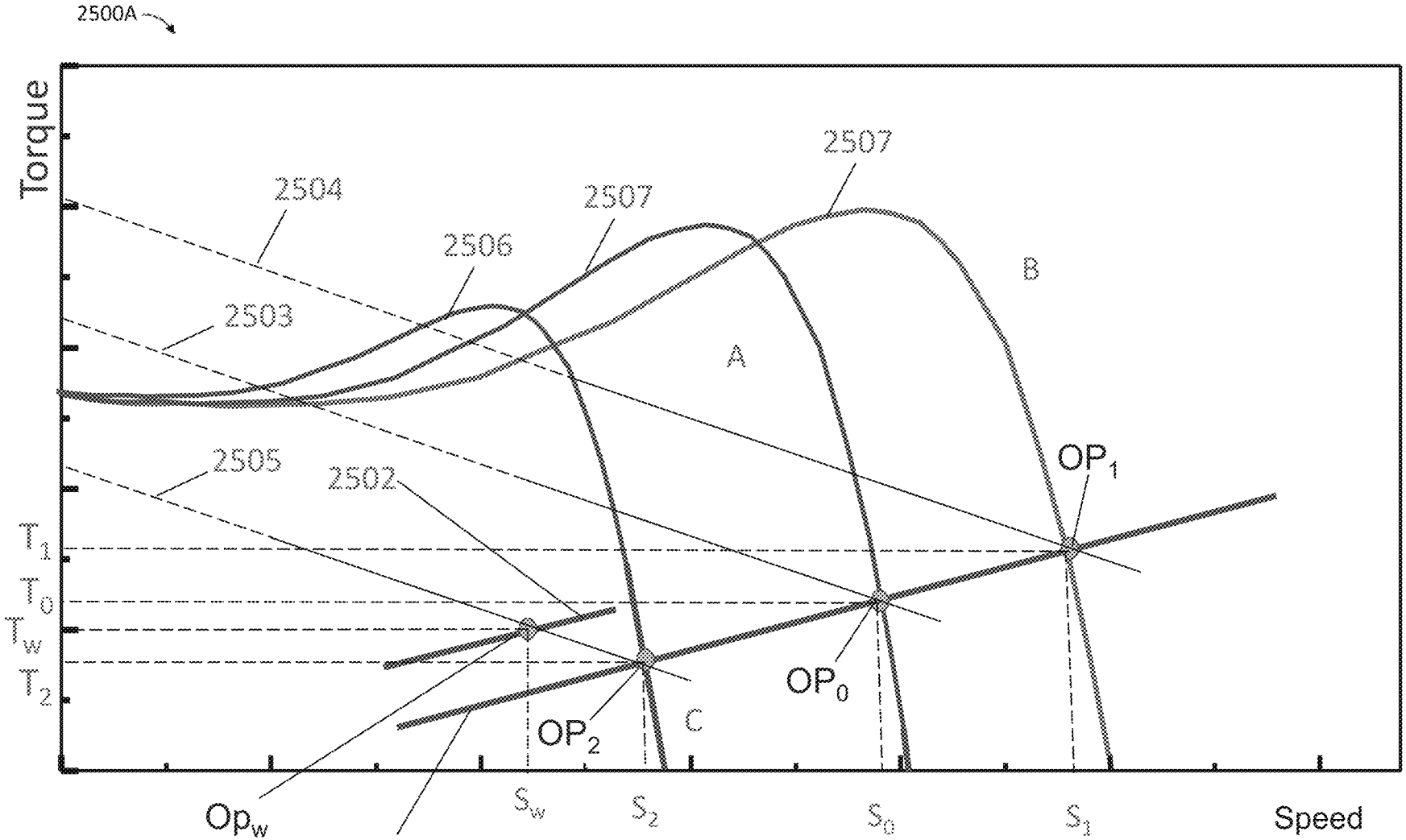
FIG. 22A illustrates a graph of reference function of a motor driving a drill string illustrating an example of a control process to determine if a current operating point is not affected by whirling in the well bore according to one or more embodiments of the present disclosure.

Referring to FIG. 22A, FIG. 22A illustrates a graph 2500A of a drill string reference function illustrating plotting a selected operating point $OP_0$ of a motor (e.g., motor 137) with or without whirling conditions (non-whirl drill string rotational demand line 2501 or whirl drill string rotational demand line 2502) along the drill-sting and the BHA while the drill string is rotated by the motor (e.g. motor 137). Additionally, the graph 2500A plots the motor driven by a power at a given frequency operated along a motor characteristic line 2506, 2507, 2508 with the X-axis being a speed of the motor and a Y-axis being a torque of the motor. Specifically, the graph 2500 may determine if the selected operating point $OP_0$ is creating or not creating whirl. To verify the selected operating point $OP_0$ is not creating whirl, the controller periodically imposes a control change in the rotation conditions to different virtual drive characteristic lines 2503, 2504, 2505. For example, the controller may change the virtual drive characteristic to be shifted upwards from line 2503 to line 2504. In the case of no-whirl (non-whirl drill string rotational demand line 2501), with such the upward shift (line 2503 to line 2504), the operating point is shifted from the selected operating point $OP_0$ to operating point $OP_1$ which is characterized with a higher rotation speed S1 and torque T1 in comparison to S0 and T0 at the selected operating point $OP_0$. Additionally, the controller may change the virtual drive characteristic to be shifted downwards from line 2503 to line 2505. At line 2505, the system would then operate at point $OP_2$ with a lower torque T2 and lower speed S2 than the torque T0 and speed S0 of the selected operating point $OP_0$.

As described above, to verify the selected operating point OP0 is not creating whirl, the selected operating point $OP_0$ moves to either point $OP_1$ or point $OP_2$ to still remain on the non-whirl drill string rotational demand line 2501 at the intersection of the virtual drive characteristic lines 2503, 2504, 2505 and the corresponding frequency of the motor characteristic lines 2506, 2507, 2508. In the case that the selected operating point $OP_0$ is creating whirl, the selected operating point $OP_0$ moves to a whirl operating point $OP_w$ along the whirl drill string rotational demand line 2502 (i.e., a sudden discontinuity in the position of operating points) when the controller changes the virtual drive characteristic to be shifted downwards from line 2503 to line 2505. The whirl operating point $OP_w$ is characterized with a speed Sw lower than the speed S2 and a torque Tw that is higher than the torque T2 of the operating point $OP_2$. Additionally, the whirl operating point $OP_w$ is not on one of the corresponding frequency of the motor characteristic lines 2506, 2507, 2508. Since the whirl operating point $OP_w$ has an increase torque and decreased speed than the operating point $OP_2$, the controller can compute that the selected operating point $OP_0$ will create whirl. To further distinguish if the selected operating point $OP_0$ is creating or not creating whirl, the torques and speeds shown in graph 2500A may be plotted on a graph versus time (see FIG. 22B).

Figure 22B:
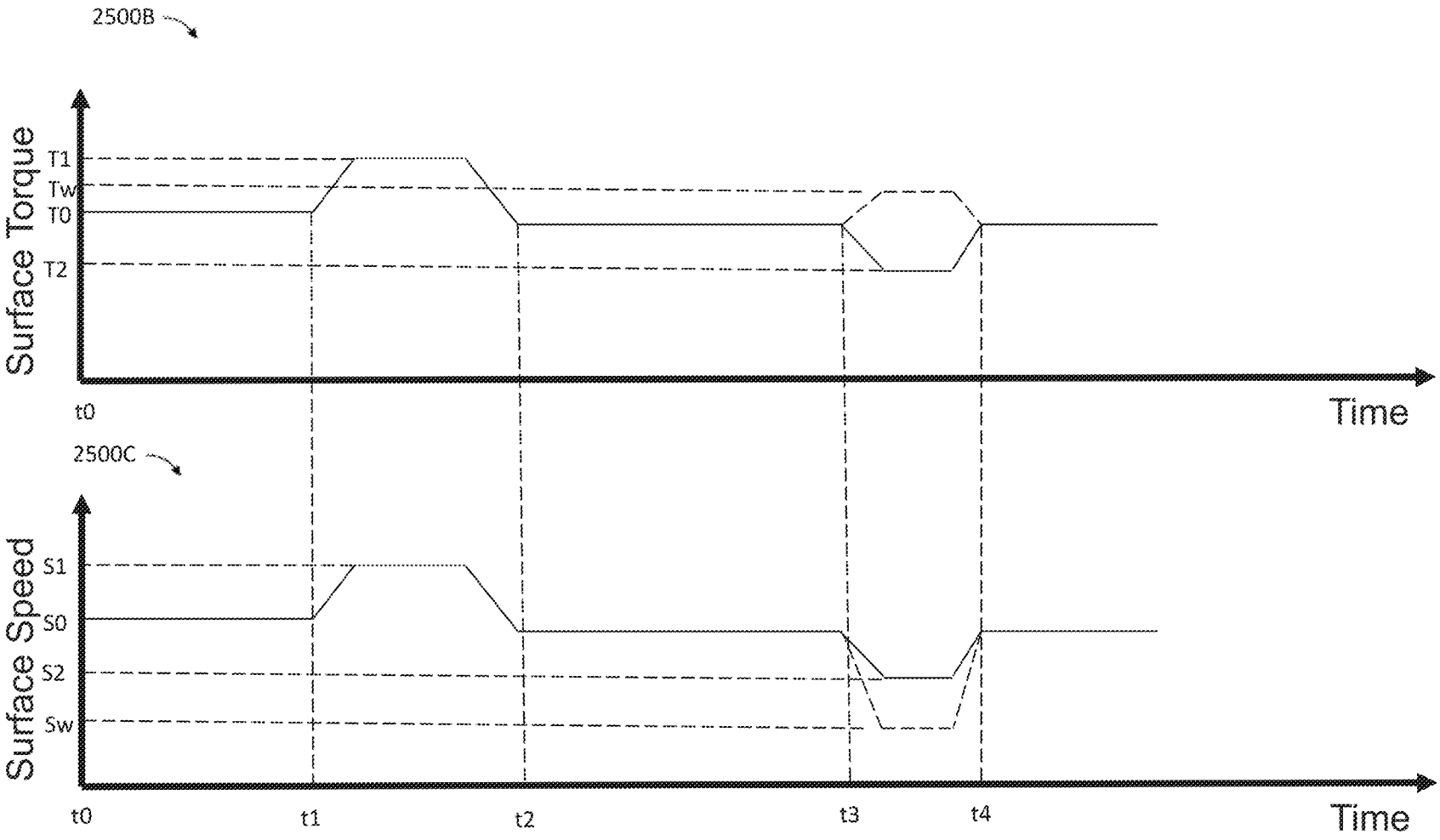
FIG. 22B illustrates a graph illustrating an example response of a motor driving a rotary drilling system of a drill string in a well bore of the graph in FIG. 22A according to one or more embodiments of the present disclosure.

In some embodiments, the torques T0, T1, T2, T3, from graph 2500A in FIG. 22A are plotted on a Torque (y-axis) versus Time (x-axis) graph 2500B in FIG. 22B. Further illustrated in FIG. 22B, the speeds S0, S1, S2, S3, from graph 2500A in FIG. 22A are plotted on a Speed (y-axis) versus Time (x-axis) graph 2500C. The motor is running at the selected operating point $OP_0$ for a duration of time starting from an initial time T0 to a time T1. Once the time T1 is reached, the controller imposes a control change to from the selected operating point $OP_0$ at torque T0 and speed S0 to the operating point $OP_1$ characterized by a higher torque T1 and speed S1 than that at the selected operating point $OP_0$. The control runs the motor at the operating point $OP_1$ for a period of time to then change back to the selected operating point $OP_0$ at time T2 without whirl occurring. For a second period of time from T2 to time T3, the control runs the motor at the speed S0 and time T0 of the selected operating point $OP_0$. Once at time T3, the control imposes another change from the selected operating point $OP_0$ at torque T0 and speed S0 to the operating point $OP_2$ characterized by a lower torque T1 and speed S1 than that at the selected operating point $OP_0$. If the motor stays running at the operating point $OP_2$, then the selected operating point $OP_0$ is verified to not create whirl, as shown by the solid line during time T3 to time T4 in FIG. 22B. However, if the selected operating point $OP_0$ is creating whirl, than during the time of period form time T3 to time T4, the motor is running at the whirl operating point $OP_w$ characterized by a lower speed Sw and higher torque Tw than that of the speed S2 and torque T2 of the operating point $OP_2$ (see dotted line during time T3 to time T4 in FIG. 22B).

Figure 23:
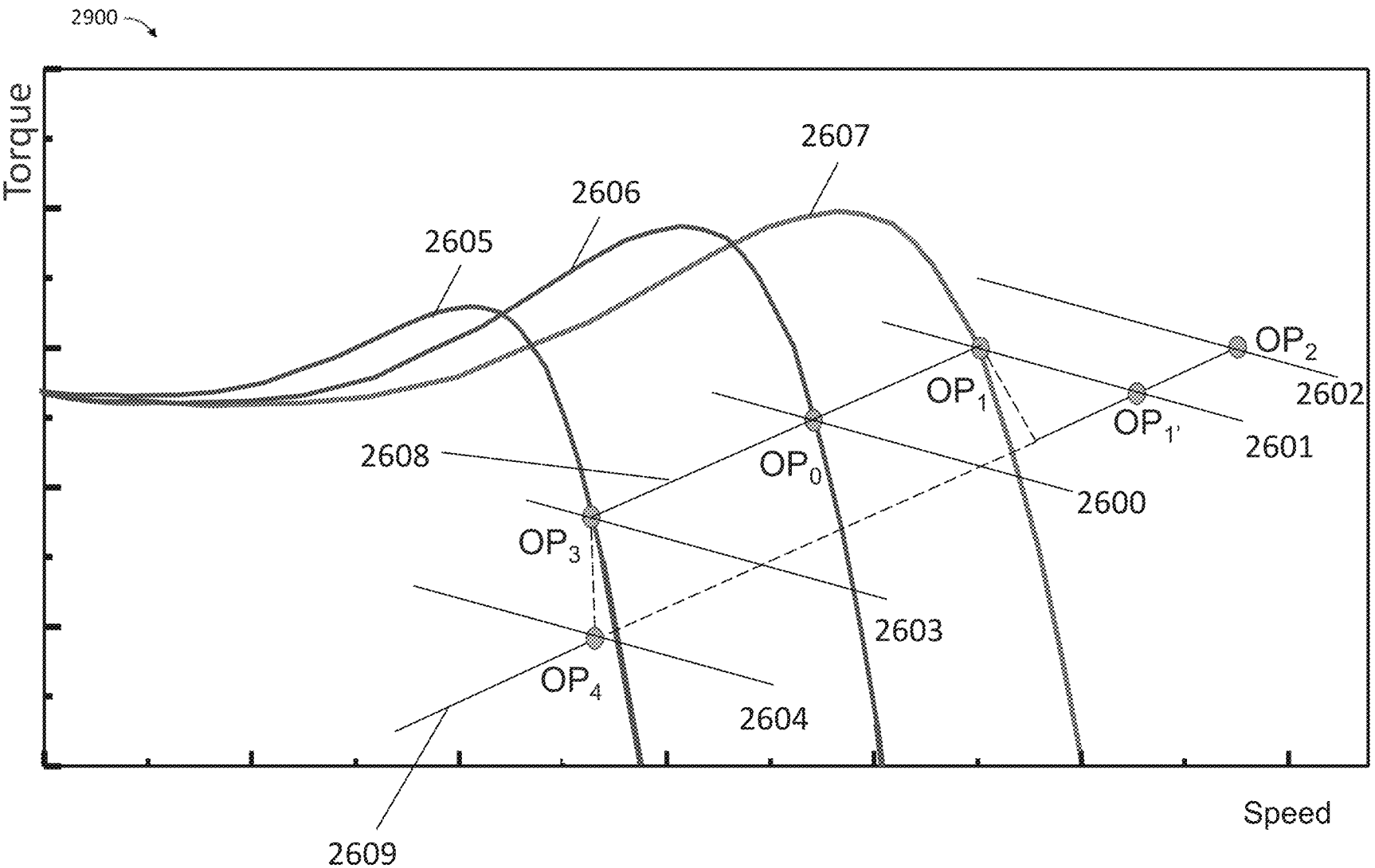
FIG. 23 illustrates a graph of reference function of a motor driving a drill string illustrating an example of a control process to determine if a current operating point is affected by whirling in the well bore according to one or more embodiments of the present disclosure.

Now referring to FIG. 23, FIG. 23 illustrates graph 2900 of a drill string reference function illustrating plotting the selected operating point $OP_0$ of a motor (e.g., motor 137) where the selected operating point $OP_0$ creates whirling conditions along the drill string and the BHA while the drill string is rotated by the motor (e.g. motor 137). The graph 2900 plots the motor driven by a power at a given frequency operated along a motor characteristic line 2605, 2606, 2607 with the X-axis being a speed of the motor and a Y-axis being a torque of the motor. Also, graph 2900 corresponds to the case of rotary system operation where rotary conditions are stable (i.e., no "stick-and-slip"). In the case shown in graph 2900, the selected operating point $OP_0$ is along rotational demand line 2608 of the drill-string under whirl condition, which is the intersection between the virtual characteristic line 2600 and the motor characteristic line 2606. Furthermore, when the controller imposes an upward shift to virtual drive characteristic line 2601 or a downward shift to virtual drive characteristic line 2603, the selected operating point $OP_0$ moves to operating point $OP_1$ or $OP_3$, respectively, which is still shown to be along the rotational demand line 2608 of the drill-string under whirl condition. Since the selected operating point $OP_0$ is estimated or verified to create whirl, the controller must then impose a variation of rotational speed by slowly changing to various virtual drive characteristic lines (2600-2604). For example, the controller changes the virtual drive characteristic upwards from line 2600 to 2601 or 2602. When applying the virtual drive characteristic 2601, the operating point may oscillate between $OP_1$ and $OP_{1'}$, as the rotational speed of the $OP_1$ corresponds to the upper limit of the occurrence of whirl. So $OP_1$ is corresponding the condition with whirl (demand line 2608), while $OP_{1'}$ is corresponding to the condition without whirl (demand line 2609). Obviously when operating along the demand line 2609, the controller lower the torque and increases the speed from the selected operating point $OP_0$ (and $OP_1$) to the new opeting points $OP_{1'}$ and $OP_2$ on the demand line 2609 without whirl.

In some embodiments, it is further envisioned that the controller may impose a shift downwards of the virtual drive characteristic line 2600 to line 2604 to produce an operating point $OP_4$ with a lower speed lower torque than the selected operating point $OP_0$ with the operating point $OP_4$ being along the non-whirl drill string rotational demand line 2609. One skilled in the art would appreciate how graph 2900 illustrates that case in how a sudden discontinuity in position of operating points may be used to eliminate or reduce whirl on the along the drill-sting and the BHA. For example, the controller may induce a change in the operating conditions (i.e., the selected operating point $OP_0$) by imposing a parallel shift of virtual drive characteristic lines (2600-2604), while keeping the slope relatively. The controller observes a sudden change of operating point for small increment in the shifting up or down of the virtual drive characteristic lines (2600-2604) and may conclude that the initial operating point (i.e., the selected operating point $OP_0$) was affected by whirl condition along the well-bore. If the initial operating point (i.e., the selected operating point $OP_0$) is affected by whirl, the operating point follows a higher load demand in the vicinity of the initial operating point (i.e., the selected operating point $OP_0$) than another lower load demand when the operating point is shifter way from the initial operating point (i.e., the selected operating point $OP_0$). In such the case of whirl, the controller may then shift the operating point from the initial operating point (i.e., the selected operating point $OP_0$) affected by whirl to another operating point not affected by whirl (i.e., by shifting the virtual drive characteristic lines).

Figure 24:
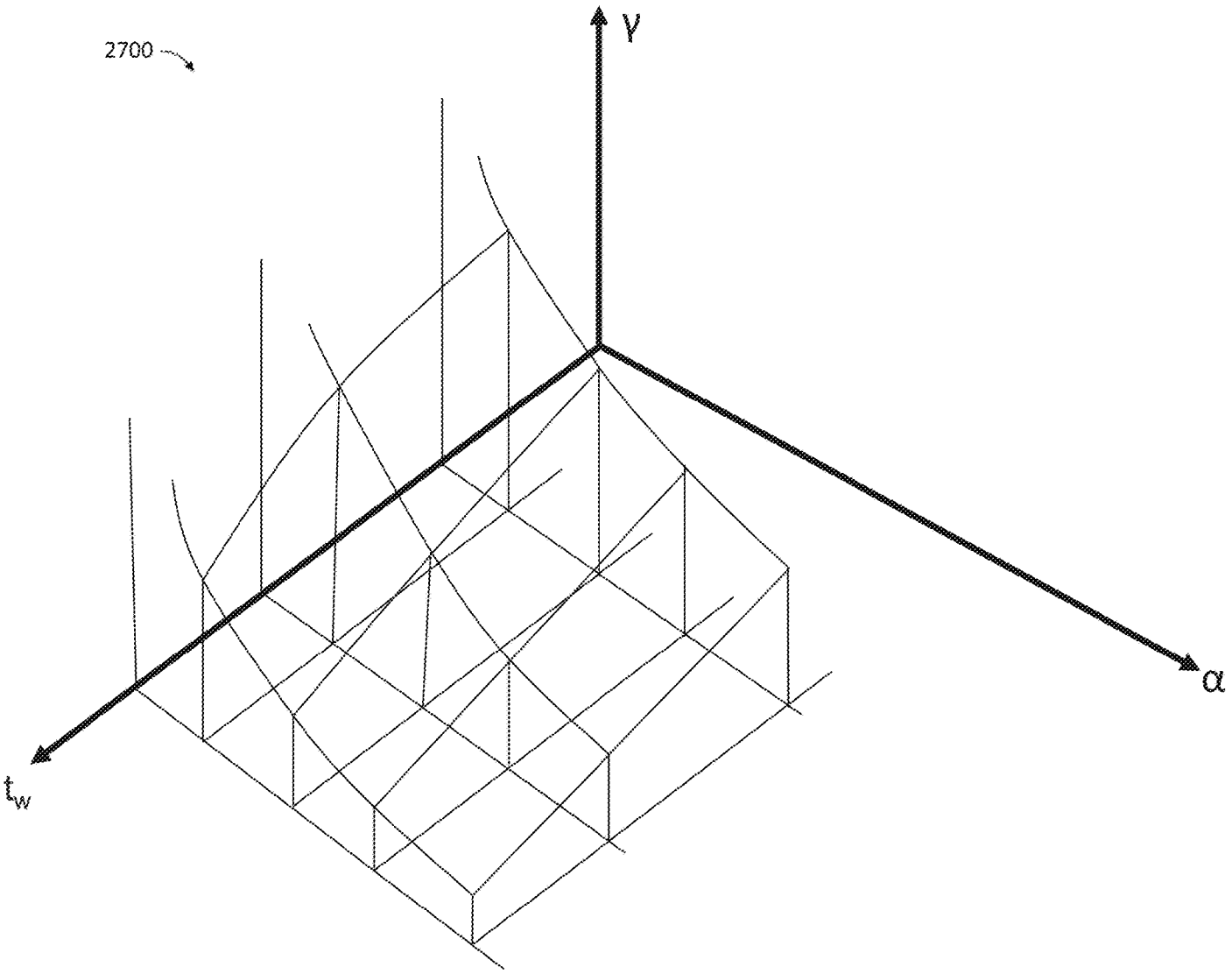
FIG. 24 illustrates a graph of an optimum configuration for $\alpha$, $\gamma$, and $t_{w\text{-}set}$ according to one or more embodiments of the present disclosure.

Referring to FIG. 24, FIG. 24 illustrates an x-y-z graph 2700 showing some dependence of critical parameters that may cause an effect on the operating point of the motor. For example, in the graph 2700, an X-axis may be a virtual drive characteristic slope $\alpha$, a Y-axis may be an adjustment rate $\lambda$, and a Z-axis may be an elapsed time $t_w$. The virtual drive characteristic slope $\alpha$ is a slope of the virtual drive characteristic line of a corresponding operating point. The adjustment rate $\lambda$ is a corresponding rate at which the motor changes the surface torque and the surface speed. The elapsed time $t_w$ is a time at which the motor is running at a new operating point, as defined in FIG. 21. Correspondingly, the elapsed time $t_w$ corresponding to whirl condition along the well-bore is affected by the adjustment rate $\lambda$ applied by the controller to change the operation of a variable frequency drive and a slope of the virtual drive characteristic ($\alpha$). As shown in the graph 2700, when the virtual drive characteristic slope $\alpha$ is lower (i.e., flatter virtual drive characteristic line), then the change of rotational speed is larger when the torque demand increases due to occurrence of whirl. In such a case, the transition from "no whirl" to "whirl occurrence" is more aggressive which means the elapsed time is shorter. In a similar way, the transition from "no whirl" to "whirl occurrence" is also more aggressive when the adjustment rate $\lambda$ is higher, as the virtual drive characteristic may change the drive condition faster. Furthermore, with a system involving less aggressive change between "no-whirl" to "whirl-occurrence", then the elapsed time $t_w$ may be lowered. It is further envisioned that the controller may use the x-y-z graph 2700 to separate whirling behavior from stick-and-slip behavior. For example, the controller relates a change in the time variation of torque and speed versus time versus time (i.e., the elapsed time $t_w$) versus the change of slope of virtual characteristic (i.e., virtual drive characteristic slope $\alpha$) and the adjustment rate (i.e., adjustment rate $\lambda$) to allow the change of the variable frequency drive to minimize the occurrence of whirling behavior.

Figure 25:
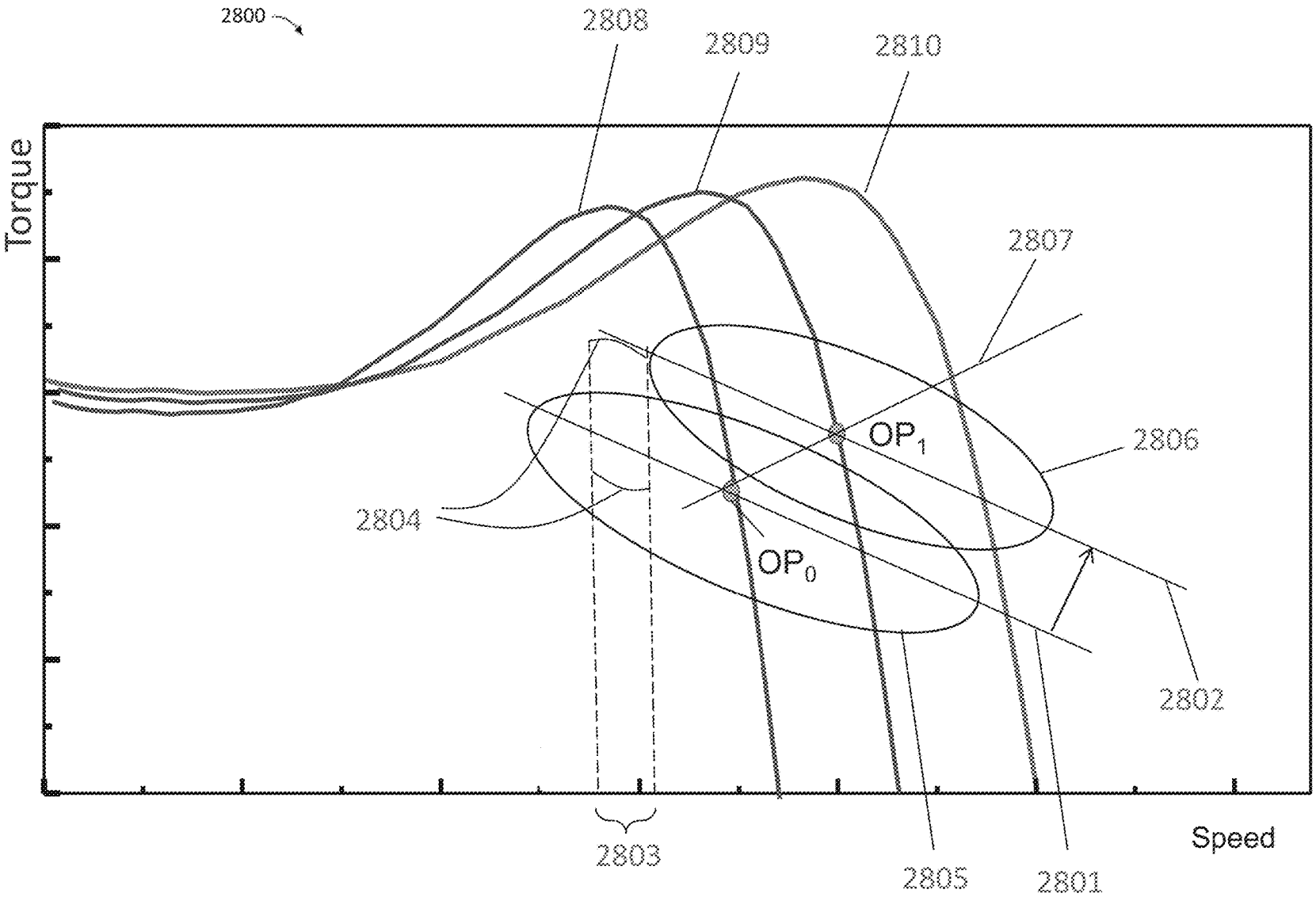
FIG. 25 illustrates a graph of reference function of a motor driving a drill string illustrating an example of a system output when whirl occurs according to one or more embodiments of the present disclosure.

FIG. 25 illustrates a graph 2800 of a drill string reference function illustrating an example of virtual drive characteristic (line 2801 and 2802) at an operating point of a motor (e.g., motor 137) while the drill string is rotated by the motor (e.g. motor 137) corresponding to rotary conditions that are not stable (i.e., stick-and-slip may occur along the drill-string or BHA). Additionally, the graph 2800 plots a motor driven by a power at a given frequency operated along a motor characteristic line 2808, 2809, 2810 with the X-axis being a speed of the motor and a Y-axis being a torque of the motor. In such non-stable rotary conditions, the drilling conditions would vary around the operating point OP0 (as described in FIG. 9). However, it is further envisioned that during low frequency oscillation of rotational speed due to the "stick-and-slip" effect, an instantaneous speed range 2803 may correspond to whirling conditions. The corresponding whirling condition may become established and an instantaneous torque range 2804 increases during the instantaneous speed range 2803 (i.e., the "range of whirl").

In some embodiments of a combination of "whirl" and "stick-and-slip," the rotary drilling system (e.g., the motor, drilling string and BHA) may be at an increased risk of being damaged. As there is the combination of "whirl" and "stick-and-slip," the controller may shift the virtual drive characterizes from line 2801 to line 2802. While it shown as an upward shift, the present disclosure is not limited to only an upward shift from line 2801 to line 2802 but may be a downward shift. It is further envisioned that the controller may optimized the parameters $\alpha$, $\beta$and $\lambda$, (as described above). Shifting from line 2801 to line 2802 and optimizing $\alpha$, $\beta$and $\lambda$ insures that the rotary drilling system is driven to not follow a first ellipse 2805 and stay driven on a second ellipse 2806. Additionally, the variation of torque and speed of the first ellipse 2805 and the second ellipse 2806 are caused by "stick-and-slip". Further, the first ellipse 2805 is centered about the operating point $OP_0$ and the second ellipse 2806 is centered about the new operating point $OP_1$. The operating point $OP_0$ is defined as an intersection of the motor output characteristic 2808 and a drill string rotational demand 2807. The new operating point $OP_1$ is defined as an intersection of the motor output characteristic 2809 and a drill string rotational demand 2807. Both intersections correspond to the torque loading imposed by the motor on the drill string at the corresponding operating point. As further shown by graph 2800, with proper adjustment of the operating point $OP_1$, and $\alpha$, $\beta$ and $\lambda$, a range of variation of rotational speed (i.e., the second ellipse 2806) should not overlap with speed range of "whirl" (i.e., the instantaneous speed range 2803).

Thus, embodiments of the present disclosure relate to distinguishing between stick-slip and whirl in the torque response. The torque response may be detected and measured at the surface, such as by sensors 135 (shown in FIG. 2), or downhole, such as by sensors 164. If the torque is detected downhole by sensors 164, the collected data may be transmitted to the surface, acquired by data acquisition unit 117, and analyzed by controller 139 that controls motor 137. For example, as described above, the down-hole telemetry 313B may be MWD wireless telemetry such as MWD mud-pulse telemetry or MWD E-mag telemetry. The topside sensors 135 can determine sensor data 313B which is transmitted by conventional surface communication (such as Wi-Fi or Bluetooth) to the controller 139 of the top drive system 115. Thus, by analyzing the data, such as the torque over time or the torque versus speed, the diagnosis of whirling versus stick-slip may be made. If whirling is determined, then the speed of the motor may be varied to get out of whirling. Controller 139 may propose and implement such change in motor speed.

In one or more embodiments, if is determined that whirling is present the operating point (imposed by the driller) may be slightly changed. For example, to go faster, the VDC line may be raised, whereas it may be lowered to go slower. It is also envisioned that the angle of the VDC may be shifted. In the event of stick-slip, one of three optimization processes may be followed. These include: (1) forcing the motor to operate following a VDC between torque and RPM, (2) tuning "a virtual motor rotor inertia" (flywheel) to affect the resonance frequency of the drill-string as well as the phase of the reflected wave at the top of the drill-sting, and (3) use of a "controlled low pass filter to adjust the VFD frequency" versus time (to limit the rate of change of the VDF).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system to reduce a whirl effect on a rotation of a drill string, comprising:

an AC induction motor mechanically coupled to a rotary drilling system and configured to drive the rotary drilling system and the drill string attached thereto;

an electronic inverter to generate supplied power for the AC induction motor; and a controller configured to:

drive the operation of the electronic inverter to impose a virtual drive characteristic relating a torque output of the motor with speed of the motor, wherein the virtual drive characteristic is a linear relation between torques of the motor versus speeds of the motor, while passing by a selected averaged operating point;

determine a desired nominal operating point;

determine presence of whirl in the drill string from torque of the rotary drilling system and speed of the drill string;

determine presence of whirl or stick-and-slip behavior from an observed torque versus speed response of the rotary drilling system and drill string for a first predetermined time duration of the observed torque versus speed response, wherein a time variation of torque and speed versus time display a periodic behavior, wherein each time period includes two time lapses of relatively steady values of torque and speed, wherein a first time lapse displays higher values of torque and speed than a second time lapse, the two time lapses of relatively steady values of torque and speed are separated by a second predetermined time duration of non-proportional and non-linear torque and speed; and monitor the periodic behavior to determine a presence of unsteady whirl conditions along a wellbore.

2. The system of claim 1, wherein the controller is configured to adjust the speed of the drill string in response to the determination of presence of whirl.

3. The system of claim 1, wherein the controller is configured to differentiate between whirl and stick-and-slip phenomena along the drill string.

4. The system of claim 1, wherein the controller is configured to select a first frequency to drive the electronic inverter so that the AC induction motor response matches the virtual drive characteristics within a range of frequencies.

5. The system of claim 1, wherein the controller determines presence of whirl by detecting a plateau over a period of time of increased torque demand at the motor simultaneous with a decreased of rotational speed of the motor.

6. The system of claim 1, wherein the time lapses corresponding to whirl condition along the well-bore is affected by a rate of adjustment applied by the controller to change the operation of a variable frequency drive and a slope of the virtual drive characteristic.

7. The system of claim 1, wherein the controller induces a change in operating conditions by imposing a parallel shift of the virtual drive characteristic with a similar slope, wherein the controller observes a sudden change of an operating point for small increments in the shifting of the virtual drive characteristic, and the controller concludes that an initial operating point was affected by whirl condition along the well-bore.

8. The system of claim 7, wherein the controller shifts the operating point from the initial operating point affected by whirl to another operating point not affected by whirl by shifting the virtual drive characteristic.

9. The system of claim 1, further comprising a topside sensor configured to measure torque output of the rotary drilling system.

10. The system of claim 1, further comprising a downhole sensor configured to measure torque downhole; and telemetry to transmit the measured downhole torque to the controller.

11. The system of claim 1, wherein the controller:

is configured to adjust the speed of the drill string in response to the determination of presence of whirl;

is configured to differentiate between whirl and stick-and-slip phenomena along the drill string;

is configured to select a first frequency to drive the electronic inverter so that the AC induction motor response matches the virtual drive characteristics within a range of frequencies;

determines presence of whirl by detecting a plateau over a period of time of increased torque demand at the motor simultaneous with a decreased of rotational speed of the motor;

induces a change in operating conditions by imposing a parallel shift of the virtual drive characteristic with a similar slope, wherein the controller observes a sudden change of an operating point for small increments in the shifting of the virtual drive characteristic, and the controller concludes that an initial operating point was affected by whirl condition along the well-bore; and shifts the operating point from the initial operating point affected by whirl to another operating point not affected by whirl by shifting the virtual drive characteristic.

12. The system of claim 11, wherein the time lapses corresponding to whirl condition along the well-bore is affected by a rate of adjustment applied by the controller to change the operation of a variable frequency drive and a slope of the virtual drive characteristic.

13. A method to detect a whirl effect on a drill string, comprising:

driving a rotary drilling system, and the drill string attached thereto, with an AC induction motor having power supplied by an electronic inverter along a virtual drive characteristic relating torque output of the motor with speed of the motor, wherein the virtual drive characteristic is a linear relation between torques of the motor versus speeds of the motor, while passing by a selected averaged operating point;

determining a presence of whirl in the drill string from a torque of the rotary drilling system and a speed of the drill string;

determining a presence of whirl or stick-and-slip behavior from an observed torque versus speed response of the rotary drilling system and drill string for a first predetermined time duration of the observed torque versus speed response, wherein a time variation of torque and speed versus time display a periodic behavior, wherein each time period includes two time lapses of relatively steady values of torque and speed, wherein a first time lapse displays higher values of torque and speed than a second time lapse, the two time lapses of relatively steady values of torque and speed are separated by a second predetermined time duration of non-proportional and non-linear torque and speed; and monitoring the periodic behavior to determine a presence of unsteady whirl conditions along a wellbore; and adjusting the speed of the drill string in response to determining the presence of whirl.

14. The method of claim 13, further comprising measuring torque downhole; and transmitting the measured downhole torque to surface equipment.

* * * * *